United States Patent [19]

Bendall et al.

[11] 3,982,832

[45] Sept. 28, 1976

[54] ELECTROSTATOGRAPHIC COPYING MACHINES

[75] Inventors: Dennis M. Bendall, Coleford; Peter M. Thorp, Lydbrook, both of England

[73] Assignee: Rank Xerox Ltd., London, England

[22] Filed: Nov. 7, 1974

[21] Appl. No.: 521,701

Related U.S. Application Data

[63] Continuation of Ser. No. 371,455, June 19, 1973, abandoned.

[30] Foreign Application Priority Data

June 23, 1972 United Kingdom ..... 29648/72

[52] U.S. Cl. ..... 355/8; 355/14

[51] Int. Cl.[2] ..... G03G 15/30

[58] Field of Search ..... 355/8, 14, 50, 51, 17

[56] References Cited

UNITED STATES PATENTS

| | | | |
|---|---|---|---|
| 3,575,503 | 4/1971 | Van Auken et al. | 355/8 |
| 3,661,452 | 5/1972 | Hewes et al. | 355/3 R |
| 3,720,466 | 3/1973 | Koizumi | 355/8 |
| 3,736,055 | 5/1973 | Davidge et al. | 355/14 |
| 3,746,442 | 7/1973 | Davidson | 355/8 X |

*Primary Examiner*—L. T. Hix

*Assistant Examiner*—Kenneth C. Hutchison

[57] ABSTRACT

A copier system with an improved developer consumption in which a document is forwarded and reversed over an exposure slit for projecting multiple images onto a re-usable photoconductive surface moving in the same direction. The surface is charged then exposed, and developed, and then transferred onto copy sheet before repeating the cycle. During document reversal the charging of the surface is eliminated to prevent images being formed and developed.

2 Claims, 40 Drawing Figures

ELECTROSTATOGRAPHIC COPYING MACHINES

This is a continuation of application Ser. No. 371,455, filed 6/19/73 now abandoned.

This invention relates to electrostatographic reproducing machines, and in particular to an automatic electrophotographic reproducing machine for producing permanent copies of relatively large documents such as engineering drawings.

One known process which is commonly used for reproducing large drawings is the diazo process. Although this process produces good copies, and as many as are required from a single master, the process suffers from the disadvantage that it is necessary for the master to be transparent. Thus, if an opaque original is to be copied, a transparency of it must first be made. Furthermore, there are the disadvantages that it is necessary to use sensitised copy paper, and to use potentially harmful chemicals such as ammonia for developing the image.

In an attempt to overcome these disadvantages, suitable electrostatographic reproducing machines have been developed.

In the electrostatographic process known as xerography, as disclosed for example in U.S. Pat. No. 2,297,691, a xerographic plate comprising a layer of photoconductive insulating material on a conductive backing is given a uniform electric charge over its surface and is then exposed to the subject matter to be reproduced, usually by conventional projection techniques. This exposure discharges the plate areas in accordance with the radiation intensity that reaches them, and thereby creates an electrostatic latent image on or in the photoconductive layer. Development of the latent image is effected with an electrostatically charged, finely divided material such as an electroscopic powder that is brought into surface contact with the photoconductive layer and is held thereon electrostatically in a pattern corresponding to the electrostatic latent image. Thereafter, the developed xerograhic powder image is usually transferred to a support surface to which it may be fixed by any suitable means.

There exist xerographic machines, such as the machine described in our U.K. Pat. Specification No. 1,094,188, which will produce copies of relatively large documents, such as engineering drawings. These known machines, however, suffer from the disadvantages that they tend to be rather slow in operation, and that they are not capable of producing multiple copies of a document except by repeatedly inserting and removing the document in the machine.

Furthermore, such machines are of rather large dimensions, thereby utilizing valuable space and presenting shipment and removal problems. Known machines of more compact dimensions suffer from the disadvantages that only flexible documents of limited size (e.g. up to 24 inches wide and up to 36 inches long) can be copied, with the copies being of reduced size when copying such documents.

It is an object of the present invention to provide an electrophotograhic reproducing machine in which many of the disadvantages of these known machines are overcome.

According to the present invention there is provided an electrophotograhic reproducing machine comprising:

a. a document handler for feeding a document to be copied past an exposure slit, the document handler including means for reversing the document and refeeding it past the slit in order to produce, when desired, a plurality of copies, and means for delivering the document either to the front or to the rear of the machine;

b. an optical system comprising means for illuminating the document as it is fed past said exposure slit, and for forming an image of the document as the slit on an electrophotographic surface which is mounted for movement at a speed related to the speed at which the document is fed, said optical system incorporating a lens and mirror arrangement permitting an electrostatic latent image of the document to be formed on said surface in a selected one of a plurality of predetermined image sizes;

c. a copy material feeder arrangement for feeding copy material towards said surface, including means to cut a sheet of the material from a roll of the copy material with a length proportional to the length of said document to be copied, and alternative means for feeding pre-cut sheets of copy material, and registration means for aligning the leading edge of a copy material with the leading edge of the image on said surface;

d. means for developing the electrostatic latent image on the said surface;

e. means for transferring the developed image to said copy material sheet;

f. means for cleaning said surface;

g. means for fixing the developed image on the copy material sheet; and h. means for delivering the copy material sheet bearing the fixed image to the front or the rear of the machine.

The machine of the invention accordingly is able to produce as many copies as are required of a single document, and the original document can be transparent or opaque, and flexible or rigid. The document may typically be up to 36 inches wide, and as long as required, for example up to 10 feet. Copies may be made on unsensitized paper which is supplied from a roll within the machine, or on pre-cut sheets of unsensitized paper. The machine can be made of relatively compact dimensions, with the main copying operations carried out at a convenient height.

A copying machine in accordance with the present invention will now be described, by way of example only, with reference to the accompanying drawings, in which.

BRIEF OUTLINE

Figure 1:
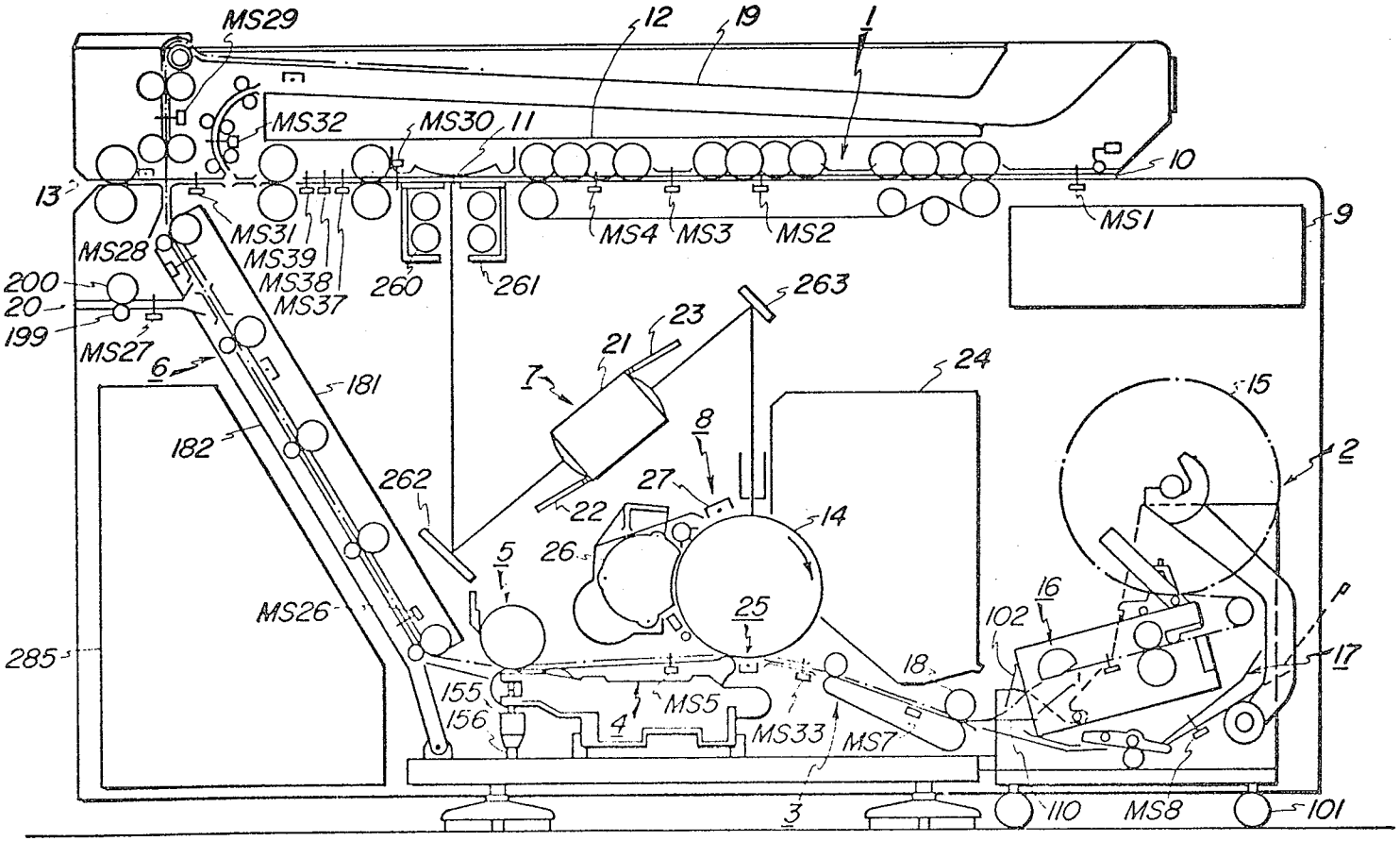
FIG. 1 is a diagramatic cross-sectional representation of the machine.

Referring to FIG. 1, a brief outline of the machine and its mode of operation will be given with reference to the major sub-units of the machine, followed by more detailed description of these sub-units.

The document to be copied is fed into a document handler 1 by way of a feed-in slot 10 at the front of the machine. The document is carried by the document handler 1 past an exposure slit 11, and is then conveyed either towards the front of the machine, to be delivered into a document tray 12, or to the rear of the machine, as required (or as necessitated by the stiffness of the document) through a rear exit slot 13. As the document is fed face down into the document handler 1, copy paper, from the copy paper feeder 2, is fed over a registration transport assembly 3 into contact with the xerographic drum 14 of the machine. Paper may be supplied either from a copy paper roll 15 which is then cut to the desired length by a rotary knife 16, or may be fed in cut lengths through a manual feed chute 17. In either case, the leading edge of the copy paper is briefly held in contact with a registration roller 18 of the registration transport assembly 3. On receipt of an appropriate signal, the registration transport assembly 3 is started, to feed the copy paper sheet forward so that the leading edge of the copy paper sheet is in registration with the leading edge of the developed image which is brought into transferring contact with the copy paper sheet by rotation of the drum 14. The copy paper sheet, carrying the transferred image, is carried along the horizontal transport assembly 4 to a fuser assembly 5, where the image is heat-fixed onto the copy paper sheet. The copy paper sheet, carrying the fixed image, is then fed into the lower end of a vertical transport assembly 6, to be fed as required, either into a copy tray 19 mounted above the document tray 12, or through a rear exit mouth 20. If the document is being fed to the rear of the machine, the copy must also be fed to the rear of the machine, otherwise there would be a collision of the document and the copy.

As the document passes over the exposure slit 11 an image of the document is projected by an optical system 7 onto the photoconductive drum 14 of a xerographic system 8. The optical system 7 is capable of providing full-sized images (100 percent mode), or images in one of two magnification modes (70 percent or 50 percent). For this purpose, the optical system comprises a main lens 21 which produces a 70 percent magnification, and two add-lenses 22 and 23 which are individually brought into the optical path of the optical system to produce respectively 100 percent and 50 percent images. At the same time the whole lens assembly is moved along the optical path so as to obtain the correct object and image distances for each mode. In this way it is possible to maintain a fixed conjugate length of the optical system. At the xerographic system 8, the image is projected onto the drum 14, and developed at developer station 24. The developed image is transferred to the copy paper at transfer station 25, after which the drum 14 is cleaned at cleaning station 26. The surface of the drum is charged ready for the imaging cycle by main charging corotron 27.

The electrical control system of the machine is indicated diagramatically at 9, and controls the times during ech imaging cycle at which the various mechanisms in the machine are brought into operation. There is also included a billing circuit, and the circuitry for permitting the machine to produce multiple copies, and for detecting and indicating document and copy paper jams. In order to produce multiple copies, the document handler 1 causes the document to be reversed over the exposure slit once the first copy has been made, and then to be re-fed so that a second copy may be made. The repetition of this backwards and forwards motion allows as many copies to be made as are desired. The control circuitry also causes the correct length of copy paper to be cut off by the rotary knife 16, in accordance with the length of the document, and the reduction mode which has been selected.

DOCUMENT HANDLER

Figure 2:
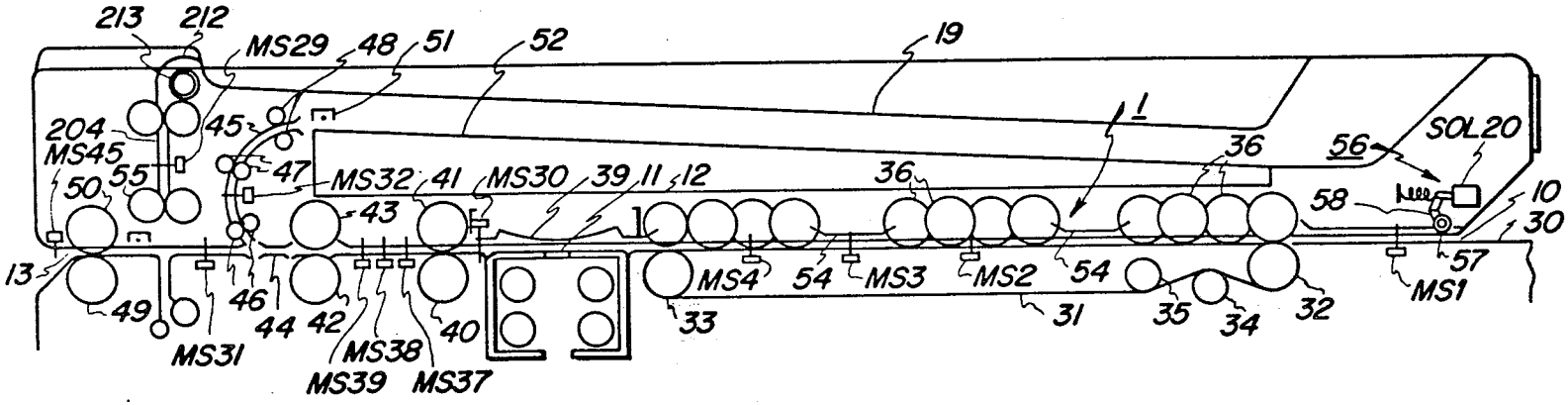
FIG. 2 is a diagramatic cross-sectional representation of the document handler of the machine.
Figure 3:
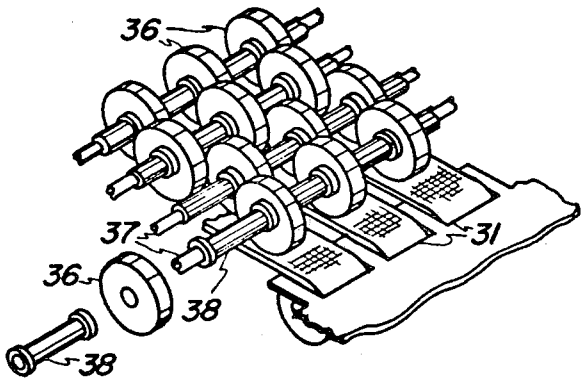
FIG. 3 is a detail view, in perspective, of part of the document handler.

The document handler is seen in FIGS. 2 and 3. An original document, which may be opaque or transparent, and which may be of flexible or rigid material, is fed into the document handler at feed-in slot 10. Feed-in slot 10 is formed between the underside of the document tray 12 and a feed-in platform 30 mounted on the top front portion of the main machine frame. Assuming that the machine is in a "print" condition, a set of conveyor belts 31 start to drive when the leading edge of the document actuates a microswitch MS1 the actuating arm of which extends into the path of the document. The conveyor belts 31 extend around rollers 32 and 33 which are journalled for rotation in the frame of the machine. The rear-most roller 33 is a drive roller for the belts 31, being driven through bevel gearing from a vertical shaft extending upwardly from a gear box which is driven by the machine main drive motor MOT1. On the lower run of the belts 31, tensioning and idler rollers 34 and 35 are provided.

Above and in contact with the conveyor belts 31 are a series of free-running rollers consisting of foam polyurethane discs 36, mounted in a staggered arrangement (as shown in FIG. 3) on a series of shafts 37. The discs are spaced apart by nylon spacers 38, which are a sliding fit over the shafts 37. The shafts 37 are supported by their ends in the underside of the document tray 12 in vertically elongated slots, so that the discs 36 press under the weight of the shafts 37 and spacers 38 on the belts 31. The discs 36 thus hold the document down onto the belts 31 as the document is conveyed towards the rear of the machine. There are three groups of discs 36, as shown in FIG. 2, and between the groups baffle members 54 are mounted on the underside of the document tray to prevent documents from wrapping around the discs 36. To assist in this, the baffle members 54 have sets of fingers which project into the spaces between the discs.

To the rear of drive roller 33 is the exposure slit 11, the document being driven between the exposure slit 11 and a platen 39 which is spring loaded into engagement with the document, and which is supported on the underside of the document tray 12. The platen 39 has a reflective white surface to enable transparent documents to be copied. Having passed between the exposure slit 11 and platen 39, the leading edge of the document is gripped between a rubber-coated roller 40 and a pinch roller 41 which rests under its own weight on top of the document, and maintains it in engagement with the drive roller 40. The document is further advanced by a pair of rollers 42, 43, exactly similar to the rollrs 40 and 41 respectively. Rollers 40 and 42 are both driven by belt drive, using toothed belts, from drive roller 33.

After passing between rollers 42 and 43, the leading edge of the document arrives at a deflector baffle 44, mounted on the machine frame and operated by a solenoid SOL1, which determines whether the document is fed forwardly and upwardly for delivery to the document tray 12, or rearwardly out of exit slot 13. In the case where the document is to be fed forwardly, it is fed around a curved guide 45, mounted on the document tray, by three pairs of rollers 46, 47 and 48. The rollers of each pair on the outside of the curve are driven through gear wheels and through a toothed belt from the shaft of roller 42. The drive is transmitted from a gear wheel on the shaft of drive roller 42 through a nylon intermediate gear wheel to a further gear wheel mounted on the shaft of the drive member of the pair of rollers 46. Since the curved guide 45, and the rollers 46, 47 and 48 are mounted on the document tray and since the document tray is hinged on the machine frame (at pivot points on each side of the upper vertical transport assembly 204) so that is can be lifted for access to the document path, it is desirable to ensure that the drive to rollers 46, 47 and 48 is maintained in constant mesh so that when the document tray 12 is lifted and replaced there is no possibility of a mis-mesh occurring. To this end the intermediate gear wheel is mounted at the pivotal junction of two arms which in turn pivot respectively at their other ends on the shafts of the rollers 42 and 46. As the document tray is lifted, the arms ensure that the nylon intermediate gear maintains its engagement with the gear wheels on the shaft of roller 42 and the shaft of the drive roller of the pair of rollers 46.

If the rear exit mode is selected for the document, the deflector baffle 44 feeds the document between a drive roller 49 and a set of polyurethane foam discs 50 similar to the discs 36 used in the underside of the document tray. The drive roller 49 is driven by a belt from the shaft of drive roller 42.

Throughout the document handler, while the document is passing from a stationary surface to the surface of a drive roller or conveyor belt, it is essential that it be impossible for the document to wrap around the drive roller or belt. To this end a set of fingers are provided between each one of the belts 31, the fingers extending from the platform 30 a short distance between each pair of belts. The various rollers which drive the document after the exposure slit 11, i.e. rollers 40, 42, 46, 47, 48 and 49, are not continuous cylindrical rollers, but consist of a series of separate drive portions, separated by narrower shaft portions. The drive portions have a frictional (e.g. rubber) surface for gripping the document, and as in the case of the drive belts, a set of fingers extends between each pair of driving portions of each roller.

Figure 4:
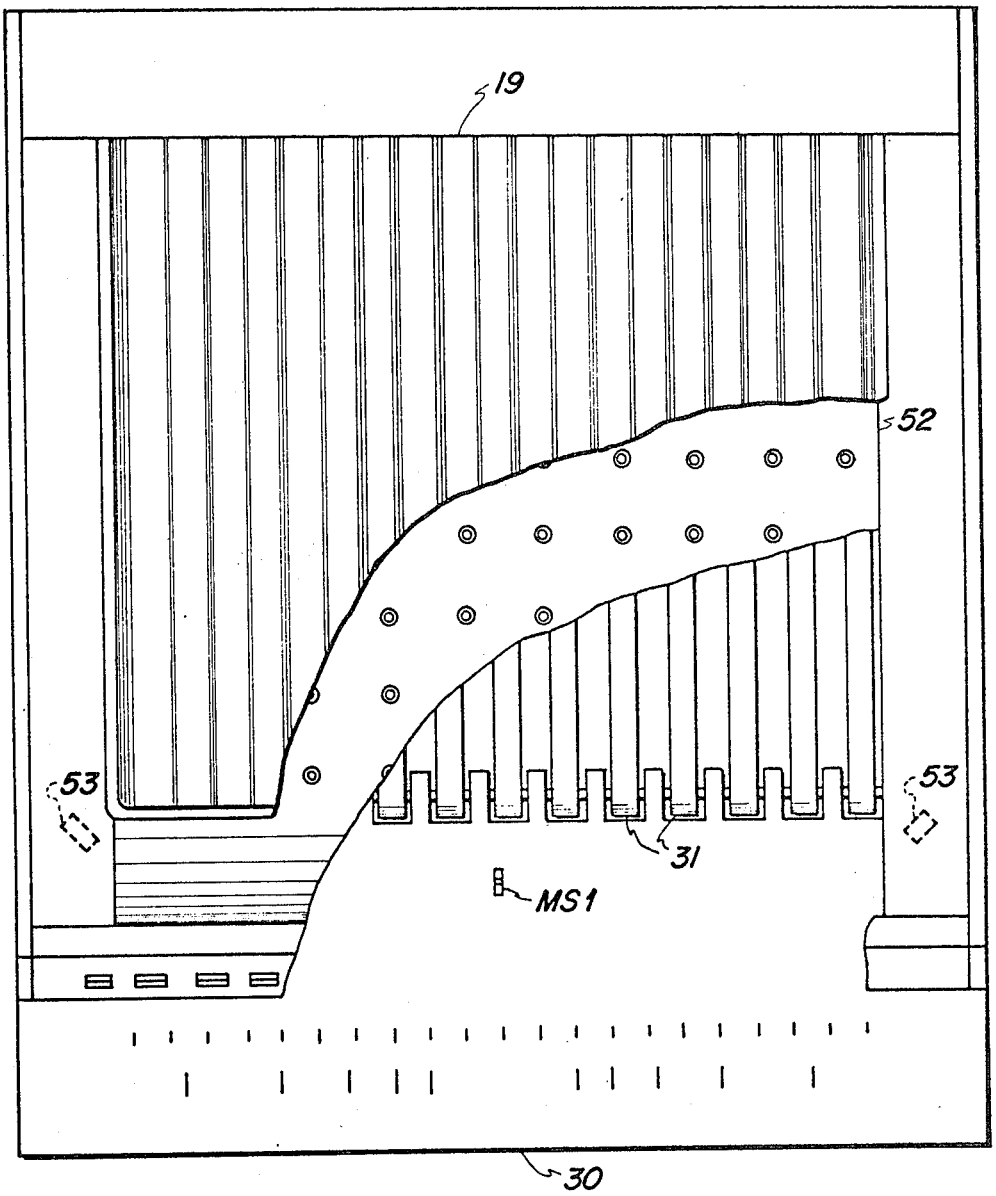
FIG. 4 is a plan view, with parts cut-away, of the machine.

When the document handler is delivering the document to the front of the machine, the document is delivered forwardly from the uppermost pair of rollers 48. The document, on emerging, passes under an a.c. corona discharge device 51 to ensure that the document has no retained static charge produced by friction between the document and the conveyor belts or rollers. The document then passes over the base 52 of the document tray 12, which slopes slightly downwards, towards the front of the machine, preferably at an angle of about 3° to the horizontal. The surface of the base 52 (FIG. 4) is perforated at intervals, and air is blown through the perforations to provide an air cushion which assists in floating the document down towards the front of the machine, thereby giving easy access to the operator. The perforations in the base 52 of the document tray are contained in individual dimples in the base 52, to provide a greater exit area for the air without increasing the size of the perforations. When the document is delivered to the rear, static charge is eliminated by an a.c. corona discharge device 55 mounted just in front of the roller 49 and discs 50.

In order to produce a number of copies from a single document, the document, instead of being fed out either into the document tray, or to the rear of the machine, is driven only until its trailing edge has just passed the exposure slit 11. The document drive system (belts 31 and rollers 40, 42, etc.) is driven in reverse at a speed somewhat faster than the forward speed, in order to bring the document quickly back over the exposure slit. Reversal takes place until the leading edge of the document (leading edge of a forward-moving document) has just passed back over the exposure slit 11. The document drive system is then stopped, and the document is fed forward again. This cycle is repeated the required number of times until on the last cycle the document is fed into the document tray 12 or to the rear of the machine as in the single copy mode.

In order to detect and allow the correction of skew in the document being fed, skew detection switches 53 are provided on the feed-in platform 30, just inside the feed-in slot 10. The switches 53 are micro-switches having actuator arms positioned in slots extending diagonally across the feed direction of the document. The skew detection switches 53 are set outside the widest limits of documents which can be handled by the machine, so that if a document is fed in which is skewed or which is too wide to be handled by the machine, at least one of the skew detection switches 53 is actuated. This causes the document drive to stop and then go into reverse thereby driving the document out of the machine and back to the operator through feed-in slot 10.

When the document is being fed into the machine, the drive speed depends upon the magnification mode. Preferred operational speeds are as follows:

100 percent mode - 8 inches/second;

70 percent mode - 11.35 inches/second;

50 percent mode - 16 inches/second.

In the reverse drive mode, the document is driven at 17.8 inches/second.

The multiple copy mode is inhibited for stiff documents, because of the danger of accidents caused by a stiff document travelling rapidly backwards out of the front of the machine. A stiff document detector switch MS45 is mounted in the document rear exit path.

As mentioned above, the document tray is pivotally mounted on the main machine frame to allow access to the document path. The pivot points of the document tray are at the rear of the tray, on each side of the upper vertical transport assembly 204, the weight of the tray being counter-balanced by gas springs positioned about half way along the side of the machine. The tray is held in a closed position by means of solenoid-actuated latches, which may be released to allow the tray to be lifted. The solenoids of the latches are actuated by pressing switches contained within recesses that are provided beneath the machine control panel for lifting the tray.

In order to prevent a second document from being fed into the machine before the machine is ready to accept it, a feed-in barrier 56 is mounted in the underside of the document tray, just inside the feed-in mouth 10, and in front of microswitch MS1. The feed-in barrier 56, as shown in FIG. 2, comprises rubber-coated roller 57 mounted, so as to be able to block a short section of the centre of the document feed-in mouth 10, between a pair of cranked arms 58. The arms 58 are pivotally mounted about their centre points, and carry the roller 57, which is rotatably mounted, at their lower ends. The upper ends of the arms 58 are connected to the plunger of a solenoid SOL 20 which, when actuated, causes the roller 57 to move downwards, from a stowed position within the document tray, into positive engagement with the feed-in platform 30. If, for any reason, a document is on the feed-in platform 30 when the barrier 56 is operated, the document may be withdrawn by the operator, the document causing the roller 57 to rotate.

COPY PAPER FEEDER

Figure 5:
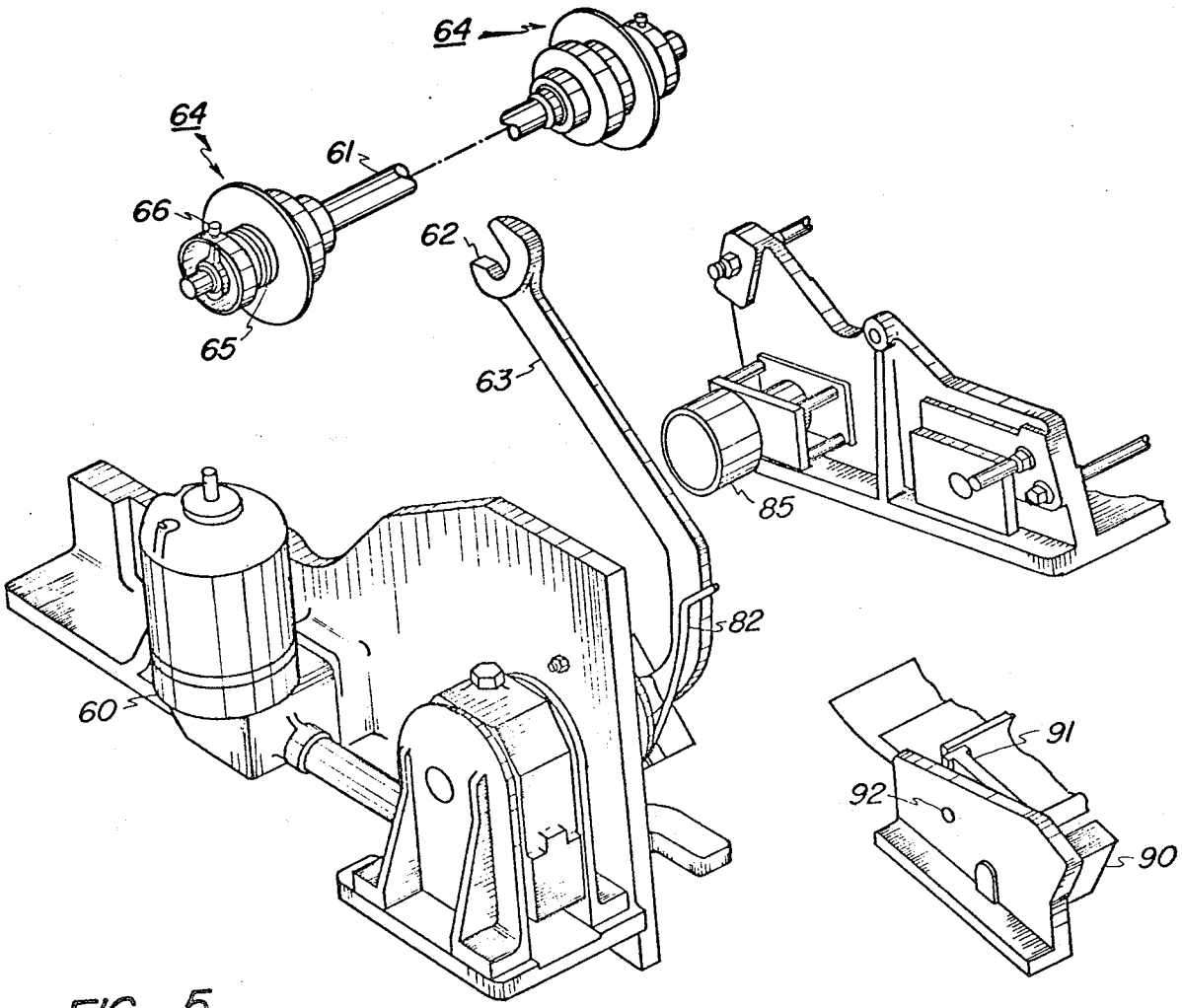
FIGS. 5 and 6 are respectively the left-hand and right-hand parts of an exploded perspective view of the copy paper feed unit of the machine.
Figure 6:
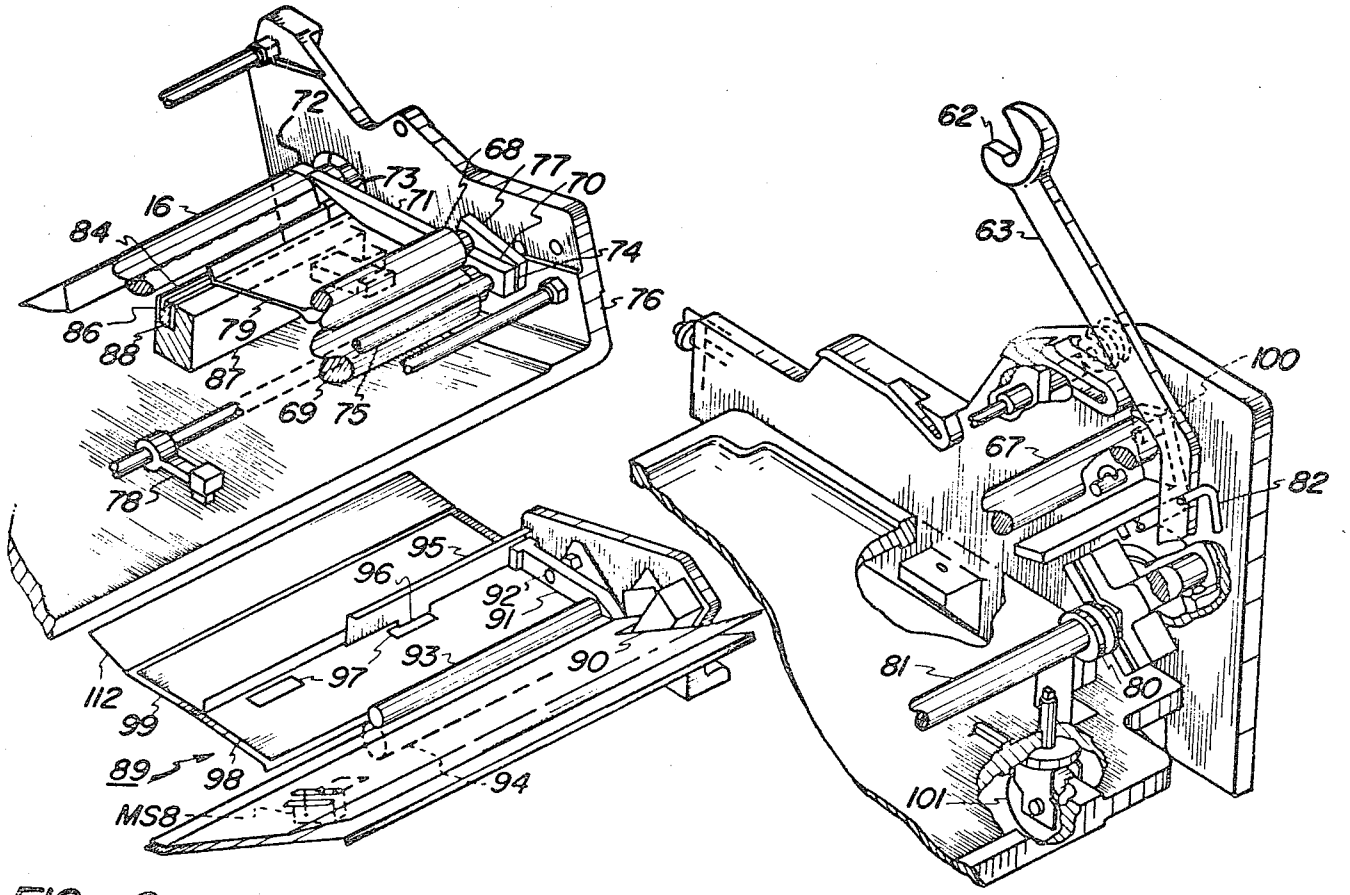
Figure 8:
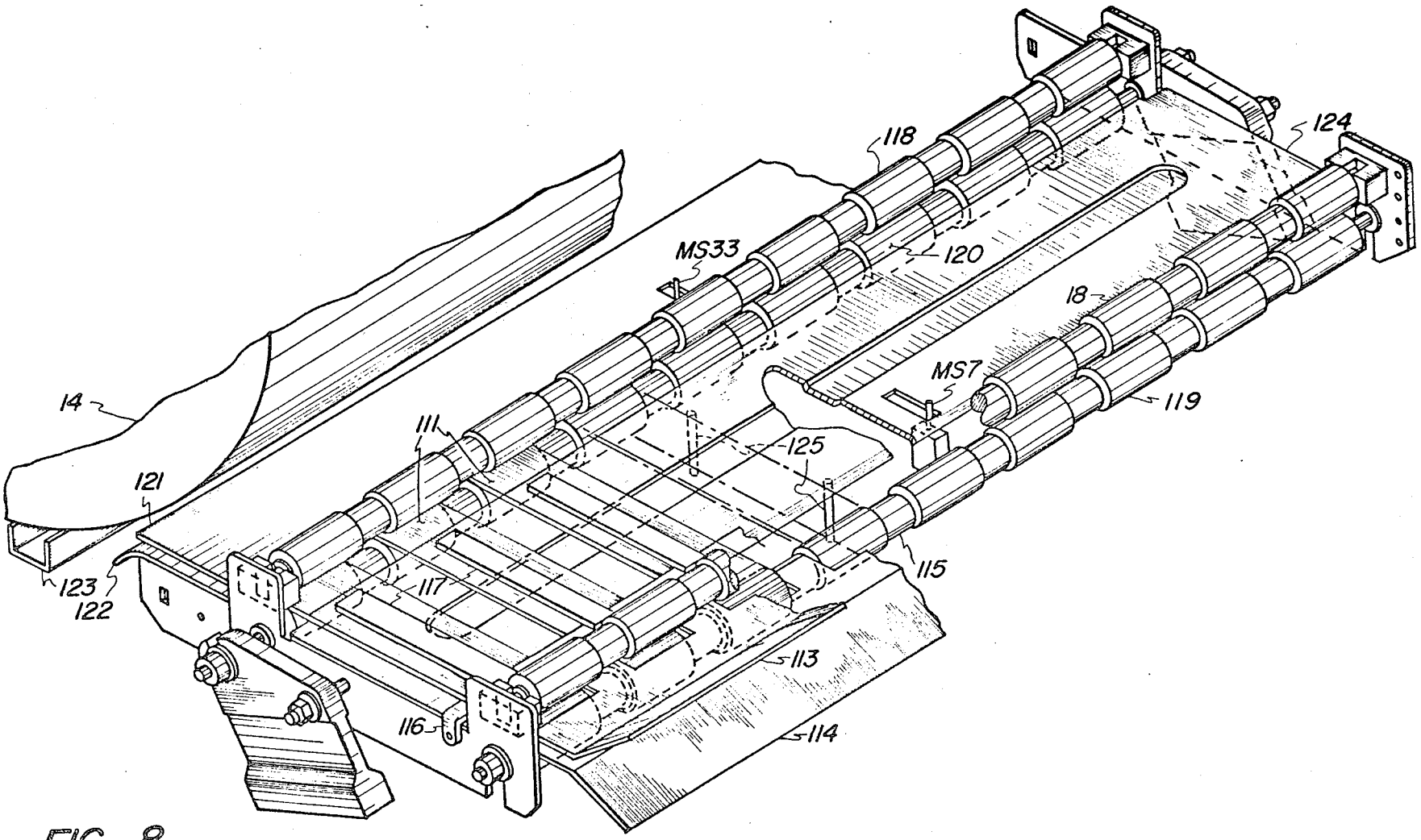
FIG. 8 is a perspective view, with parts cut-away, of the registration transport assembly for copy paper.

Reference is now made to FIGS. 5 and 6, which show respectively the left and right-hand portions of the paper feeding unit, as seen from the front of the machine. FIGS. 5 and 6 may be considered to be the two halves of an exploded perspective view of the paper feeding unit.

A supply of paper, in the form of a roll 15 (FIG. 1) is held on a spindle 61, the ends of the spindle 61 resting in receiving slots 62 in a pair of support arms 63. The support arms 63 are mounted for angular movement about their lower ends on a shaft 81, and are spring-biased towards their uppermost positions by means of torsion springs 82. The spindle 61 is provided with end plates 64 which are slidable along the spindle 61 and which are used to centre the roll of paper on the spindle, whatever the width of paper. The end plates 64 are positioned by means of a series of notches 65 in each end of the spindle, one notch at each end of the spindle being engaged by a spring-loaded pin 66 mounted in the end plate. The notches 65 are correspondingly numbered at each end of the spindle so that accurate centering can be carried out.

Since a full roll of paper is rather heavy, provision is made for automatic lifting of the roll of paper by the support arms 63. In order to install a new roll of paper, the support arms 63 are rotated about their lower ends in a clockwise direction as seen in the drawings. A new roll of paper is rolled up to the front of the machine, with its direction of feed being forwardly from the bottom of the roll. The spindle 61 is passed through the roll, and the end plates 64 of the spindle are adjusted to center the roll. The ends of the spindle 61 are then brought close to the receiving slots 62 of the support arms 63, the support arms being raised or lowered a fraction as required. The support arms 63 are driven to either raise or lower them through reduction gearing from a motor 60, the motor 60 only driving while pressure is maintained on the appropriate operating button. When the support arms 63 have been appropriately positioned, the roll is simply rolled forwards until the ends of the spindle engage in the receiving slots 62. The side arms 63 are then lifted to their uppermost positions by operating the motor 60. The extreme limits of motion of the support arms 63 are determined by micro-switches that are operated by cams 80 that are mounted for rotation with the arms 63.

With the copy paper roll 15 in position, the end of the paper is fed forwardly (i.e. towards the operator) from the bottom of the roll, around a guide roller 67 and then forwardly between pinch rollers 68 and 69 which, in operation of the feeder, feed paper towards the rotary knife 16. The paper path can best be seen in FIG. 1 where it is shown as a broken line as far as the rotary knife 16.

Roller 67 is mounted for rotation on the upper ends of a pair of side arms 100, the side arms 100 being spring-urged towards the front of the machine. When the copy paper is first fed from the roll 15, therefore, by the pinch rollers 68 and 69, it is not necessary to initially overcome the high starting inertia of the roll 15, but only the smaller resistance offered by the springs of side arms 100. Passing the copy paper round the roller 67 also assists in over- coming the natural tendency of the paper to curl in the direction in which it was wound onto the roll 15.

The lower pinch roller 69 is a rubber-faced driver roller, being operated from a continuous drive through a magnetic clutch (not shown) which causes the drive roller 69 to be driven in engagement with the copy paper for the desired length of time. The continuous drive for the magnetic clutch is derived, by toothed belts, from the input drive to the driven roller of the registration transport assembly 3 (see below). The upper roller 68 is a heavy roller which normally rests under its own weight on top of the paper. The axle ends of the upper roller 68 rest in depressions 70 in side arms 71, the side arms 71 being lifted so as to raise the upper roller 68 away from the lower roller 69 every time a cut is made by the rotary knife 16. The ends of the rotary knife 16 are provided with camming surfaces 72 upon which rest the forward ends 73 of the side arms 71. The rear ends 74 of the side arms 71 are secured to a shaft 75 which is journalled for rotation in the frame part 76 of the paper feeding unit. A pair of end members 77 are journalled for rotation on the shaft 75, between the side arm 71 and machine frame 76, and acts as supports for the axle ends of the upper roller 68. Thus, every time the rotary knife 16 is actuated, the side arms 71 are lifted at their forward ends 73, thereby raising the upper roller 68 away from the lower roller 69, and allowing an accurate cut to be made in the copy paper. As the side arms 71 are lifted, the shaft 75 rotates through a small angle, thereby causing a brake 78, secured to the shaft 75, to exert light pressure on the paper to steady it. The paper is guided in its progress from the rollers 68 and 69 to the rotary knife 16 by means of a pair of guide plates 79.

The rotary knife 16 is actuated at appropriate times by a rotary solenoid 85. The cutting edge of the rotary knife 16 is brought into cutting engagement with the cutting edge 84 of a stationary blade 86 which is resiliently mounted on a support 87 secured to the frame part 76. The blade 86 may be resiliently mounted on the support 87 by means, for example, of a strip 88 of resilient material such as rubber, between the blade 86 and the support 87. Alternatively, the blade 85 may be mounted by means of horizontally disposed springs spaced along the length of the blade 86 to give the required amount of resilience. In these circumstances, the lower edge of the blade 86 is journalled in fixed bearing blocks with the upper, cutting edge 84, of the blade being resiliently urged towards the rotary knife 16.

As can be seen from FIG. 6, the rotary knife is of generally semi-circular cross-section, and the cutting edge of the rotary knife extends helically along it. The stationary cutting blade 86 is set at a small angle to the direction parallel with the axis of rotation of the rotary knife. In this way, the point of cutting contact between the rotary knife and the stationary cutting edge travels across the paper sheet from one side to the other as the rotary knive rotates.

Figure 7:
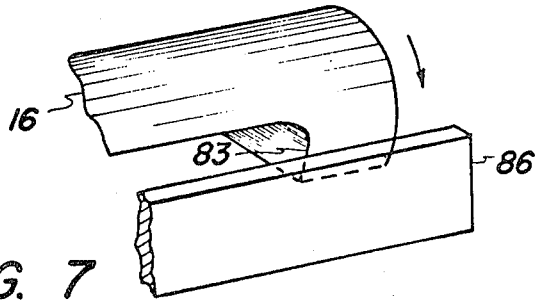
FIG. 7 is a detail view, in perspective, of part of a rotary knife of the copy paper feed unit.

In order to cleanly cut the copy paper, firm pressure must be exerted between the rotary knife and the stationary cutting edge. It is therefore necessary to provide a lead-in between the rotary knife and the stationary edge, otherwise the cutting edge of the rotary knife would impinge directly onto the stationary cutting blade 86 on actuation of the rotary knife, without making cutting engagement with it. The lead-in of the present arrangement is provided as a projection 83 on the rotary knife 16, as shown in FIG. 7, the direction of cutting rotation being indicated by the arrow.

The copy paper feeder includes a "manual chop" facility, to enable the leading edge of copy paper fed from the roll 15 to be cut by manual operation of the rotary knife 16. Two well-shaped operator switches are provided so that the operator has to use two hands to actuate the rotary knife, thereby reducing the possibility of accidents.

The guide plates 79 have slots cut in them to accommodate the actuator arms of microswitches (not shown) which indicate to the billing circuit the width of paper being used in the machine.

Mounted immediately below the frame part 76 of the copy paper feeder is a manual feed unit 89. A cut sheet of paper of appropriate length is fed in through the manual feed chute 17, thereby actuating a microswitch MS8 whicn in turn operates a pair of solenoids 90 mounted on each side of the chute 17. The solenoids 90, on actuation, lift the front ends of levers 91 which are pivoted on pivots 92. The front ends of the levers 91 have bearings for an upper roller 93 of a pair of pinch rollers 93 and 94. The rear ends of the levers 91 rigidly carry a gate member 95. As the solenoids 90 are operated, upper roller 93 is lifted away from lower roller 94, and gate member 95 is lowered so that blocking fingers 96 extending below the gate member 95 drop through slots 97 in a guide plate 98. Guide plate 98, in co-operation with a lower guide path 99, forms a guide for the paper as it is fed through the manual feed unit.

Thus, as the paper is fed in, upper roller 93 is lifted, the gate member 95 is lowered, and the paper comes to rest with its leading edge against the blocking fingers 96. On receipt of a "feed" signal, the solenoids 90 are operated to lower the roller 93 into engagement with roller 94, at the same time lifting the gate 95. When the lower roller 94 is driven, for example in response to a document which is to be copied being fed into the machine, the copy paper is fed forward between guide plates 98 and 99, and into the registration transport system.

The manual feed unit allows cut sheets of different type, size or weight from the paper on the roll 15 to be fed into the machine. Furthermore, duplex copies (i.e. copies printed on both sides) may be made by re-feeding a copy upside down through the manual feed chute.

The control circuitry of the machine is arranged such that on completion of each manual sheet feed operation, the machine reverts to automatic operation.

The whole copy paper-feeder 2, including the manual feed unit 89, is mounted on castors 101 so that it can be easily removed from the machine for access to the interior of the machine and for ease of maintenance of the copy paper feeder.

REGISTRATION TRANSPORT ASSEMBLY

Copy paper which has been fed past the rotary knife 16 drops onto a guiding baffle 110 (FIG. 1) and the loading edge is fed into the nip between the registration roller 18 and conveyor belts 111 of the registration transport assembly 3. A hanging baffle plate 102, hinged about its upper edge above the guiding baffle 110, ensures that the copy paper is correctly fed by the guiding baffle 110. If copy paper is being fed manually, it is guided by a baffle 112 unit its leading edge is engaged by the nip between the registration roller 18 and the conveyor belts 111. The conveyor belts 111 extend between rollers 119 and 120, each belt passing round a wider driving portion of each roller, the wider portions being separated by narrower shaft portions. At the appropriate point in the copy cycle, the registration signal causes the belts 111 to be driven, so that the copy paper leading edge is carried up the registration transport assembly in time to coincide with the leading edge of the image on the drum 14. The registration transport system has entrance guide baffles 113 and 114, the upper baffle 113 having apertures which surround the driving portions of roller 119, and the lower baffle 114 has bridge portions 115 extending between the initial portions of the belts 111 so as to prevent the copy paper from wrapping around the underside of the drive belts 111.

The baffle 113 terminates in a strip 116 which extends across the width of the system, and which has a number of nylon strips 117 extendng from it, one strip 117 extending along, and resting on, each one of the belts 111. These strips 117 maintain the paper on the belts 111, the paper being fed, at the exit end of the belts 111, between the belts and a roller 118 which rests under its own weight on the belts 111.

Roller 120, at the exit end of the belts 111, is driven by a toothed belt from the main drive system through a magnetic clutch which causes the copy paper to be fed when required.

When copy paper is being fed from the copy paper feeder, the feed roller 69 is driven for slightly longer than is required to bring the leading edge of the paper into engagement in the nip between registration roller 18 and the conveyor belts 111. In this way, a buckle is formed in the paper between the rotary knife and the registration transport assembly. Thus, when it is desired to cut the trailing edge of the paper, the leading edge of the paper can continue to be fed at a uniform rate while the trailing edge of the paper is momentarily held stationary for the cut to be made.

On emerging from between the roller 118 and conveyor belts 111 where they pass around roller 120, the copy paper is guided by baffles 121 and 122 into engagement wth the surface of the xerographic drum 14. As the paper emerges from between baffles 121 and 122, it is attracted to the charged surface of the drum. At this point, of course, the drum carries a developed image, and paper is fed in the direction of rotation of the drum, at a speed the same as the surface speed of the drum, over a transfer corotron 123 which reduces the attraction of the image particles for the drum, thereby assisting the transfer of the developed image to the paper.

The conveyor belts 111 travel over a flat plate 124 between the rollers 119 and 120, the underside of the plate 124 carrying a series of pins 125 which extend downwards on each side of each belt 111 in its return path. The pins 125 accordingly maintain the belts 111 in their correct paths.

HORIZONTAL TRANSPORT ASSEMBLY

Figure 9:
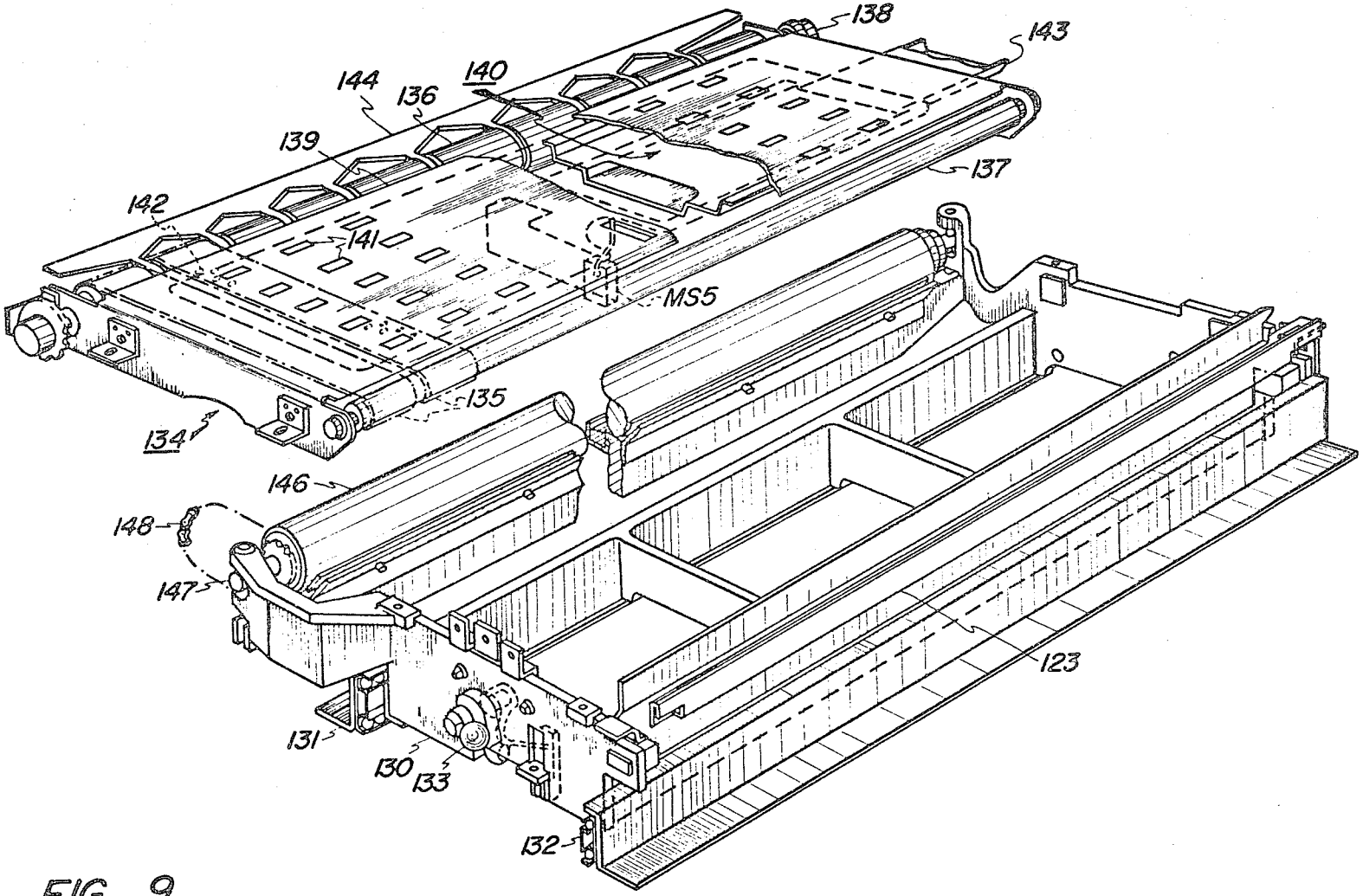
FIG. 9 is an exploded perspective view, with parts cut-away, of the horizontal transport assembly for copy paper.

The copy paper, carrying the developed image, is then carried by the horizontal transport assembly 4, towards the fuser assembly 5. The horizontal transport assembly will now be described with reference particularly to FIG. 9. enables the The base 130 of the horizontal transport assembly is slidably mounted between rails 131 and 132. This enablesthe whole of the horizontal transport assembly to be withdrawn sideways from the machine for clearing copy paper jams and for maintenance. A latching device operated by lever 133 allows the assembly to be locked into position, and unlocked for withdrawal. The transfer corotron 123, is mounted on the base of the assembly, immediately above the rail 132.

Mounted on the base 130 is sub-assembly 134, which includes a set of conveyor belts 135 that extend between two rollers 136 and 137. Roller 136 is a drive roller, being driven through drive wheel 138 which engages with a driving member (not shown) that is driven by the main drive system of the machine. When the horizontal transport assembly is locked into its operative position the drive wheel 138 positively engages with the driving member, and is disconnected when the horizontal transport assembly is withdrawn.

The belts 135 extend over a flat plate 139, which provides the upper surface of a vacuum chamber 140. The vacuum chamber 140 is used to draw air, via holes 141 in the plate 139, through holes in some of the belts 135. There are altogether ten belts 135, five on each side of the centre line of the machine. Considering only the five belts on one half of the machine, the three central belts of these five are provided with holes 142. In this way sheets of copy paper are held firmly in place on the horizontal transport assembly. An entrance mouth 143 of the vacuum chamber 140 abuts against one aperture in the casting on the drive side of the machine, a seal being provided by a resilient member, (not shown) surrounding the mouth 143, the aperture in the casting being connected to a vacuum source. On withdrawal of the bottom transport assembly, therefore, both the drive and the vacuum connections are broken. Similarly, electrical connections are made and broken by a plug and socket connector.

In order to prevent copy paper from wrapping around the exit end of the conveyor belts 135 and roller 136, a latterally extending baffle member 144 is provided, having nine fingers which extend between each adjacent pair of drive belts 135 with the ends of the fingers extending under the plate 139.

In order to separate the leading edge of the paper from the drum, a puffer 145 (FIG. 14) is provided to direct a number of jets of air against the leading edge of the paper just after the drum has carried it past the transfer corotron. Once the paper is on the horizontal transport assembly, it is held there by the vacuum arrangement.

The base 130 of the horizontal transport assembly also carries the back-up roll 146 of the fuser assembly. This back-up roll 146 (as will be explained in greater detail below) is mounted for rotation on a shaft 147 whicn in turn is mounted for vertical movement relative to the base 130. The back-up roll 146 is driven by means of a chain 148 from the drive roller 136 of the horizontal transport assembly.

FUSER ASSEMBLY

The image is fixed to the copy paper by means of a fuser assembly comprising an upper, heated fuser roll 151 and the lower, back-up roll 146. The operation of the fuser assembly will now be described with reference particularly to FIG. 10.

The heated fuser roll 151 is mounted for rotation in the machine frame, and contains an axially mounted quartz heater element 152. The fuser roll 151 is a hollow aluminum roll with a P.T.F.E. coating, and is driven through reduction gearing from the machine main drive motor MOT1. The roll is spring biased towards one side of the machine by means of a spring 153, thereby allowing for expansion of the fuser roll when it is at its operating temperature. As the roll expands on heating, the spring is compressed. When the fuser is operated, the back-up roll 146 is lifted into engagement with the fuser roll 151. The shaft 147 of the back-up roll is mounted (at each end) on vertical rods 154. In order to lift the back-up roll a horizontal bar 155 which carries the rods 154 is lifted from below pneumatically. Compressed air is supplied at the appropriate time to operate an actuator in the machine frame, the operating portion 156 (FIG. 1) of the actuator being arranged to lift the bar 155. As previously mentioned, the fuser back-up roll 146 is driven from the drive roller 136 of the horizontal transport assembly.

Figure 10:
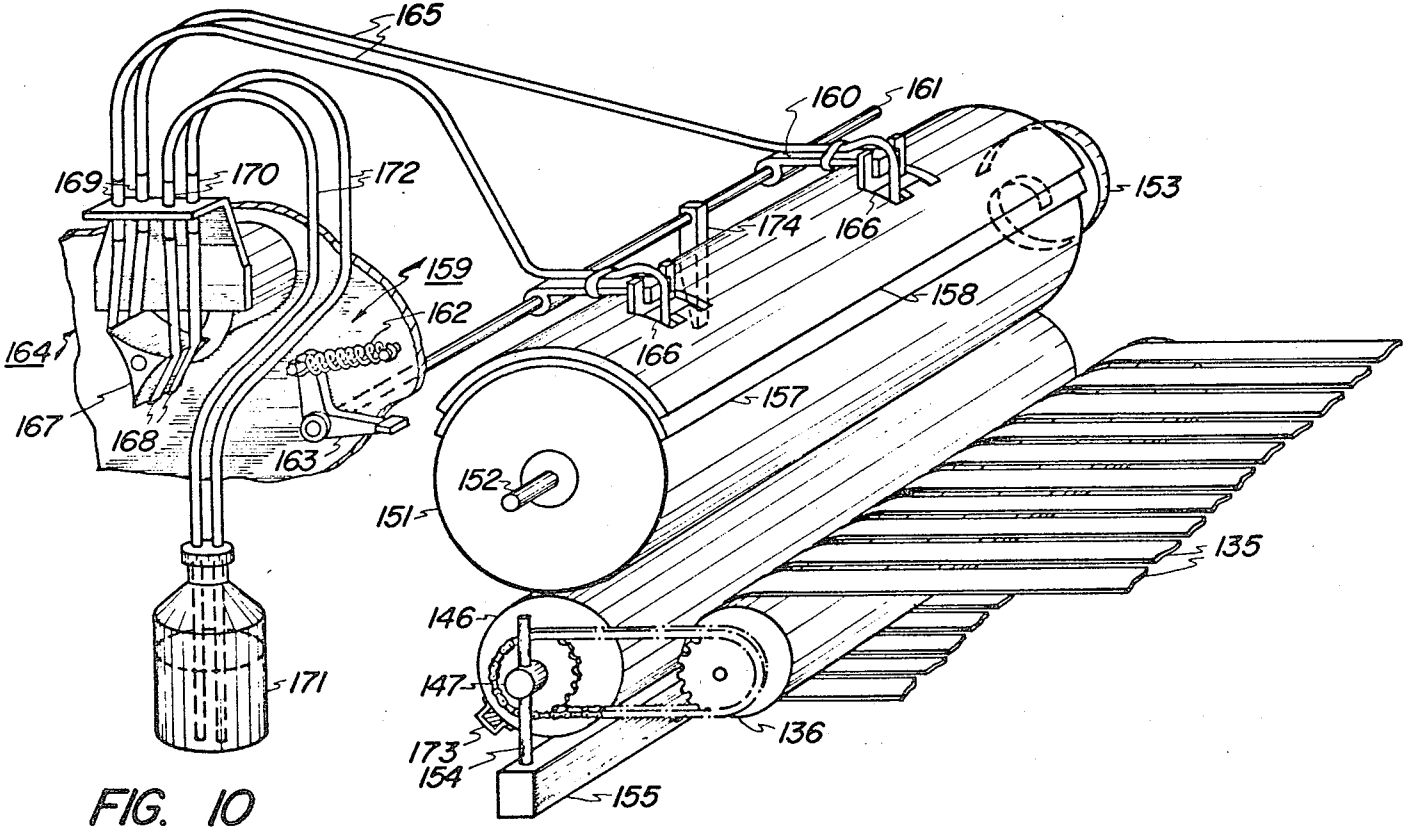
FIG. 10 is a diagramatic perspective view of the fuser assembly.

In order to prevent toner particles and paper sheets from sticking to the fuser roll, a fuser oil is continuously applied to it. Any suitable fuser oil may be used, in accordance with well-known requirements, preferred oils being silicon oils. The fuser oil is applied to the surface of the fuser roll by means of a felt wick 157 which is held in place on top of the fuser roll 151 by a partially cylindrical pressure plate 158. Pressure is exerted on the pressure plate 158 to maintain the wick 157 firmly in contact with the fuser roll by means of a spring arrangement 159 mounted on the machine frame. Two pressure levers 160 press down onto the plate 158, the levers 160 being mounted on a rod 161 which is urged by means of a spring 162 in a clockwise direction as seen in FIG. 10. In order to allow the wick 157 to be replaced or inspected, a lifting lever 163 is provided so that the pressure levers 160 may be lifted against the action of spring 162.

In order to supply fuser oil to the wick 157 a peristaltic pump 164 is mounted on the machine frame, and delivers fuser oil along two delivery tubes 165 to spaced apart holes 166 in the pressure plate 158. The peristaltic pump 164 comprises a slowly rotating, generally triangular shaped cam 67 around which plastic pumping tubes 168 are stretched between sets of rigidly mounted connectors 169 and 170. The rotation of cam 167 exerts a stroking action on the pumping tubes 168, progressively compressing the tubes 168 at the apices of the cam. Fuser oil is accordingly sucked from a supply bottle 171 which is mounted on the machine frame, through supply tubes 172 and is delivered as described above through delivery tubes 165.

Figure 33:
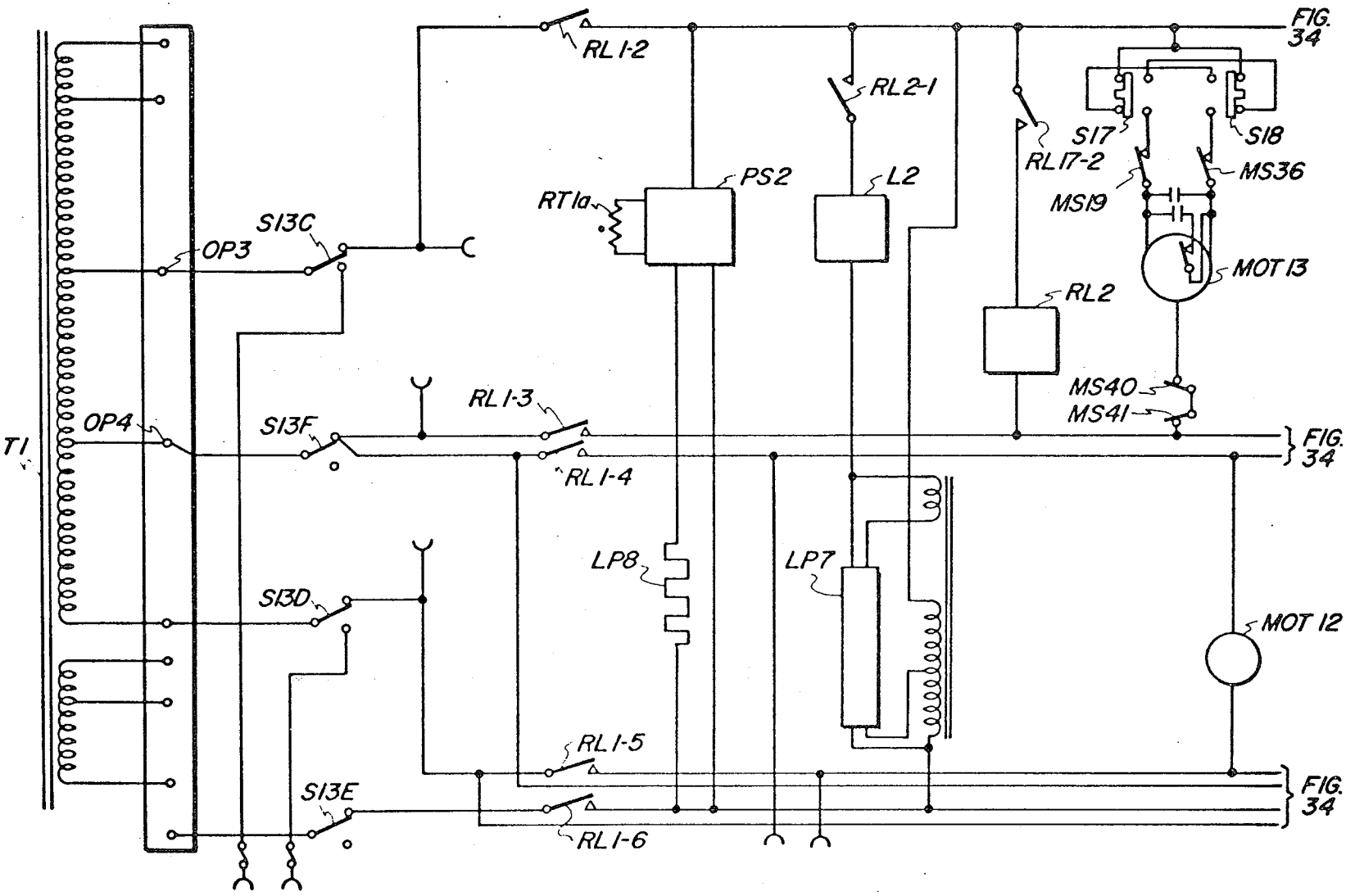
Figure 34:
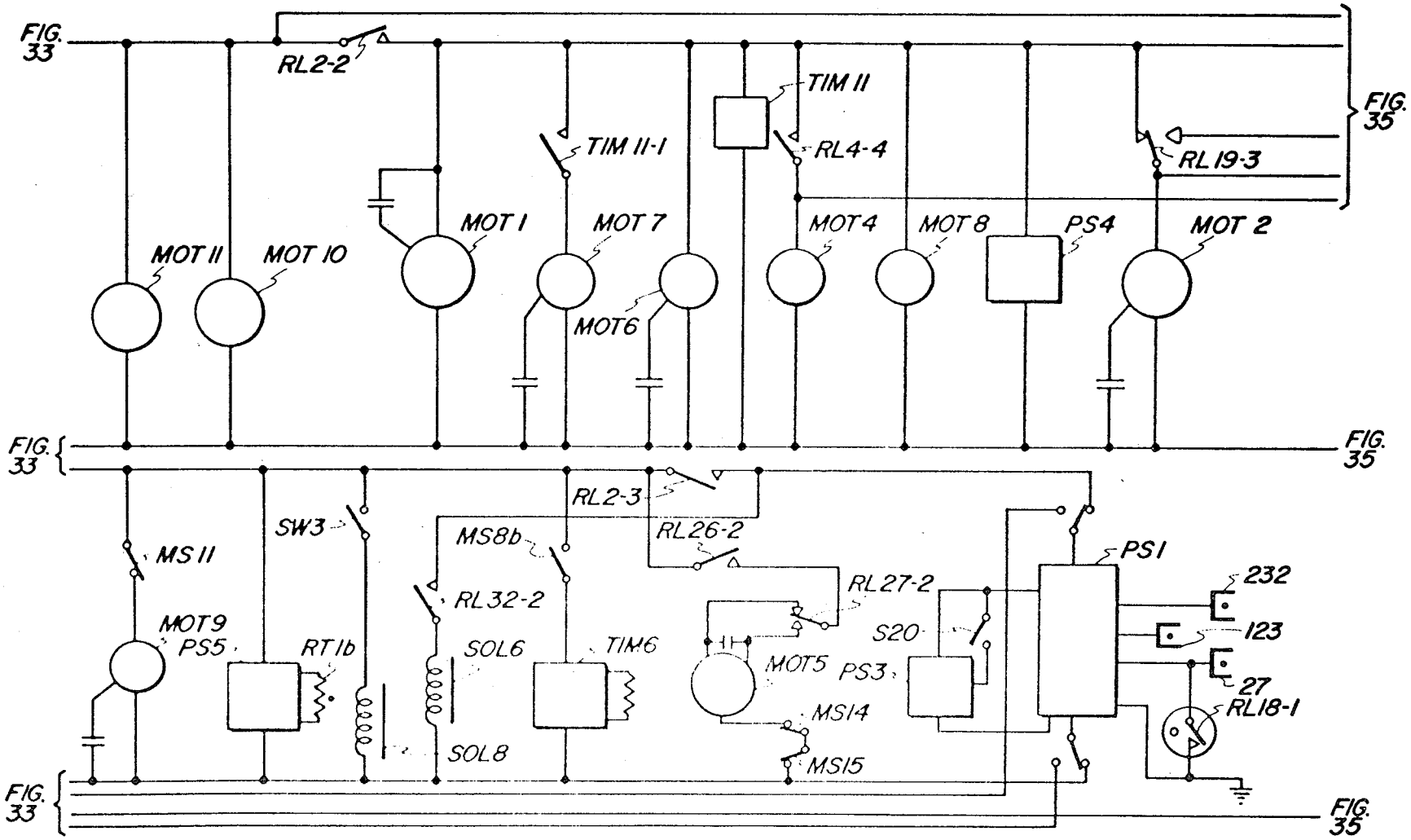

Thermistors RT1*a* and RT1*b* FIGS. 33 & 34 (not shown in FIG. 10) supply appropriate signals to a control unit PS2 which switches the heater element 152 (LP8) on an off, so as to maintain the fuser roll at the correct operating temperature, and to hold the machine in an inoperative state if the fuser temperature is not sufficiently high.

The thermistors are mounted in contact with a copper track at one end of the fuser roll. Mounted adjacent the copper track is a thermostat TH1 which shuts down the machine if the fuser roll overheats.

A cleaning wick 173 is mounted adjacent the back-up roll 146 to keep it clear of fuser oil and toner particles.

The back-up roll is of cylindrical configuration, with straight, parallel sides. The fuser roll 151, however, is of tapered configuration, being slightly narrower at the centre than at the two ends. Fuser rolls of such configuration are described and claimed in our co-pending U.S. Pat. application No. 45,566/70. Such a tapered fuser roll greatly reduces any tendency of the fuser assembly to crease the copy paper.

The copy paper, carrying the fixed image, is fed from the fuser assembly 5 towards the lower part of the vertical transport assembly 6 (FIG. 1). In order to prevent the paper from wrapping around the fuser roll 151, a stripper finger 174 extends downwardly from rod 161 and is lightly weighted into engagement with the fuser roll 151.

Mounted directly above the fuser assembly 5 is a heat shield (not shown) which reduces the amount of heat radiated (or convected) from the fuser assembly to the optical system. The prevention of convection currents prevents dust and toner particles from being carried into those parts of the machine where it would cause damage.

VERTICAL TRANSPORT ASSEMBLY

Figure 11:
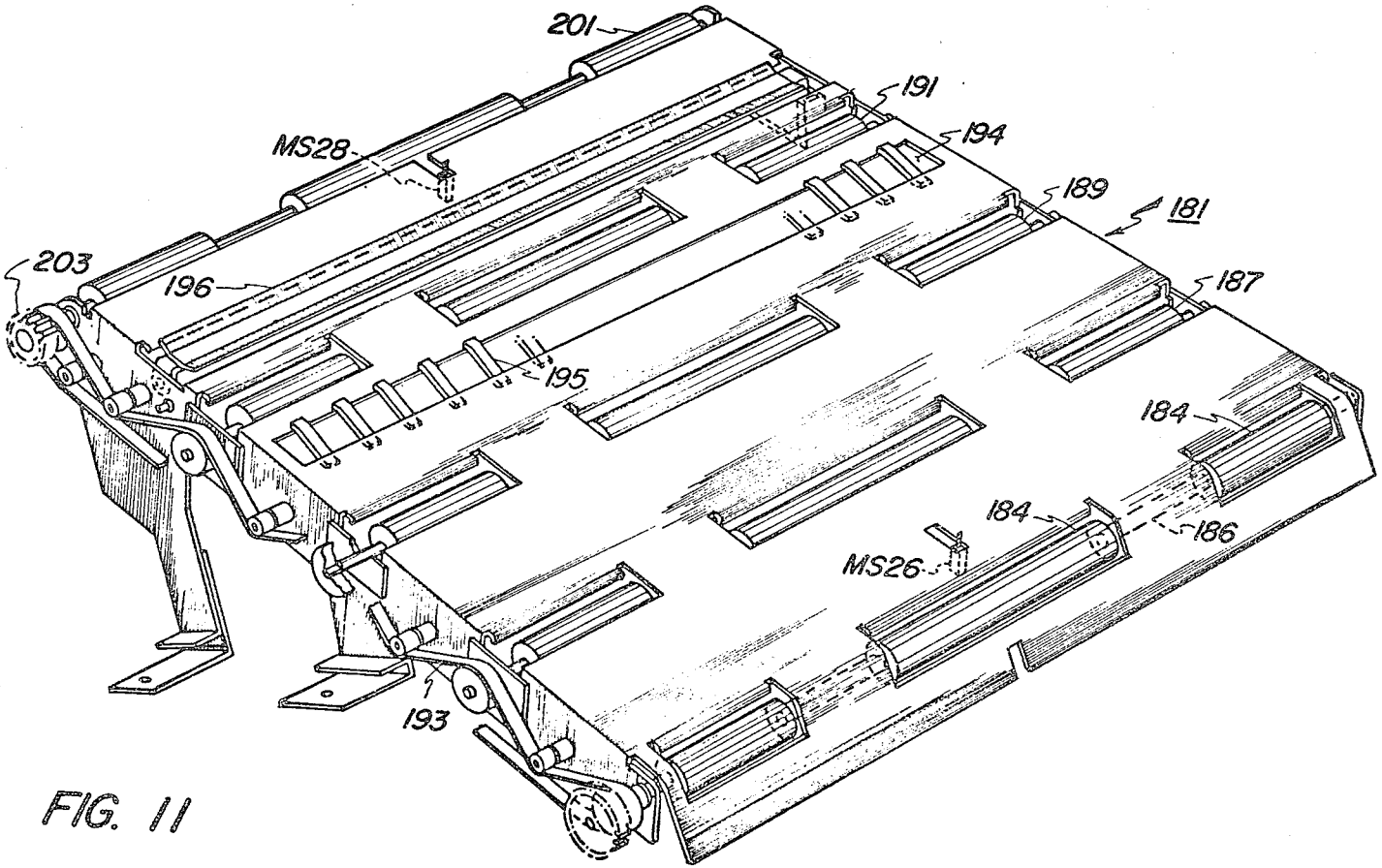
FIG. 11 is a perspective view of the driving assembly of the lower vertical transport assembly for copy paper.
Figure 12:
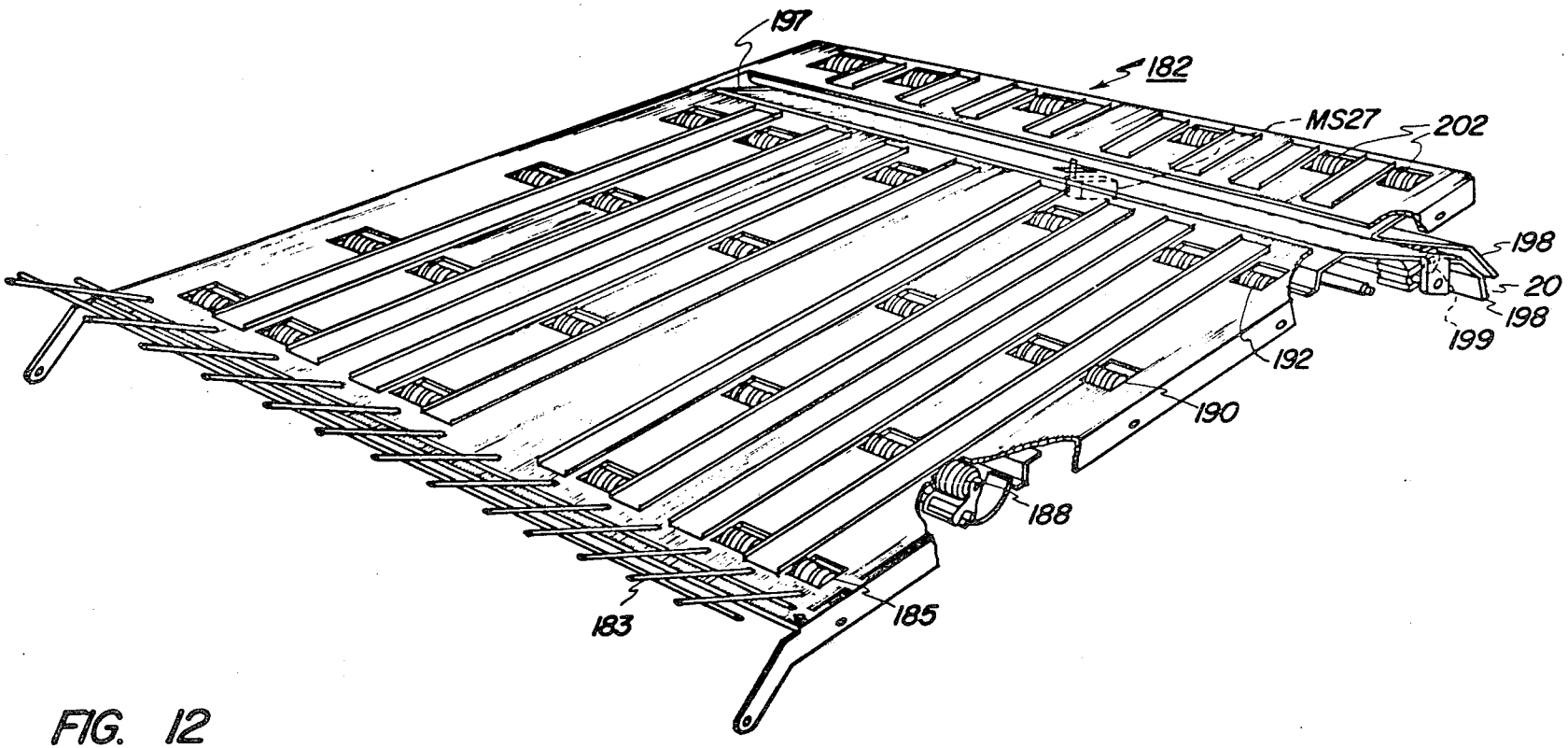
FIG. 12 is a perspective view of the pinch pan which co-operates with the assembly of FIG. 11.

The lower vertical transport assembly comprises a driving assembly 181 shown in FIG. 11, in which all the rollers shown are driven, and a pinch pan assembly 182, shown in FIG. 12, in which all the rollers are free-running back-up rollers that are lightly sprung for running engagement with the rollers of the assembly shown in FIG. 11. The manner in which these two assemblies co-operate with one another can be seen in FIG. 1. The pinch pan assembly 182 is hinged at its lower end on the machine frame to give access to the vertical copy paper path.

The leading edge of a sheet of copy paper emerging from the fuser assembly 5 falls onto a guiding grid 183, which is attached to the lower end of the pinch pan (FIG. 12). The copy paper is then gripped between a first drive roller 184 on the driving assembly 181, and the corresponding back-up rollers 185 on the pinch pan. The drive roller 184 consists of three separate roller sections, interconnected by a driving shaft 186, this shaft 186 being driven by a toothed belt from the main drive assembly of the machine. Each of the three sections of roller 184 co-operates with two shorter back-up rollers 185 on the pinch pan. As mentioned above, the back-up rollers 185 are free-running, and rotate independently of each other. Drive roller 184 is driven, via toothed belts, from a gearbox that is driven by the main machine motor MOT1.

The driving assembly 181 contains three further sets of driving rollers 187, 189 and 191, which co-operate respectively with back-up rollers 188, 190 and 192 on the pinch pan. Each of these three sets of rollers and back-up rollers is identical with the rollers 184 and back-up rollers 185. The drive shafts of rollers 187, 189 and 191 are all driven by a common toothed belt 193 from the drive shaft 186 of roller 184. Thus far, the path of the copy paper is the same whether the paper is to be delivered to the copy tray 19 at the front of the machine, or through the rear exit mouth 20 at the rear of the machine. Between the third set of rollers and back-up rollers 189, 190 and the fourth set 191 and 192, an aperture 194 is provided behind which is situated an a.c. corona discharge device for discharging the copy paper to leave it charge-free. To prevent the paper from dropping into the aperture 194, a bridging arrangement, such as the set of strips 195 shown, is used to guide the paper over the aperture.

After being fed by the fourth set of rollers and back-up rollers 191, 192, the paper encounters a deflector baffle 196 which dictates whether the paper will be delivered to the copy tray 19 at the front of the machine or through the exit mouth 20 at the rear of the machine. The deflector baffle 196 is operated by a solenoid SOL17, and if the paper is to be fed to the front of the machine, guides the paper directly upwards past an exit mouth 197 in the pinch pin. If, on the other hand, the paper is to be fed to the rear of the machine, the deflector baffle 196 is moved so that the paper is deflected to pass through the exit mouth 197 of the pinch pan and out of exit mouth 20 at the rear of the machine. Between the exit mouth 197 of the pinch pan and the rear exit mouth 20 of the machine, guide baffles 198 are provided, the lowermost guide baffle 198 supporting back-up rollers 199 which co-operate with a drive roller 200 that is mounted on the machine frame.

If the copy paper is to be fed forwardly to the copy tray 19, the deflector baffle 196, as mentioned above, directs the paper past the exit mouth 197 of the pinch pan, and between a fifth set of drive rollers and back-up rollers 201 and 202. Drive roller 201 is driven, like all the other drive rollers on the drive assembly 181, by means of the toothed belt 193.

Drive roller 200 which feeds the copy out of the rear of the machine, is also driven by a toothed belt from a toothed pulley 203 on the shaft of drive roller 201.

Continuing with the case where the copy paper is to be fed to the copy tray 19, when the leading edge of the copy papers is fed between rollers 201 and 202 at the top of the lower vertical transport assembly, it crosses the path followed by documents being fed to the rear of the machine. Obviously, therefore, a collision of document and copy would occur at this point if the document were fed to the rear of the machine, and the copy to the front. The machine logic circuitry accordingly allows delivery of document to the front and copy to the front, document to the rear and copy to the rear, and also document to the front and copy to the rear. The logic is arranged, however, such that it is not possible for the document to be fed to the rear and the copy to the front.

Figure 13:
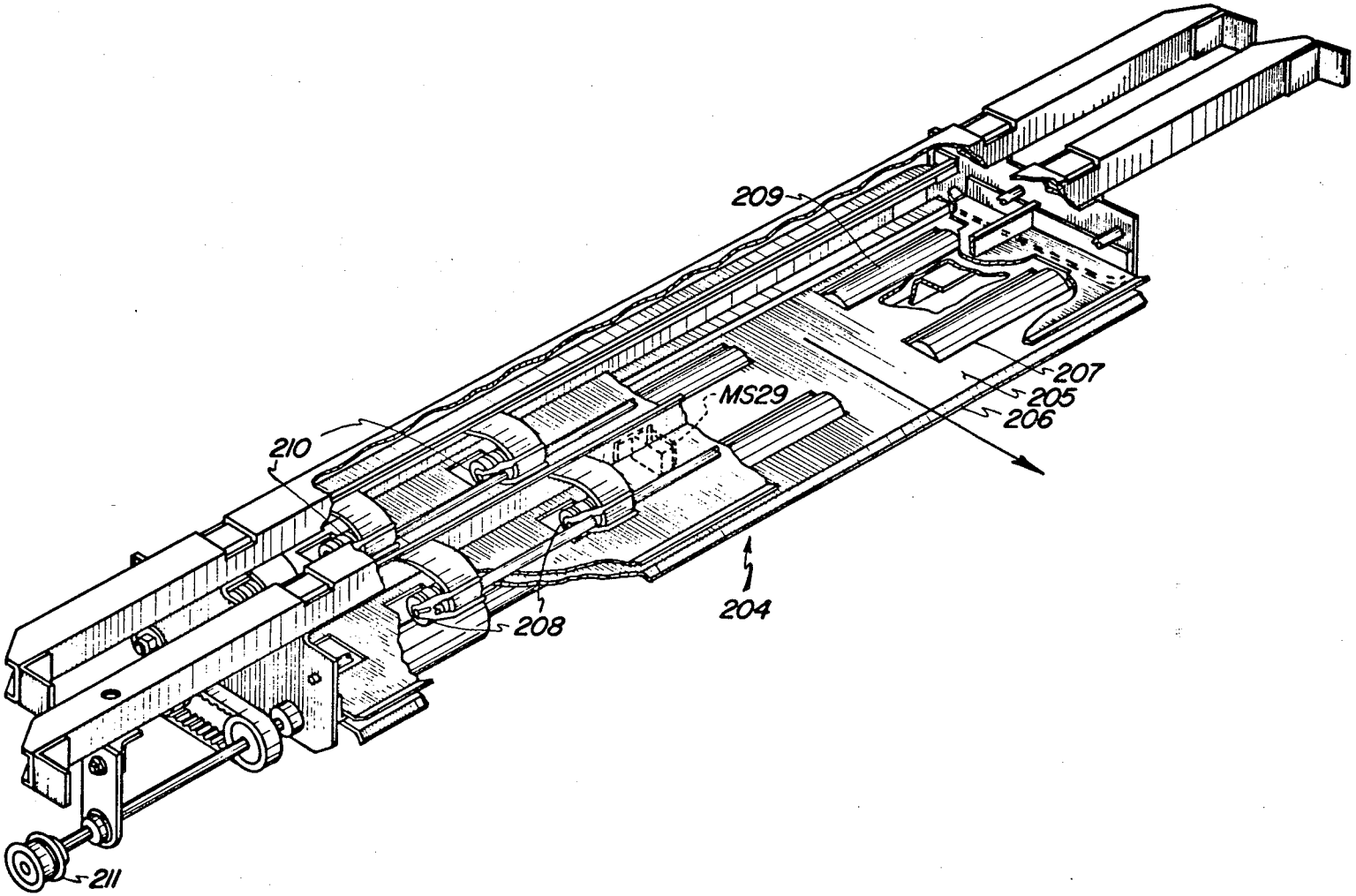
FIG. 13 is a perspective view, with parts cut-away, of the upper vertical transport assembly for copy paper.

Once the copy paper has passed the rear-exit document path, it is fed further upwards by the upper vertical transport assembly 204 (FIG. 13). The copy is fed upwards (i.e. in the direction of the arrow in FIG. 13), between guide plates 205 and 206. Guide plate 206 carries drive rollers 207 and 209 and guide plate 205 carries back-up rollers 208 and 210 which are sprung into rolling engagement with drive rollers 207 and 209 respectively. Drive rollers 207 and 209 are similar to those used in the lower vertical transport assembly, and are driven by means of a toothed belt through a pulley 211 from the drive shaft of the uppermost drive roller 201 of the lower vertical transport assembly. On emerging from between the uppermosst roller 209 and back-up roller 210, the paper is guided from motion in a vertical direction to motion in a horizontal direction by a substantially quartercylindrical guide plate 212 (FIG. 2). As it is guided around the guide plate 212, the paper passes over a perforated tube 213 which blows air under the copy paper as it is fed into the copy tray 19. This helps to prevent copy paper sheets from sticking to sheets already lying in the copy tray 19, and establishes a thin air cushion which assists in floating the sheet down towards the operator at the front of the machine.

The upper vertical transport assembly is rigidly mounted on the machine frame, between the pivot points for the document tray.

The copy tray 19 is of moulded plastic material having a dark but translucent appearance, and is formed with a number of ridges to reduce the area of contact between the paper and the tray, thereby reducing the formation of static electricity and allowing easier sliding motion of the sheets down the copy tray. As seen in FIG. 1, the depth of the copy tray increases towards the front of the machine (i.e. the floor of the copy tray slopes downwards). The copy tray 19 is hinged at the rear of the machine along the same hinge axis as the document tray so that it can be easily lifted either alone to provide access to the document tray 12 below it, or together with the document tray as the latter is lifted.

XEROGRAPHIC SYSTEM

Figure 14:
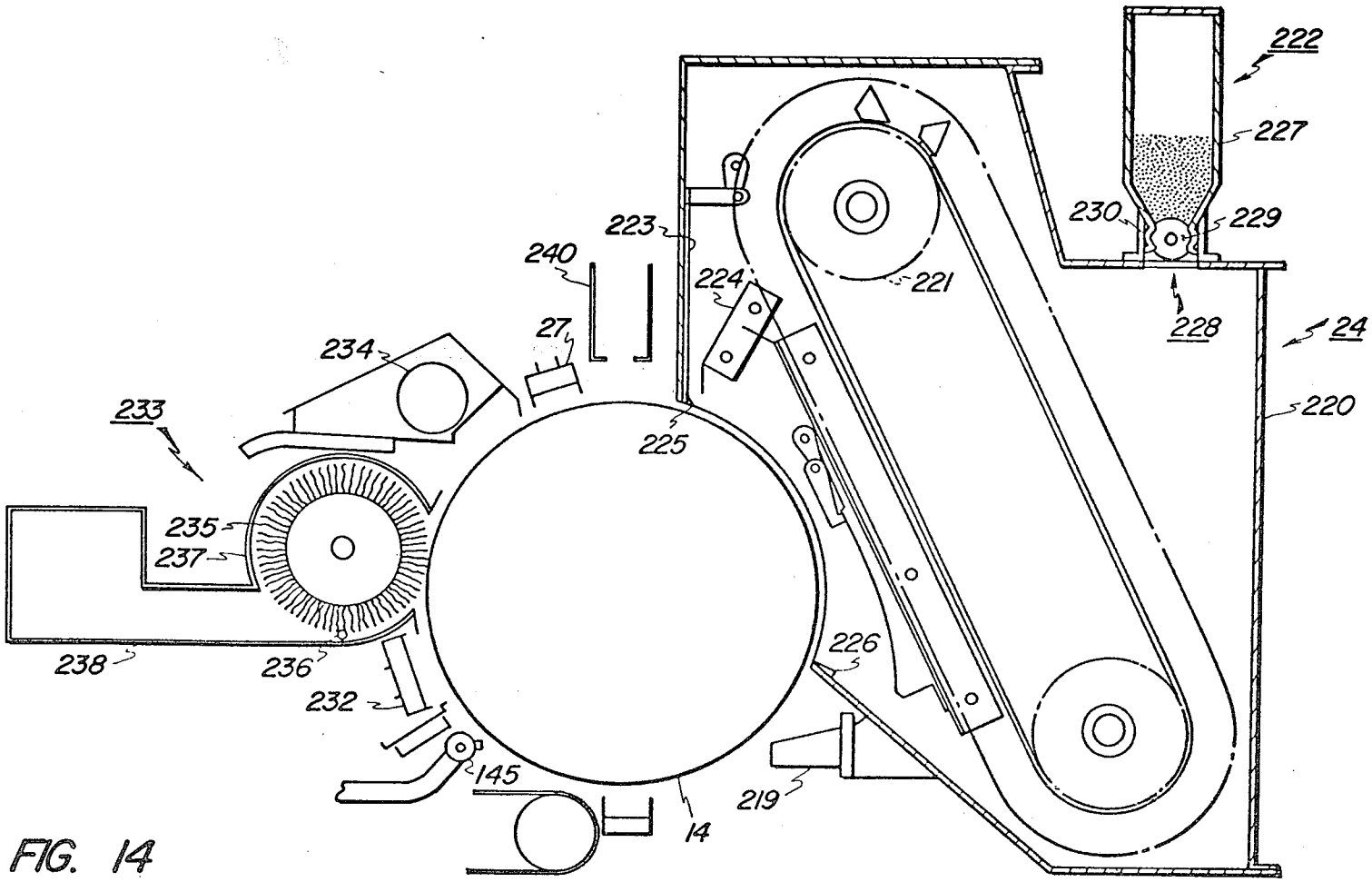
FIG. 14 is a diagramatic cross-sectional view of the xerograhic system of the machine.
Figure 15:
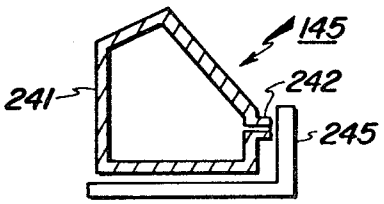
FIG. 15 is a cross-section through the puffer of the xerographic system.

The xerographic system, which will now be described with reference particularly to FIG. 14, is for the purpose of the present application taken to include the xerographic drum, and its surrounding stations, the most important of which still to be described are the developer station and the cleaning station. The transfer station has already been discussed, and the remaining stations are the main charging corotron, the puffer, the pre-clean corotron and the pre-charging exposure lamp. The imaging and exposure system will be described separately below.

DEVELOPER SYSTEM

The developer station 24 is contained in a housing 220 which houses a bucket conveyor 221. The bucket conveyor 221 supplies developer for development of the image by the cascade development method. The developer consists of carrier beads and toner particles, the toner particles and the carrier beads being selected in relation to the xerographic surface of the drum 14 to have appropriate tribo-electric relationships such that toner particles are attracted to the carrier particles until the developer is cascaded onto the drum, at which time the toner particles are attracted to the image areas of the drum more strongly than they are attracted to the carrier particles. Clearly, as the developer is cascaded onto the drum it becomes depleted of toner particles, and a toner dispenser arrangement 222 is provided to continuously supply a measured flow of fresh toner particles into the developer housing.

The lower portion of the housing 220 acts as a sump for the developer and the buckets of the bucket conveyor 221 scoop up developer from this sump and carry it up to the top of the housing. The developer is then tipped by the buckets into a hopper which is defined between an electrode 223 secured to the wall of the housing and a flow baffle 224 which converges downwardly towards the electrode 223 to define an outlet mouth just above the surface of the drum 14. The lower end 225 of the electrode 223 is curved slightly towards the direction of rotation of the drum 14 so as to guide the developer generally in the direction of rotation so that toner particles do not tend to escape in the direction contrary to the direction of rotation of the drum. The flow baffle 224 is provided so that a roughly constant head of developer particles is maintained, thereby ensuring an even flow of developer to the drum. The extent of curvature, and the exit angle of the lower portion 225 of the electrode 223 are carefully chosen so that the developer particles strike the drum with sufficient velocity to ensure efficient development, while at the same time preventing toner particles from escaping contrary to the direction of the drum. At the lowermost point of contact between the developer housing 220 and the drum 14 a pick-off baffle 226 extends to provide an edge very close to the drum, allowing toner particles to pass by it in image configuration, but trapping the carrier particles within the developer housing. Positioned just below the pick-off baffle 226 is a catch pan 219 for catching any stray toner particles which escape at the pick-off baffle.

The electrode 223 is typically maintained at a potential of plus 800 volts, thereby causing the toner particles to be strongly attracted to the image areas of the drum.

The toner dispenser arrangement comprises a toner bottle 227 of translucent plastic material, the mouth 228 of which is sealed by a roller 229 having at least a surface layer of foam plastic material. The bottle is mounted on the developer housing 220, and a drive shaft is arranged to rotate the roller 229 whenever the developer system is operating. The roller fits between two part-cylindrical, concave surfaces 230 which define the mouth 228 of the bottle, and pinch the roller, so that on rotation of the roller 229, toner particles are carried in the pores of the roller to be dropped into the developer housing. In this way an even and continuous flow of toner particles into the developer housing is obtained.

CLEANING SYSTEM

The cleaning system comprises a pre-clean corotron 232, a brush-type cleaning arrangement 233, and a discharge lamp 234. The pre-clean corotron 232, which is supplied with an a.c. current having a small negative d.c. bias, substantially discharges the surface of the drum 14 thereby destroying the electrostatic latent image formed by the exposure system. The brush of the cleaning arrangement then physically sweeps the surface of the drum 14 thereby removing any residual toner particles which are not now strongly bound to the surface 14 since it has been substantially discharged. Particles removed by the brush are extracted by a vacuum system. Finally, the discharge lamp 234 is used to momentarily render the xerographic surface conductive thereby completely and uniformly discharging the surface and ensuring that no uneven charge patterns remain on the drum.

The cleaning assembly comprises a rotating brush 235 the bristles of which sweep the particles off the surface of the drum. The bristles, which may typically be or Rayon or Dinel, are then flicked by a flicker bar 276, positioned in the bottom of the brush housing 237, as the brush rotates. The toner particles are projected substantially tangentially of the brush, i.e. horizontally, into a vacuum duct 238. The flicker bar consists of a stainless steel rod which is grounded, extending parallel to the rotational axis of the brush in such a position that it causes a flickering action of the bristles as the brush rotates past it.

Next in the path of rotation of the drum 14 is the main charging corotron 27. This uniformly charges the surface of the drum 14 positively ready for imaging. A flowing image of the document to be copied is projected, in synchronism with the rotational speed of the drum 14, through an exposure slit box 240 extending just above the uppermost part of the drum 14 and parallel with its rotational axis.

During reversal of the document, an image is still projected onto the surface of drum 14. The image is, of course, not a useful image since the drum surface is moving in the opposite direction to the image. If no further steps were taken, therefore, a blurred latent image would be formed on the drum, and would be developed. It would not be transferred, however, since there would be no copy paper positioned to receive it. Some toner particles might, however, be released from the drum, and all would be cleaned off in the cleaning system, giving rise to toner wastage and brush contamination. To prevent these problems, the main charging corotron 27 is switched off during document reversal. In this way, no latent image can be formed during document reversal.

Situated between the transfer corotron 123 and the pre-clean corotron 232 is the puffer 145. The puffer will now be more particularly described with reference to FIGS. 15, 16, 17 and 18.

Figure 16:
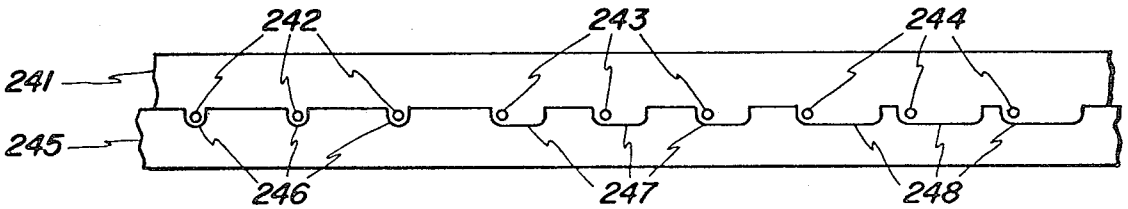
FIGS. 16, 17 and 18 are partial front elevations of the puffer of FIG. 15, shown in three different operative positions.
Figure 17:
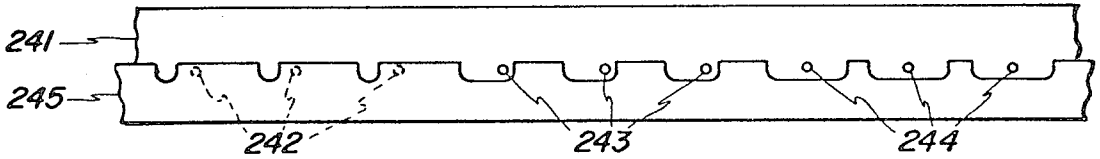
Figure 18:
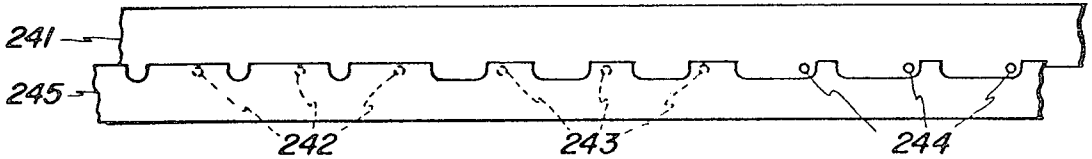

The puffer consists of a rigid hollow bar 241 which has a series of puffer jets 242, 243 and 244. A masking member 245 is slidably mounted beneath the bar 241 and acts to selectively mask the jets 242, 243 and 244, as illustrated in FIGS. 16, 17 and 18. The jets are selectively masked so that it is possible to puff jets of air only to an extent corresponding to the width of paper being used; air being blown outside the width of paper being used might blow any stray toner particles off the drum and into the machine, causing damage.

The masking member 245 is shaped as shown in FIGS. 16, 17 and 18, and may be slid into one of three positions. In the first position, shown in FIG. 16, all the jets, 242, 243, and 244 are uncovered, thereby allowing jets of air to be puffed under the widest sheets of paper (24 inches wide). In FIG. 17, the masking member has been moved one position to the left, thereby obscuring jets 242 but leaving jets 243 and 244 open. This allows jets of air to be puffed under an intermediate width (18 inches) of paper. In FIG. 18, the masking member 245 has been moved to its extreme left position, thereby obscuring jets 242 and 243 but leaving jets 244 open. This enables jets of air to be puffed only under the narrowest (11 inches) width of paper. As can be seen, selective masking is achieved by means of recesses cut in the masking member 245, the left-hand recesses 246, which correspond with jets 242, having a width equal to one jet, the central recesses 247 which correspond with jets 243, having a width equal to two jets, and the right-hand recesses 248, which correspond with jets 244, having a width corresponding to three jets. The sliding masking member 245 may be operated either manually or automatically by means of solenoids.

OPTICAL SYSTEM

As mentioned above, the optical system 7 (FIG. 1) projects a flowing image of the document as it passes over exposure slit 11, onto the surface of the xerographic drum 14. The light source consists of a set of four fluorescent tubes 260 which are located within a light box 261. Light reflected from the surface of the document (which of course might be inserted into the machine face downwards) is projected downwardly through light box 261 onto a lower mirror 262. Lower mirror 262 reflects the light through the lens assembly which comprises main lens 21 and add-lenses 22 and 23. An image of the document is focused on the surface of the drum 14 by the lens assembly after being reflected downwards by an upper mirror 263. In order to accurately define the width of the projected image on the drum surface, and thereby control the exposure, the exposure slit box 240 is mounted just above the drum surface. The exposure slit is wider towards the edges to compensate for fall-off in illumination intensity at the edges.

The fluorescent light tubes particularly favoured for this machine are very high output purple phosphor tubes. These tubes emit a high proportion of blue light, their spectral emission characteristics being particularly suited to the spectral response characteristics of the selenium drum which is used, thereby providing an efficient system. These particular lamps, however, suffer from the disadvantage that they have a relatively short-persistence phosphor, so that when they are run from a.c. mains, the resultant 100 cycles per second variation in the illumination intensity may be noticable as a series of parallel stripes, particularly in the background portions of the copy. This problem is less troublesome with lamps which have longer-persistance phosphors, since the illumination drops-off relatively slowly and never falls to a value close to zero. In the case of the phosphor of the blue lamps being used at present, however, the illumination intensity falls off almost to zero between each peak of the illumination intensity cycle. In order to overcome this problem, two separate sets of lamps within the light box are arranged to be run from a.c. sources which are phase-shifted relative to one another. The use of phase-shifting ballast circuits to obtain such a.c. sources is well known. It has the effect of additively combining the two illumination outputs, with the result that the effective illumination level fluctuates around some level above zero. This considerably alleviates the problem, and permits copies with a relatively uniform background to be produced.

Turning now to the lens system, the system of the present machine provides three magnification modes, while maintaining, by movement of the lenses only, a constant conjugate length. In other words, the exposure slit 11, the mirrors 262 and 263, and the image position on the drum 14 all remain stationary relative to one another regardless of the magnification mode selected.

As mentioned above, the three magnification modes are a 100 percent mode, in which the copy is substantially the same size as the original document; and two reduction modes, in which the copy is respectively 70 percent and 50 percent of the size of the original document. In the 70 percent mode only the main lens 21 is used, whereas in the 100 percent mode, add-lens 22 is swung into the optical path as the main lens 21 is moved to a position closer to lower mirror 262. In the 50 percent mode, the main lens 21 is used in conjunction with add-lens 23, which is moved into the optical path as the main lens is moved towards upper mirror 263. The add-lenses 22 and 23 are swung into and out of the optical path as the main lens moves by means of ramp cams, as will be described in more detail below.

The whole lens and mirror assembly is mounted on a self-contained sub-assembly which may be optically aligned outside the machine. The lens and mirror sub-assembly is carried by a casting which is provided with trunnions projecting at right-angles to the optical path on a line near the centre of gravity of the optical sub-assembly. The machine frame is provided with trunnion mounts, and an additional (adjustable) stop on the optical system casting is arranged to contact a fixed stop on the machine frame. The stop on the optical casting is a screw threaded stop which can be set to align the optical system during its manufacture, so that in assembly of the machine, the optical system can be very simply but completely accurately located. The main reason for making the stop adjustable is that this enables the optical path length to be changed to an extent sufficient to allow for manufacturing tolerances in the total focal length of the main lens. In order to allow accurate alignment of the projected image with the optical path of the main lens on adjustment of this stop, the mirrors 262 and 263 are adjustably mounted, employing standard fine adjustment devices.

Figure 19:
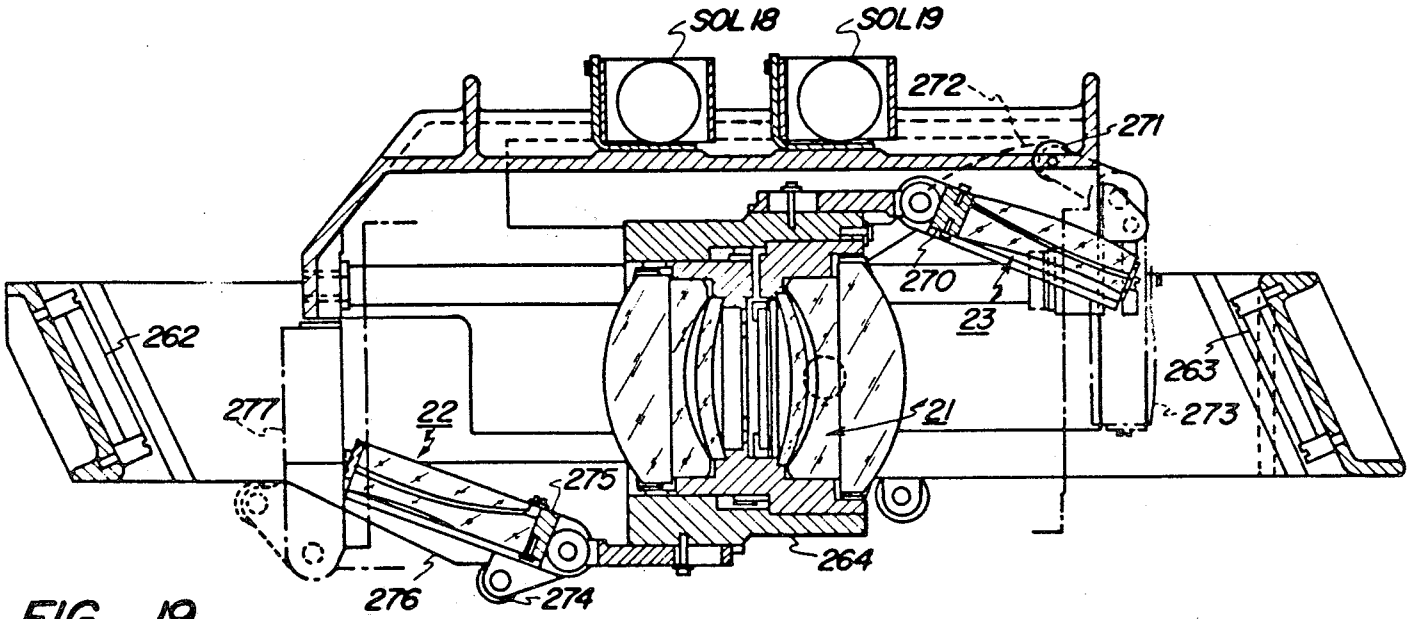
FIG. 19 is a cross-sectional elevation of the optical assembly.
Figure 20:
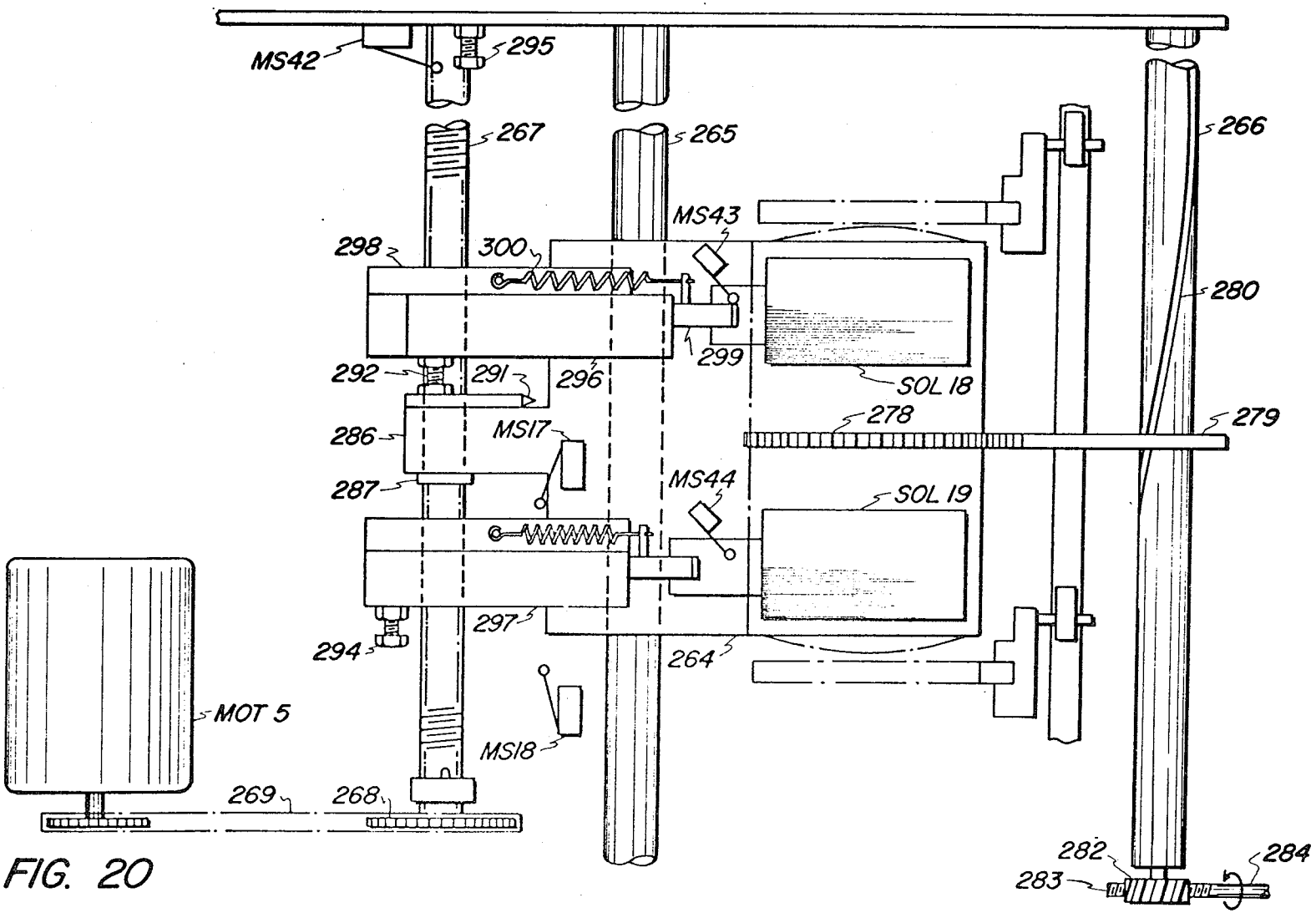
FIG. 20 is a diagramatic plan view of the mechanical control and drive systems of the optical assembly.

Referring now to FIGS. 19 and 20, the main lens 21 and the add-lenses 22 and 23 are mounted on a lens carriage 264. The lens carriage 264 is mounted for sliding motion parallel with the optical path through the main lens on shafts 265 and 266 that are mounted in the optical system casting. Shaft 265 is fixed relative to the optical system casting, whereas shaft 266 is mounted for angular movement about its longitudinal axis for reasons to be described below. The lens carriage 264 may be driven along the shafts 265 and 266 by means of a lead screw 267 which is mounted for rotation about its longitudinal axis, which is parallel to the shafts 265 and 266, relative to the optical system casting. The lead screw may be rotated in either direction by means of a reversible drive motor MOT5, through a toothed pulley 268 secured to the lead screw 267, and a toothed belt 269.

Figure 23:
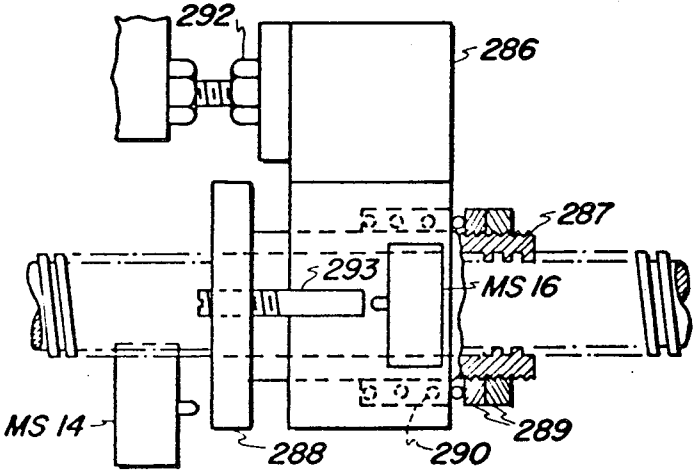
FIG. 23 is a side elevation, partly in section, of a part of the system of FIG. 20.

In order to position the main lens for the three magnification modes, positive stops are provided on the optical system casting. Furthermore, in order to ensure that inaccuracies in positioning do not arise due to backlash between the lead screw and its cooperating lead-screw nut 287 (carried by the lens carriage) the lens carriage 264 is always driven in the same direction against the stops whenever it is repositioned. Since the lens carriage is driven by a motor, stopping the motor at the appropriate time, and taking account of motor overrun, are essential to proper operating of the optical system, otherwise rapid wear or damage would result. Referring now to FIGS. 20 and 23, the lens carriage 264 has a lateral extension 286 which supports the lead-screw nut 287. The lead-screw nut 287 is threaded onto the lead-screw 267, and is slidably mounted within the lateral extension 286. The end of the lead-screw nut 287 nearest the 100 percent position terminates in a wide flange 288, whilst the other end (nearest the 50 percent position) carries a pair of locking nuts 289. A compression spring 290 acts between the nuts 289 and the lateral extension 286 so as to urge the flange, in the absence of any other constraints, into contact with the adjacent face of the extension 286.

When the lens carriage is being brought into any one of its three positions, an abutment surface 291 of the extension 286 encounters the appropriate stop, e.g. stop 292 (the 70 percent stop) which has been brought into position by solenoid SOL18. The lens carriage 264 is accordingly positively positioned, but the motor MOT5 has not yet stopped. The motor is stopped as follows: the lead-screw nut 287 continues to move (compressing spring 290) until microswitch MS16 (carried by the extension 286) is deactuated by its actuating pin 293. Pin 293 is carried by the flange 288 of the lead-screw nut. Microswitch MS16 switches off the motor, and motor over-run further compresses the spring 290. Should microswitch MS16 fail, a backing switch MS14 is actuated just before the spring 290 is completely compressed.

Figure 21:
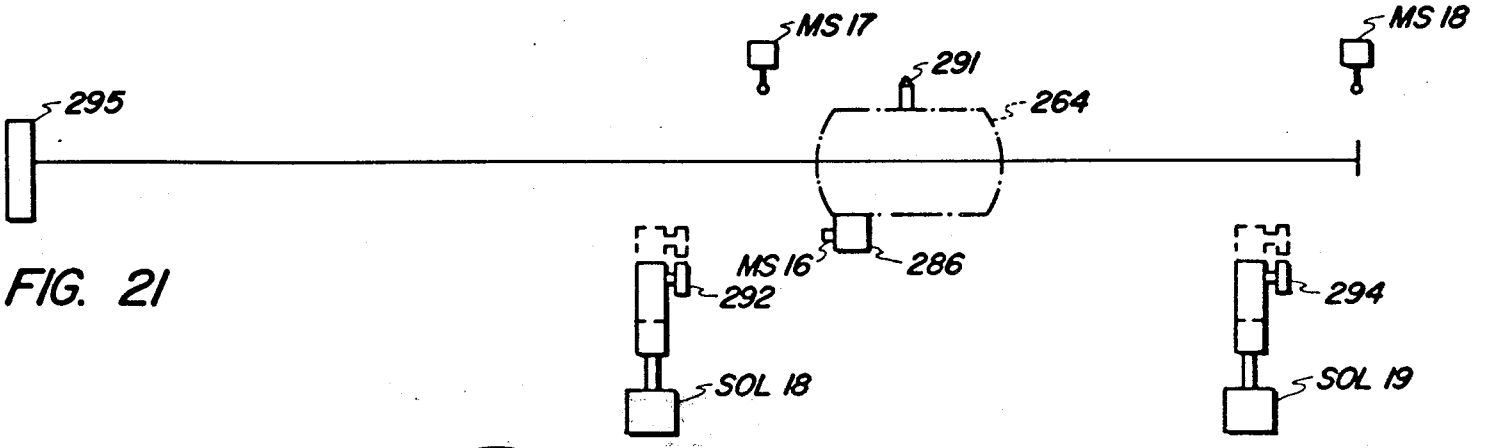
FIG. 21 is a simplified diagram illustrating the action of the system of FIG. 20.

The way that lens position changes are achieved will now be described with particular reference to FIG. 21. In the following discussion, movement of the lens in the direction from its 100 percent mode position to its 50 percent mode position will be referred to as the "forward" direction. Assuming that the lens is in the 100 percent mode initially, the case will first be considered where the lens is to be moved into the 70 percent mode position. The lens carriage 264 is first driven forward until the activating edge 291 carried by the extension 286 actuates a microswitch MS17, positioned just forwards of the 70 percent mode position, which reverses the direction of motor MOT5, causing the lens carriage to be driven in the reverse direction. At the same time a 70 percent position solenoid SOL18 is actuated to place a stop 292 in the path of the backward-travelling lens carriage. The microswitch MS16 is deactuated as a result of the lens carriage extension 286 encountering the stop, thereby switching off the motor MOT5, and stopping the lens carriage in positive engagement with the stop.

A similar procedure is followed when it is desired to change the lens position from the 70 percent to the 50 percent mode. The lens carriage is driven forwards until the actuating edge 291 encounters microswitch MS18, positioned just forwards of the 50 percent mode position, which reverses the direction of motion of the lens carriage, and at the same time operates solenoid SOL19 to bring a stop 294 into the path of the backward-moving lens. The microswitch MS16 is deactuated, as explained above, thereby stopping the len in the 50 percent mode position, in positive engagement with the stop. The same procedure is followed when it is desired to move the lens from the 100 percent mode position to the 50 percent mode position. In these circumstances, however, microswitch MS17 is inhibited so that the lens carriage can travel straight from the 100 percent mode position to the 50 percent mode position.

In order to return the lens from the 50 percent mode position to the 70 percent mode position, the lens carriage is driven forward until the actuating edge 291 actuates microswitch MS18. This causes reversal of the motion of the lens, but this time solenoid SOL19 is inhibited and solenoid SOL18 is actuated to bring the stop into position at the 70 percent mode position. The lens accordingly travels up to the 70 percent mode position, until the microswitch MS16 is deactuated as a result of the lens carriage 264 encountering the stop 292.

When it is desired to move the lens back into the 100 percent mode position, from either the 70 percent or the 50 percent mode position, the motor MOT5 is first driven forwards until the actuating edge 291 actuates either microswitch MS17 (70 percent mode) or MS18 (50 percent mode). This reverses motor MOT5 and drives the lens backwards, either solenoid SOL18 or both of solenoids SOL18 and SOL19 being inhibited. The lens, which always approaches the 100 percent mode position from the same direction, is stopped when microswitch MS16 is deactuated as a result of the lens carriage encountering a fixed stop 295.

Returning to FIG. 20, the 70 percent and 50 percent stops 292 and 294 are mounted respectively on sliding members 296 and 297 that are operated by solenoids SOL18 and SOL19. In the figure, SOL18 is in the operated position (i.e. the lens carriage 264 is in the 70 percent mode position) the sliding member 296 having moved, relative to its guide 298, towards the solenoid. In moving across, the draw-bar 299 actuates microswitch MS43, which is the 70 percent lens position microswitch, and also extends a tension spring 300. When power is removed from solenoid SOL18, however, the fact that the lens carriage was driven against stop 292 holds the sliding member 296 in the operated position, and keeps MS43 actuated. Only when the lens position is changed is sliding member 296 released, so that stop 292 is removed under the action of the spring 300. Exactly similar considerations apply in the case of solenoid SOL19, its stop 294, and the 50 percent lens position microswitch MS44. In FIG. 20, SOL19 is, of course, shown in its non-operated condition.

In the 100 percent mode position, the lens carriage actuates microswitch MS42, which is mounted near the fixed stop 295.

In summary, if the lens is to move in the forward direction, it is always driven just past its selected position, and then driven backwards against a positive stop. If the lens is to be moved in a backwards direction, it is driven directly against the stop after leaving its previous position in a forwards direction.

As the lens is moved between its various positions, the add-lenses 22 and 23 are moved into and out of the optical path. Referring to FIG. 19, the lens assembly is shown in the 70 percent mode position, with both the add-lenses 22 and 23 swung out of the optical path. If now the lens is brought into its 50 percent mode position, i.e. from left to right as seen in FIG. 19, add-lens 23 is swung into the optical path. The mount 270 of add-lens 23 carries a small wheel 271 which travels along a fixed ramp cam surface 272 as the lens is driven towards its 50 percent position. In FIG. 19, the position of add-lens 23 when the lens is in its 50 percent position is shown in broken outline 273. Wheel 271 is only visible with the add-lens 23 in this position, being out of sight behind main lens 21 (as seen in FIG. 19) when in the 70 percent position. Similarly, when the lens is moved into its 100 percent mode position, add-lens 22 is swung into the optical path by means of a wheel 274 carried on the lens mount 275 of add-lens 22, the wheel 274 running along a second fixed ramp cam surface 276. The position of add-lens 22 when the lens is in its 100 percent mode position is indicated by broken outline 277.

Figure 22:
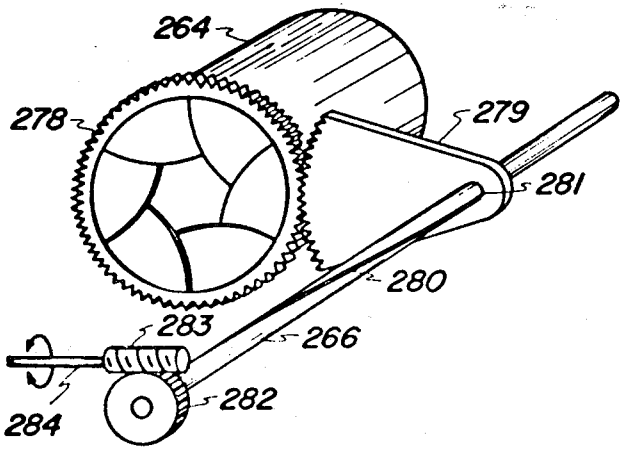
FIG. 22 is a diagramatic perspective view of part of the optical assembly.

In order to ensure that constant exposure is achieved regardless of the magnification mode, an automatic aperture-adjusting device is incorporated, as will be described with particular reference to FIGS. 20 and 22. The lens carriage 264 carries a toothed ring 278 which is engaged by co-operating teeth of a toothed quadrant 279. The toothed ring 278 is coupled to an iris diaphragm, so that movement of the quadrant about its axis causes aperture changes. The quadrant is held for movement along the optical path with the lens carriage 264, but is caused to rotate about its axis as the lens carriage moves by means of the shaft 266 which passes through an aperture 281 in the quadrant 279, the axis of shaft 266 coinciding with the axis of the quadrant 279. Shaft 266 (although mounted for angular movements in the optical system casting, as mentioned above) is normally held stationary relative to the optical system casting, and is provided with a helical groove 280 which is engaged by a tooth projecting from the aperture 281 in the quadrant through which shaft 266 passes. In this way, the aperture of the iris diaphragm may be controlled to provide constant exposure whichever magnification mode is selected.

In order to allow for the possibility of operator control of the lens aperture, to vary the intensity or contrast of an image, provision is made for biasing the automatic aperture change just described. To do this it is necessary only to move the helically grooved shaft 266 angularly about its axis. This is done by mounting the shaft 266 in bearings in the optical system casting, and arranging a worm wheel 282 on the shaft 266 to mesh with a worm gear 283 connected to an operator control by means, for example, of a flexible drive cable 284.

The configuration of the lens elements in the main lens and add-lens is described in detail in our co-pending U.S. Pat. application No. 371,458, now U.S. Pat. No. 3,853,387.

VACUUM AND COMPRESSED AIR SYSTEMS

For supplying compressed air as required to the puffer and to the lifting device for the back-up roll of the fuser, a relatively high pressure compressed air supply is required. For this purpose a compressor motor MOT9 is mounted on the drive side of the machine and pressurises the air in a compressed air storage tank. Pipes take the compressed air at a pressure typically around 15 p.s.i., from the tank and to the back-up roll lifting device, the compressed air being supplied as required on the operation of solenoid actuated values. The compression motor MOT9 is switched on and off by a pressure sensing switch MS11 (FIG. 34) to maintain a constant pressure in the storage tank.

In order to supply the air required to form the air cushion in the document tray and to assist in turning over the copy paper at the top of the vertical transport assembly, air is simply blown through the relevant perforations by a blower motor. The blower motor is of the standard fan kind, and draws air in at the back of the machine through a filter box. The air is then blown along two ducts, to the chamber below the document tray, and to the perforated bar at the top of the vertical transport assembly.

For cooling the main illumination lamps 260, air is drawn from the two ends of the closed light box 261 by means of two fan-type blower motors. Cool air from the rear of the machine is drawn through filter boxes, and enters the light box through two holes at the centre of the light box.

The vaccum for the horizontal transport assembly is provided by a fan-type motor mounted directly on the machine casting, on the drive side. This simply draws air out of the chamber (discussed above) within the horizontal transport assembly.

The vacuum system for the cleaning arrangement consists of a relatively powerful motor mounted within a large filter box 285 (FIG. 1) mounted at the rear of the machine behind the vertical transport assembly. The filter box is connected directly to the cleaning assembly by a duct which draws air and toner particles from the cleaning brush housing. The filter material in the filter box provides efficient extraction of toner particles from the air, so that only clean air is blown out at the rear of the machine. The whole of the filter box assembly is hinged about a vertical axis, so that it can be swung out of the rear of the machine to provide access to the vertical transport assembly.

ELECTRICAL CONTROL CIRCUITRY

GENERAL DESCRIPTION OF A COPY CYCLE

A general description of a copy cycle will now follow, in order to establish the position of a number of microswitches which are positioned in the path of the document and the copy paper to initiate the various control functions of the machine. The positions of many of these microswitches are best seen from FIG. 1.

Assuming the machine is switched on, and warmed up ready for operation, when a document is fed into the machine, its leading edge hits microswitch MS1. This turns on the machine's drive systems, causing the document belt to be driven at a speed depending on the magnification ratio chosen, and the copy paper transport to start moving. At the same time, the main exposure lamps are illuminated, the xerographic drum starts turning, the cleaning system vaccum pump is started, followed after a short delay by the cleaning brush motor MOT7, and the developer drive motor MOT2 is started. The cleaning brush is started after a delay so that a vacuum is built-up before the brush starts turning. The leading edge of the document then hits microswitches MS2, MS3, MS4 in turn, these microswitches being operative respectively in the 50 percent, 70 percent and 100 percent modes. Thus, if the 100 percent mode has been selected, the actuation of microswitches MS2 and MS3 has no effect, the next process step being initiated by actuation of MS4. Actuation of MS4 starts the copy paper feed unit 2, and also starts a cycle control timer. This microswitch provides a count in a programmer (which is used to select the number of prints required), so that if only a single print is required, the single count received by the programmer achieves coincidence with the selected number, thereby allowing the document to be fed out of the machine. The cycle control timer comprises a set of switches SW1 to SW11 which are operated by cams sequentially at predetermined times during each print cycle. The document then commences to pass over the exposure slit 11. At this stage, copy paper feed has started, but the leading edge of the copy paper is stopped at the registration position (i.e. in contact with registration roller 18). The cycle switch SW1 in the cycle control timer then starts the registration transport moving, thereby feeding the leading edge of the copy paper towards the drum 14.

The document continues to be fed either upwards and forwards towards the document tray 12 or rearwards through exit slot 13, depending on the mode selected. Copy paper continues to be fed throughout this time, until the trailing edge of the document releases the relevant microswitch (MS2, MS3, MS4, depending on magnification mode), thereby actuating a copy paper cutter.

If another document is not fed in within 12 seconds, the machine reverts to the "stand-by" condition.

When microswitch MS1 is de-actuated by the trailing edge of the document passing over it, the feed-in barrier drops from the document tray to bar the entry of a further document until the machine is ready to accept a further document, after which the feed-in barrier is raised so that a further document can be fed in. During the period in which the machine is ready to receive another document, a "feed document" light is illuminated.

In the multiple copy mode, document reversal is controlled by a timer delay operated by the release of one of MS2, MS3 and MS4. The timing arrangement is such that on reversal the trailing edge of the document has just passed the exposure slit, and if the document is not sufficiently long for the cycle control timer to have undergone the necessary part of a complete revolution, the document stays where it is until the appropriate function of a control cycle has been completed. The document is then reversed and microswitches MS4, MS3 and MS2 are actuated by the trailing edge of the document travelling backwards. (Through the description the terms "leading" and "trailing" edge of the document are used consistently as if the document were travelling in the forward direction). The document continues to travel backwards until the leading edge of the document releases microswitches MS39, MS38 and MS37. Actuation of the relevant one of these three microswitches, depending on the magnification mode, initiates the next copy cycle, and supplies a count pulse to the programmer. The document drive system stops the document so that its leading edge has just passed backwards over the exposure slit 11. Switch SW10 on the cycle control cam is actuated to send the document forward again. As in the single copy mode, as the trailing edge of the forwardly moving document leaves MS2, MS3 or MS4, the copy paper is chopped. As soon as coincidence is achieved between the number of copies set in the programmer, and the number of counts received by it, the document is fed into the document tray, or to the rear of the machine, as selected. If coincidence is not achieved, further copying cycles are initiated until coincidence is achieved.

Situated just beyond the exposure slit 11 is microswitch MS30, which is a jam detecting switch. This checks with a switch (SW9) in the cycle control cam. If switch SW9 is made before MS30, a document jam indication is provided. Furthermore, actuation of MS30 starts a timer which has to be cancelled by either microswitch MS31 or MS32 before the timer times out (the length of time depending on the magnification mode). Once again, if MS31 or MS32 is not actuated before the timer times out, a document jam is indicated. MS31 is located in the document path of a rearwardly fed document, whereas MS32 is located in the document path for forwardly fed documents. The jam detection also works in the reverse direction (i.e. as the document is being fed backwards). The deactuation of MS31 or MS32 starts the timer, and microswitch MS30 has to be deactuated before the timer times out. Whenever a document jam is detected, the document feed system closes down, but not the copy paper system. Provided the minimum length of copy paper has been fed, the copy paper is cut, and the cut sheet fed out. To clear the jam the lid is lifted after the machine has cycled out, and the document is removed. As the lid is lifted, the jam relays are cleared.

Turning now to the copy paper path, as copy paper is fed by the copy paper feeding unit, the presence of the paper on the registration transport assembly 3 is detected by microswitch MS7. Microswitch MS7 must be actuated before switch SW2 in the cycle control cam, otherwise a jam is indicated in the paper feed. This is indicated as a horizontal jam. The paper proceeds up the registration transport, and actuates microswitch MS33 at the top end of the registration transport assembly. MS33 and MS7 together provide a hold on the clutch which drives the registration transport assembly, so that as long as paper is on the rollers, the rollers are driven. As soon as the trailing edge of the paper leaves MS33 the rollers stop driving. The paper is fed under the drum 14, and switch SW3 on the cycle control cam operates the solenoid which causes a puff of air to be blown from the puffer 145. This ensures that the leading edge of the paper is peeled off the drum. The leading edge of the paper is then sucked onto the horizontal transport assembly. Microswitch MS5 on the horizontal transport assembly detects whether the leading edge of the copy paper arrives on the horizontal transport assembly, it being necessary for MS5 to be actuated before switch SW4 on the cycle control cam. If microswitch MS5 is not actuated first, a horizontal paper jam is again indicated.

On the first copy of a sequence of copies, microswitch MS33 operates the solenoid which supplies compressed air to the back-up roll lifter of the fuser assembly. The paper passes between the fuser roll and the back-up roll and is fed to the lower end of the vertical transport assembly.

The leading edge of the copy paper than actuates microswitch MS26 positioned at the lower end of the vertical transport assembly, it being necessary for MS26 to be made before switch SW6 of the cycle control cam, otherwise a document jam is indicated in the vertical transport system. Microswitch MS26 also provides a hold for the back-up roll of the fuser so that it is not released until the trailing edge of the copy paper has deactuated microswitch MS26. There are other holds which maintain the fuser roll up in the multiple copy mode. Microswitch MS26 pulses a relay which starts a timer, and also holds itself and the timer in. As the paper is fed out at the top end of the lower vertical transport assembly, it actuates either microswitch MS27, if the rear exit mode has been selected, or microswitch MS28 if the front exit mode has been selected. Actuation of microswitch MS27 or MS28 pulses another relay which cancels the hold on the timer. If MS27 or MS28 is not reached before the timer times out, a jam is indicated. The relays are pulsed so that long sheets can be fed in succession, and still be detected.

A further jam detection microswitch MS29 is located in the upper vertical transport assembly. Actuation of microswitch MS28 starts a timer, and actuation of MS29 stops the timer. If MS 29 is not actuated before the timer times out a jam is indicuated. On detection of a copy paper jam, the machine shuts down completely, and the paper has to be removed. Opening the horizontal transport drawer resets the jam stop circuit, but restarting is not possible if the paper is lying on any of the switches in the copy paper path. If all the switches are clear, the "on" button is pressed and the machine goes into a "restart to clear" cycle. In this mode the document path switches (other than the jam detection switches) are inhibited, so the document is fed out without a copy being made. If the machine was in a multiple copying mode, the count is held and on restarting the machine, the count continues.

Figure 24:
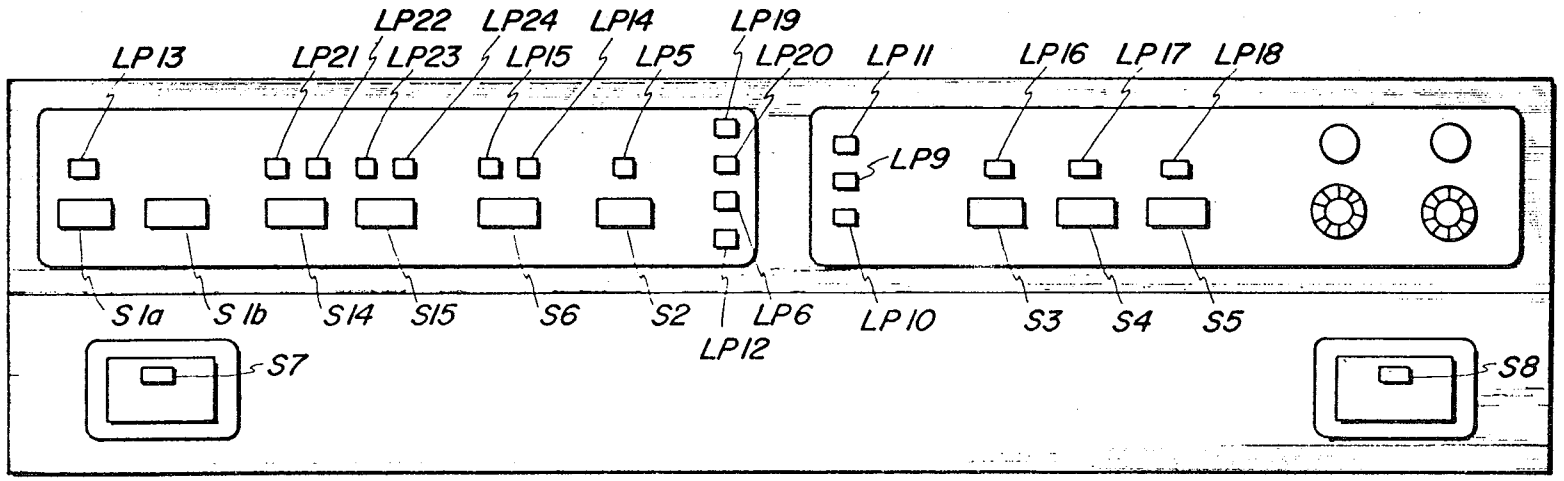
FIG. 24 illustrates the operation control panel of the machine.
Figure 25:
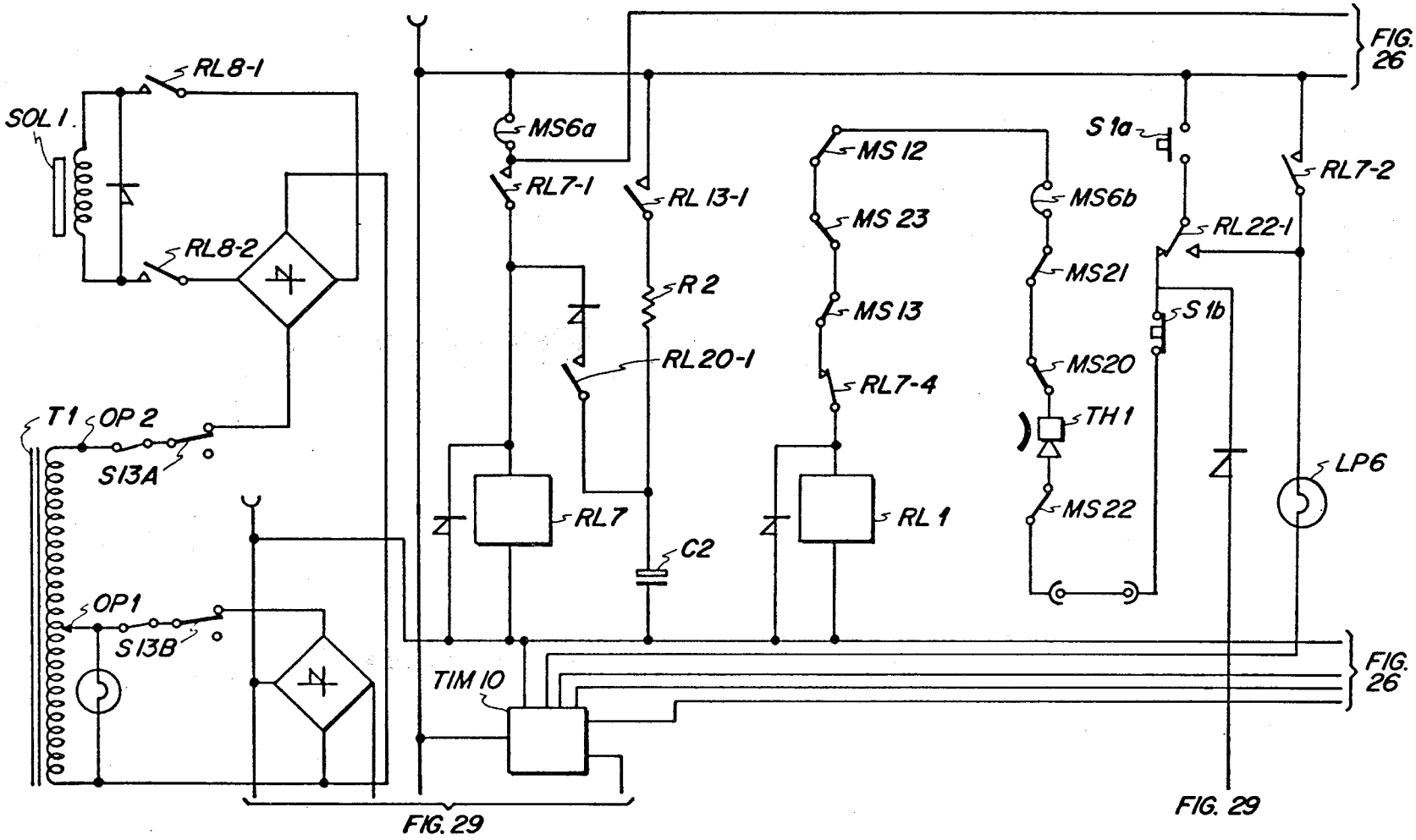
FIGS. 25 to 36 are portions of the electrical circuit of the machine, each unconnected line in each figure carrying, in a circle, a reference to the figure in which that line is continued.

The machine control circuitry will now be described in more detail, with reference to the circuit diagram of FIGS. 25 to 36. It may also be helpful to refer to FIG. 37, which is a chart showing the functioning sequence of a series of cam-operated cycle control switches SW1 to SW11. In addition, FIG. 24 shows the positions of various ones of the operator switches on the control panel of the machine, and various ones of the indicator lamps.

POWER SUPPLIES

Power is supplied to the machine via an autotransformer T1, (FIGS. 25 and 33) the input of which is fused. On the secondary side, there are low voltage outputs OP1 and OP2 (FIG. 25) for the +24 volts control systems and the +68V cutter solenoid respectively, and high voltage outputs, OP3 and OP4, for the machine drive motors and heaters. These supplies are controlled by a rotary switch S13 which has contacts S13A, S13B (FIG. 25), and S13C, S13D, S13E, S13F (FIG. 33). With the switch in the "off" position, 230 volts is available at a service socket, via contacts S13C and S13D, for use by an engineer for electrical equipment such as a vacuum cleaner.

Figure 35:
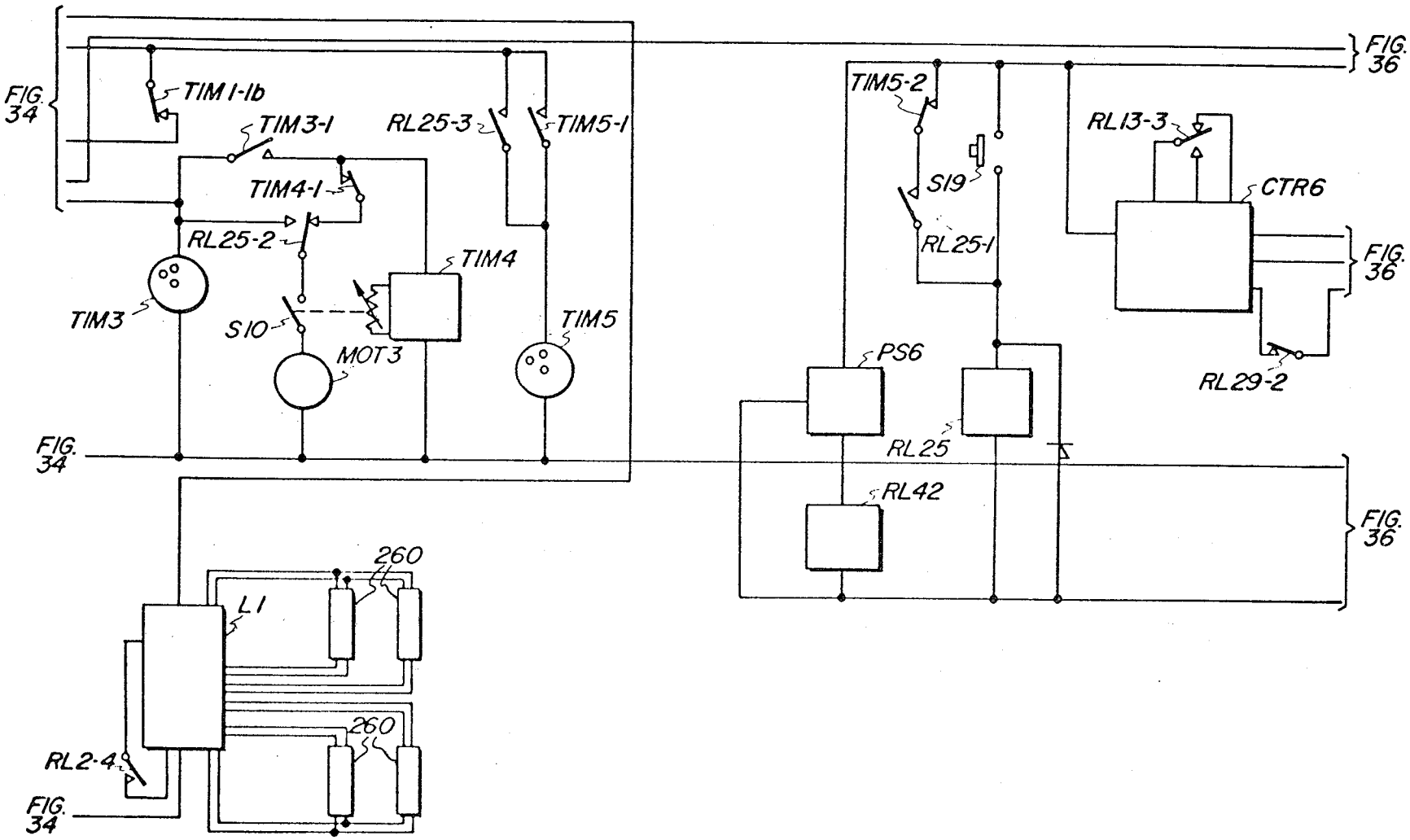

In order to start the machine from cold, operating button S1*a* (FIG. 25) is pressed. This supplies +24 volts to relay RL1 via the machine interlocks. Providing all the interlocks are made, RL1 is called, and contact RL1-1 (FIG. 29) provides a hold path for the relay and lights "on" lamp LP13. Relay contacts RL1-2, -3, -4. -5 and -6 (FIG.33) connect the 115 volt and 230 volt supplies to the exposure lamp cooling motors MOT 10 and MOT11 (FIG. 34), compressor motor MOT9, and document tray blower motor MOT12 (FIG. 33), and also to the fuser roll heater LP8 and exposure lamp ballast L1(FIG. 35). The machine will remain in a "not ready" condition until the fuser heater reaches a running temperature. Lamp LP11 (FIG. 30), the "not ready" lamp, will be lit until all systems are in the "ready to print" condition. If any of the interlocks are broken, relay RL1 will be de-energized, and the power supplies to the fuser, the drive systems, and the mode selection system will be disconnected.

In order to remove power to the machine, switch S1*b* (FIG. 35) is pressed. This de-energizes RL1 and closes down the machine.

The interlock system (FIG. 25) comprises a set of contacts all connected in series, so they must all be made before relay RL1 can be called. Microswitch MS13 is closed when the developer housing 200 is in place, MS23 is closed when the front door is closed, MS12 is closed when the drum 14 is in place, MS6b is closed when the horizontal transport assembly is in its operative position, MS20, MS21 and MS22 are closed respectively on closing the rear, left-hand and right-hand doors of the machine. Thermostat TH1 is closed unless the fuser roll overheats.

OPTICAL RATIO MODE SELECTION

Figure 32:
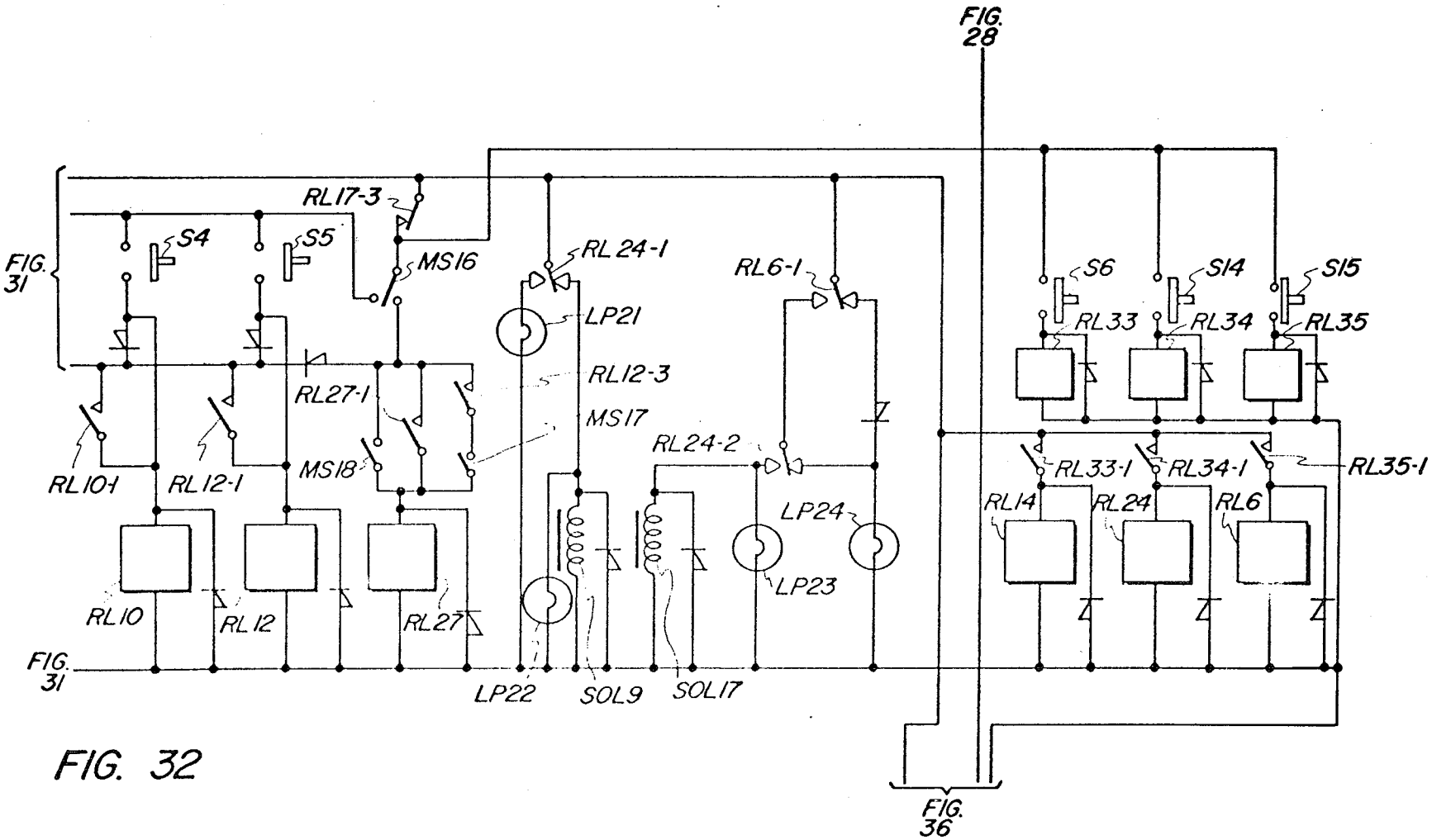

A change 31), lens position between the 100 percent, 70 percent and 50 percent modes can only be achieved when the machine is not in a print cycle. The three magnification modes are selected respectively by operator switches S3 (FIG. 31) S4 (FIG.32) and S5. SELECT 70 PERCENT POSITION WITH LENS STARTING FROM THE 100 PERCENT POSITION Switch S4 is pressed, thereby calling two relays, RL26 (FIG. 31) and RL10 (FIG. 32). Relay contact RL26-1 (FIG. 30) places the machine in a "not ready" state and lights lamp LP11. RL26-2 (FIG. 34) drives the lens change motor MOT5 in a forward direction (as defined in the description of the optical system, above). RL10-1 (FIG. 32) acts as a hold path for RL10, +24 volts being supplied via RL17-3 and MS16. RL10-2 (FIG. 28) primes the lens stop solenoid circuit. As the lens moves from the 100 percent position, MS16 changes over, and supplies +24 volts to relays in the lens position circuit. At a position just after passing the 70 percent position, microswitch MS17 (FIG. 32) is made, and relay RL27 is called via contact RL12-3. RL27-1 acts as a hold path for RL27. RL27-2 (FIG. 34) is a change-over contact, and upon its operation, the lens motor MOT5 is driven in the reverse direction towards the 70 percent (home) position. RL27-3 (FIG. 28) initiates the lens stop solenoid SOl18 which was previously primed by contact RL10-2. SOl18 places a physical stop in the lens path, and on contact with this, MS16 (FIG. 32) (which is mounted on the lens carriage) changes over, and de-energises relays RL26, RL10 and RL27. It also de-energises the lens drive motor MOT5 and the solenoid SOL18. Since the lens carriage is driven hard against the stop, the solenoid plunger remains in the operated position. The 70 percent position has now been reached, and the switches 53, 54 and 55 are re-energized, ready for the next required change.

SELECT 50 PERCENT POSITION WITH LENS STARTING FROM 100 PERCENT OR 70 PERCENT POSITION

Figure 28:
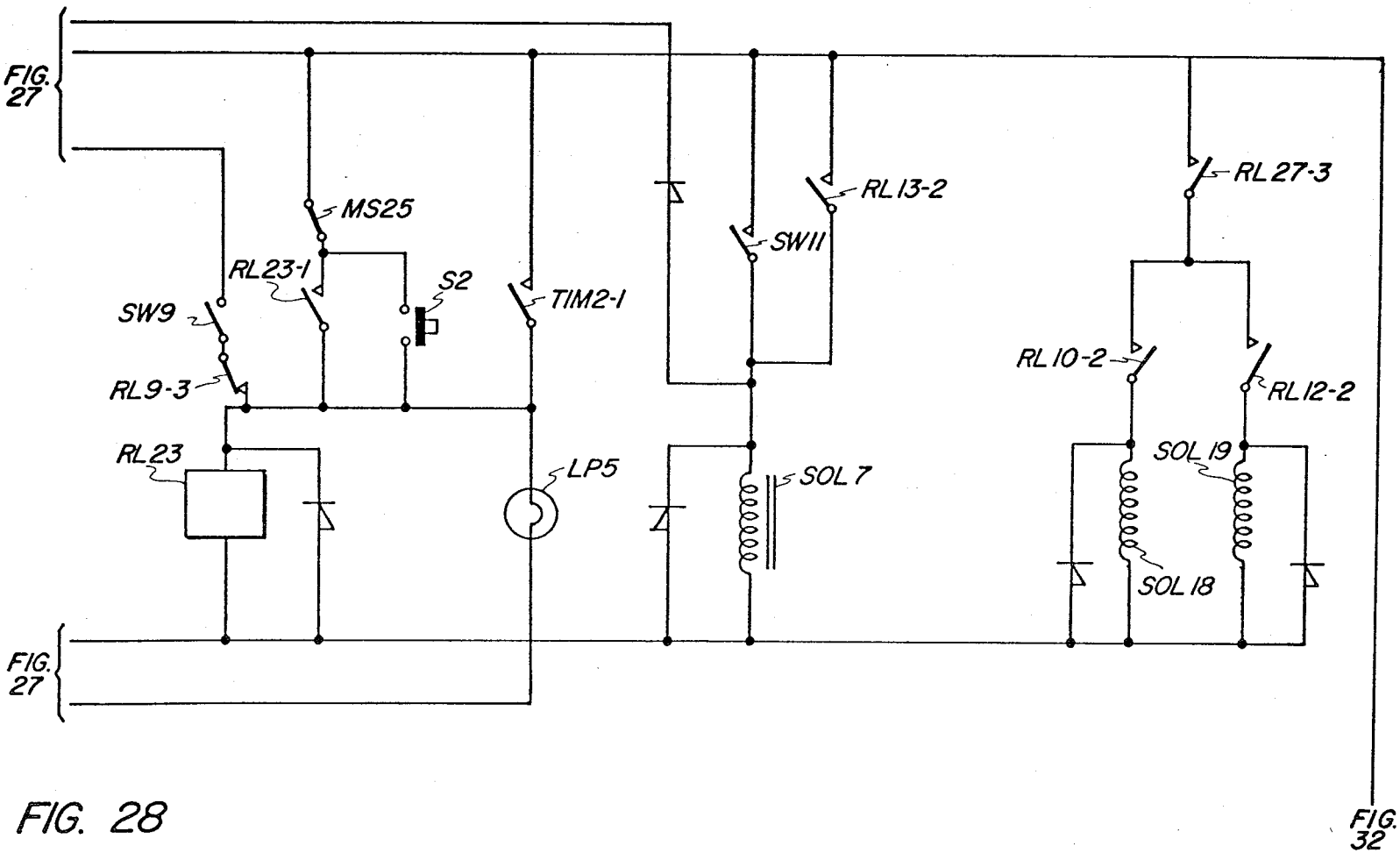

The same general sequence of events takes place when the 50 percent mode is selected. S5 (FIG. 32) is pressed which calls relays RL26 (FIG. 31) and RL12 (FIG. 32). RL12-1 acts as a hold path for RL12, and RL12-2 (FIG. 28) primes the 50 percent lens stop solenoid SOl 19. Motor reversal at the 70 percent position is inhibited by RL12-3 (FIG. 32), and the lens only reverses on reaching microswitch MS18 at a location forwardly of the 50 percent position. A physical stop is placed in the 50 percent mode position by means of the solenoid SOL19 (FIG. 28).

SELECT70 PERCENT POSITION WITH LENS STARTING FROM 50 PERCENT POSITION

Switch S4 (FIG. 32) is pressed which calls relays RL26 (FIG. 31) and RL10 (FIG. 32). As before, RL26-1 (FIG. 30) places the machine in a "not ready" state, and lights the indicator lamp LP11. RL26-2 (FIG. 34) drives the lens motor in a forward direction. FL10-1 (FIG. 32) acts as a hold path for RL10, +24 volts being supplied by RL17-3 and MS16. RL10-2 (FIG. 28) primes the lens stop solenoid SOl18 circuit, and as the lens moves from the 50 percent position MS16 (FIG. 32) changes over and supplies +24 volts to the relays in the lens position circuit. On reaching the 70 percent position, microswitch MS17 is made, and RL27 is called. Relay contacts RL27-1, -2, and -3 operate as described above, so that the lens comes to rest in the 70 percent (home) position.

SELECT 100 PERCENT POSITION WITH LENS STARTING FROM 70 PERCENT OR 50 PERCENT POSITION

On selecting the 100 percent mode a similar sequence occurs as in the case just described, where the 70 percent position is selected starting from the 50 percent position. The lens moves off the stop in a forward direction (towards the 50 percent position) and then reverses to come to rest against the 100 percent position stop.

Thus, whichever mode is selected, the lens always starts to drive in a forward direction (i.e. towards the 50 percent position), and always approaches the programmed position from the same direction (towards the 100 percent position).

In case any of the position microswitches fail, MS14 (FIG. 34) and MS15 are provided, being over-travel switches which isolate the motor to prevent damage to the mechanism.

EXIT SELECTION FOR PRINT AND DOCUMENT

Documents and prints may be directed to the front or rear of the machine for collection. As mentioned above, in connection with the document handler and copy paper paths, there are three possible combinations of exit modes. The document and print may both be delivered to the front of the machine, or may both be delivered to the rear of the machine. Alternatively, it is possible to have the document delivered to the front tray and the print to the rear. It is clearly not possible to direct documents to the rear and prints to the front as a jam would result. The circuit has been arranged to inhibit this mode.

The selection of exit condition is achieved by means of solenoid operated baffles in the document and copy paths. Document deflector baffle 44 is operated by solenoid SOL 9 (FIG. 32), and copy paper baffle 196 is operated by solenoid SOl17. These solenoids have been arranged so that, when de-energised, the documents are fed to the front exit position, and copies are fed to the rear exit position, thus ensuring a "fail-safe" element in the operation of the machine. Solenoids SOL17 and SOL9 are actuated by means of electro-mechanical latching relays ("divide by 2" relays) so that the system retains a memory of its last command even if power is removed.

Considering first the selection of the copy exit mode, the operation of "copy to front or rear" switch S15 (FIG. 32) by the operator causes RL35 to change state. This will either de-energise or energise the slave relay RL6, by means of RL35-1, dependent on the previous condition of RL35. RL6 has one change over contact, RL6-1, supplying power in its first, normally closed, state to the "copy rear exit" indicator lamp LP24. When relay RL6 is called, the normally open part of the change-over contact RL6-1 then supplies power to the copy exit solenoid SOL17 via the normally open contact RL24-2 of the document exit selection slave relay RL24. Thus, if RL24 is called when RL6 is called, the copy exit solenoid SOL17 will be actuated, and the copy returned to the front of the machine.

Considering now the selection of the document exit, pressing operator switch S14 ("document to front or rear") causes relay RL34 to change state. This will either energise or de-energise its slave relay RL24, by meas of RL34-1, depending upon its previous condition. RL24 has two sets of change-over contacts. RL24-2 changes over to switch the "copy front exit" demand from RL6-1 either to the copy exit solenoid SOL17 and "copy front exit" lamp LP23 (the normally open contact) or to the "copy rear exit" lamp LP24 (the normally closed contact). RL24-1 switches power to either the "document front exit" indicator lamp LP21 (the normally open contact) or to the "document rear exit" solenoid SOL9 and its indicating lamp LP22.

This switching of the "copy front exit" signal through RL24 inhibits the condition in which documents and copies would collide (documents to rear and copies to the front).

SELECTION OF AUTOMATIC OR MANUAL FEED OF COPY PAPER

Figure 36:
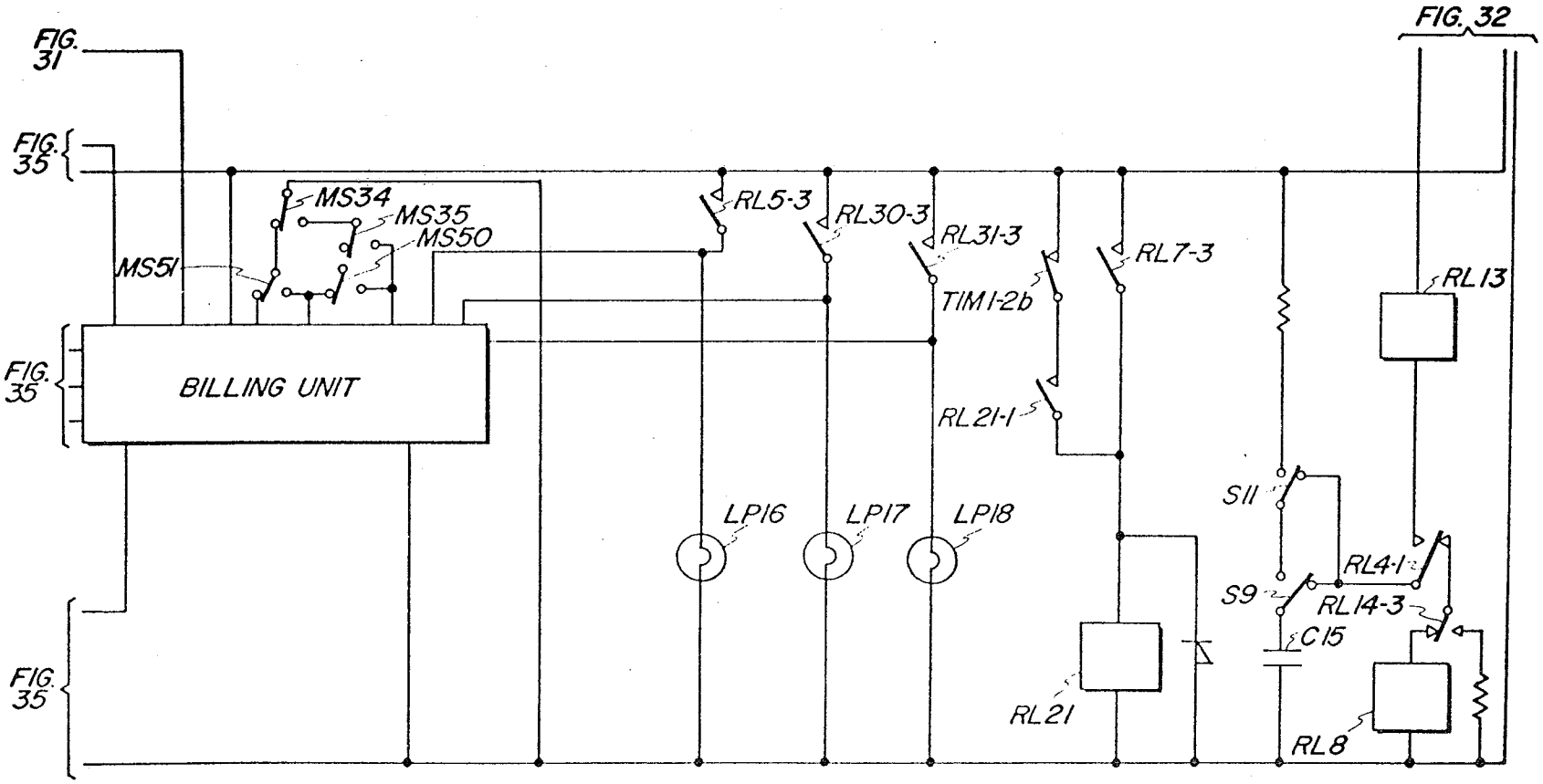
Figure 37:
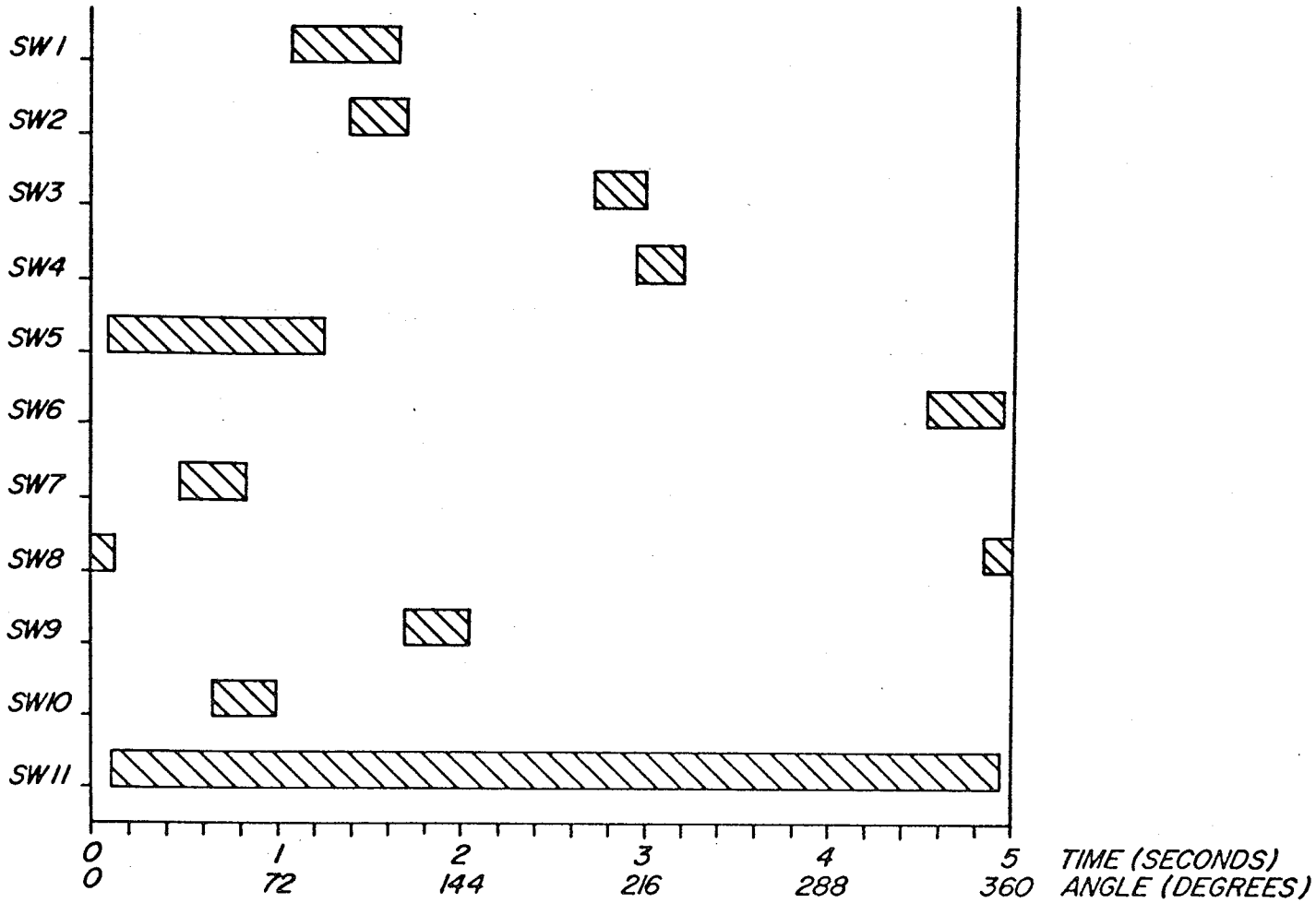
FIG. 37 is a chart indicating the relative functioning times of the set of switches operated by the cycle control timer.

Considering first the case where the machine is to be used with automatic copy paper feed, solenoid SOL10 (FIG. 31), which actuates the feed of paper from the roll and relay RL8, which operates the automatic rotary knife are called respectively by relay contacts RL14-1 and -3 (FIG. 36). RL14 (FIG. 32) is slaved to RL33, which is an electro-mechanical latching unit. Pulsing the relay RL33 by pressing the "automatic/-manual" switch S6 changes the contacts RL33-1 from the normally closed to the normally open state or vice versa. The mechanical latch RL33 holds this state until the relay is pulsed again. In the automatic copy feeding mode, lamp LP15 (FIG. 30) lights to indicate the condition.

MANUAL SHEET FEED

Figure 29:
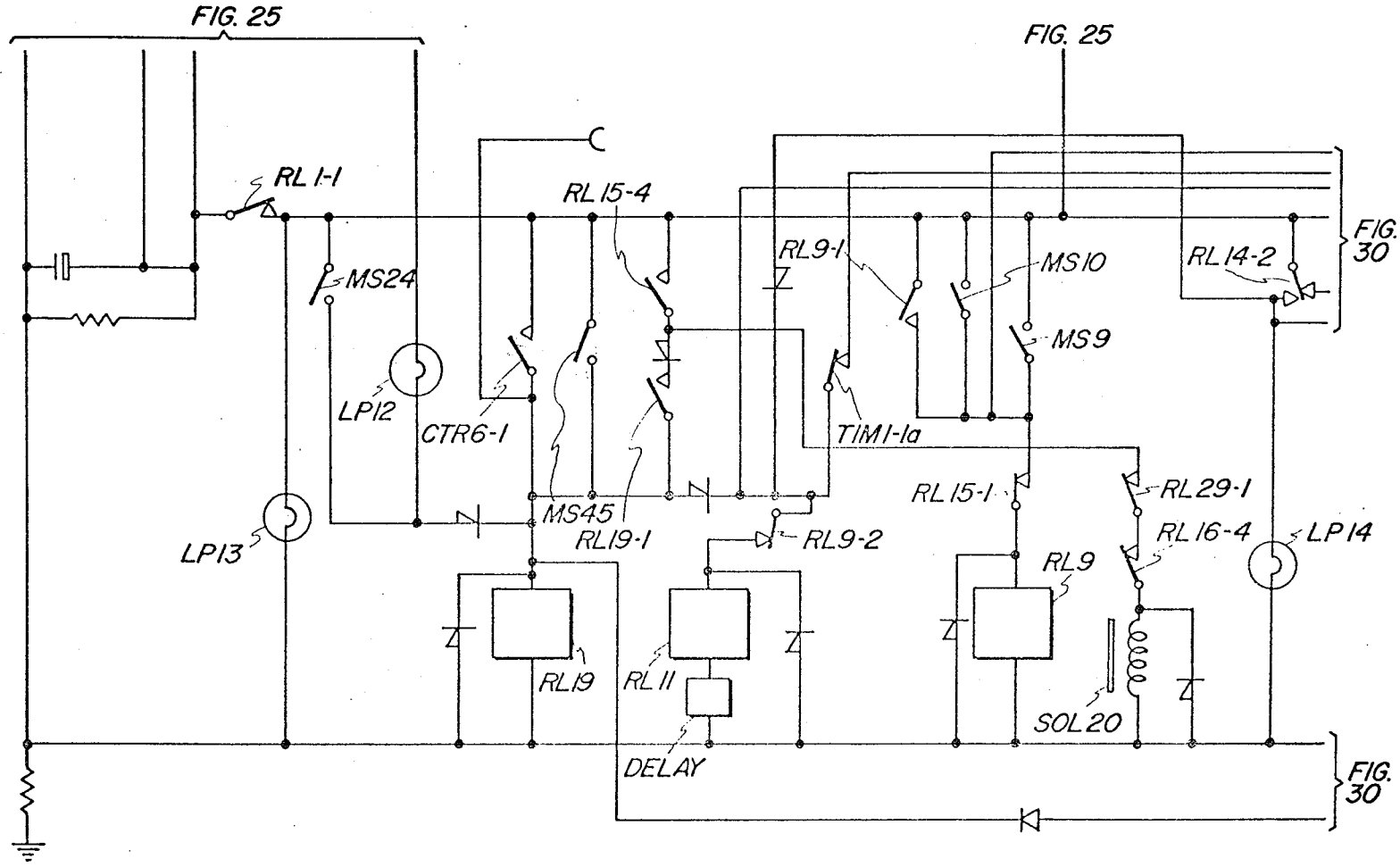

Turning now to the case where copy paper is to be manually fed, relay contacts RL14-1 (FIG. 31) change to the normally open condition, to actuate sheet feed solenoid SOL12, and are mechanically held in this state by the latching relay RL33 (FIG. 32). Contact RL14-1 (FIG. 31) primes the sheet feed circuit, and RL14-3 (FIG. 36) inhibits the rotary knife solenoid and RL14-2 (FIG. 29) lights lamp LP14 to indicate that manual feed has been selected. The "feed paper" lamp LP10 (FIG. 30) is also lit by RL14-2. To ensure that only one print is made, the manual switch 56 completes a path to RL11 (FIG. 29). When this relay RL11 is activated it ensures that forward drive is maintained. Hence, when the document leaves microswitch MS1, the shut-down sequence is inhibited.

On inserting a cut sheet, microswitches MS8*a* (FIG. 30) and MS8*b* (FIG. 34) are actuated. MS8*a* has its contacts changed over by the cut sheet, thereby extinguishing lamp LP10 (FIG. 30), and energising RL15, which is in turn lights the "feed document" lamp LP9 via contact RL15-2. It also provides a voltage supply to solenoids SOL2 (FIG. 27) and SOL3 through contact TIM6-1. The contacts of MS8*b* (FIG. 34) are closed to energise timer TIM6. Timer TIM6 causes contacts TIM6-1 to remain closed for 5 seconds. With this contact closed, manual registration solenoids SOL2 and SOL3 are energized.

On energisation, SOL2 and SOL3 release the sheet drive rollers 68 and 69 and introduce the registration blocking members 96 into the feed path. The operator thus has 5 seconds in which to register the sheet against the blocking members. This process ensures that the document and cut sheet are in registration throughout the copy cycle.

After 5 seconds, TIM6-1 opens, de-energising solenoids SOL2 and SOL3. This causes the sheet feed barrier to be removed, to clear the feed path, and causes the sheet drive roller 68, 69 to grip the paper in readiness for the copy cycle. On feeding the document into the handler, the copy cycle is the same as that already described, except that cycle switch SW7 (FIG. 31) controls the manual feed circuit.

Mode changes (magnification mode selection, document and print exit selection, and automatic/manual paper feed selection) can only be made when the machine is not in a print cycle. To inhibit selection when printing, the +24 volt supply to the various mode change circuits is removed by opening relay contact RL17-3 (FIG. 32).

JAM HOLD CIRCUIT

The "jam hold" circuit is called whenever a paper jam is detected in the machine. It is primed on every print cycle in readiness for the detection of a jam condition. At the start of every print cycle, contact RL13-1 (FIG. 25) closes, and capacitor C2 is charged through R2 to +24 volts. In the event of a copy paper jam being detected, relay RL20 (FIG. 26) is energised, and contact RL20-1 (FIG. 25) closes. This allows C2 to discharge into relay RL7, which is then energised and self-held through its own contact RL7-1, as well as the horizontal transport assembly interlock microswitch MS6*a*. RL7 also closes its contacts RL7-2 and lights the "clear paper" lamp LP6. RL7-3 (FIG. 36) energises the jam hold relay RL21, and RL7-4 (FIG. 25) opens to break the interlock circuit, thereby removing power from RL1, the main machine power relay. This in turn causes the machine to stop, with a "hold circuit" condition prevailing in the programmer.

As mentioned above, copy paper jams can be detected at several stages along the paper transport system. To summarise, the jam detection microswitches in the paper path are, MS7 (FIG. 26) in the registration transport assembly, MS5 in the horizontal transport assembly, MS26 in the rear vertical transport assembly, MS27 (FIG. 27) at the rear print exit, and MS28 and MS29 (FIG. 26) in the upper vertical transport to front print exit.

If a jam occurs on the registration transport assembly, switch SW2 on the cycle control cam will close before MS7 is actuated. Relay RL20 and the "horizontal jam" lamp LP19 are energised, thereby indicating a horizontal jam.

If paper fails to be puffed off the drum onto the horizontal transport assembly, microswitch MS5 will remain in its normally closed position. If MS5 is not open by the time switch SW4 of the cycle control cam is closed, relay RL20 is energised, as well as horizontal jam light LP19.

As a further check on copy paper remaining on the drum after the puffer 145, a photo-cell detector PS6 senses the presence of paper on the drum passed the puffer assembly. The detection of paper on the drum by photo-cell detector PS6 (FIG. 35) energises RL42. RL42-1 (FIG. 26) closes to energise RL20 and lamp LP19.

If the paper does not feed properly into the rear vertical transport, switch MS26 will remain in its normally closed position. Switch SW6 of the cycle control cam will close at the appropriate point in the cycle, and complete the supply path to relay RL20 and the horizontal jam lamp LP19.

Figure 26:
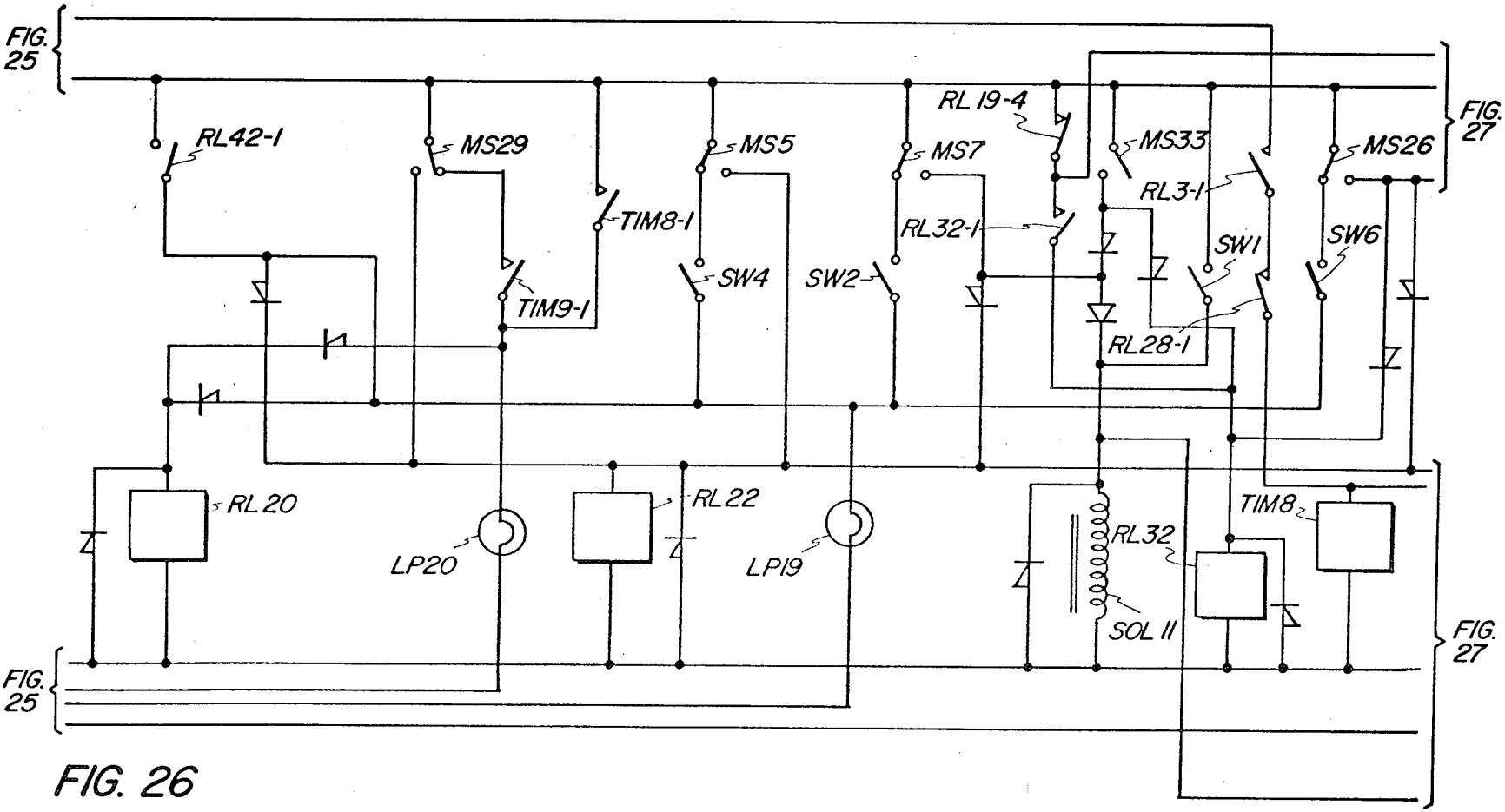
Figure 27:
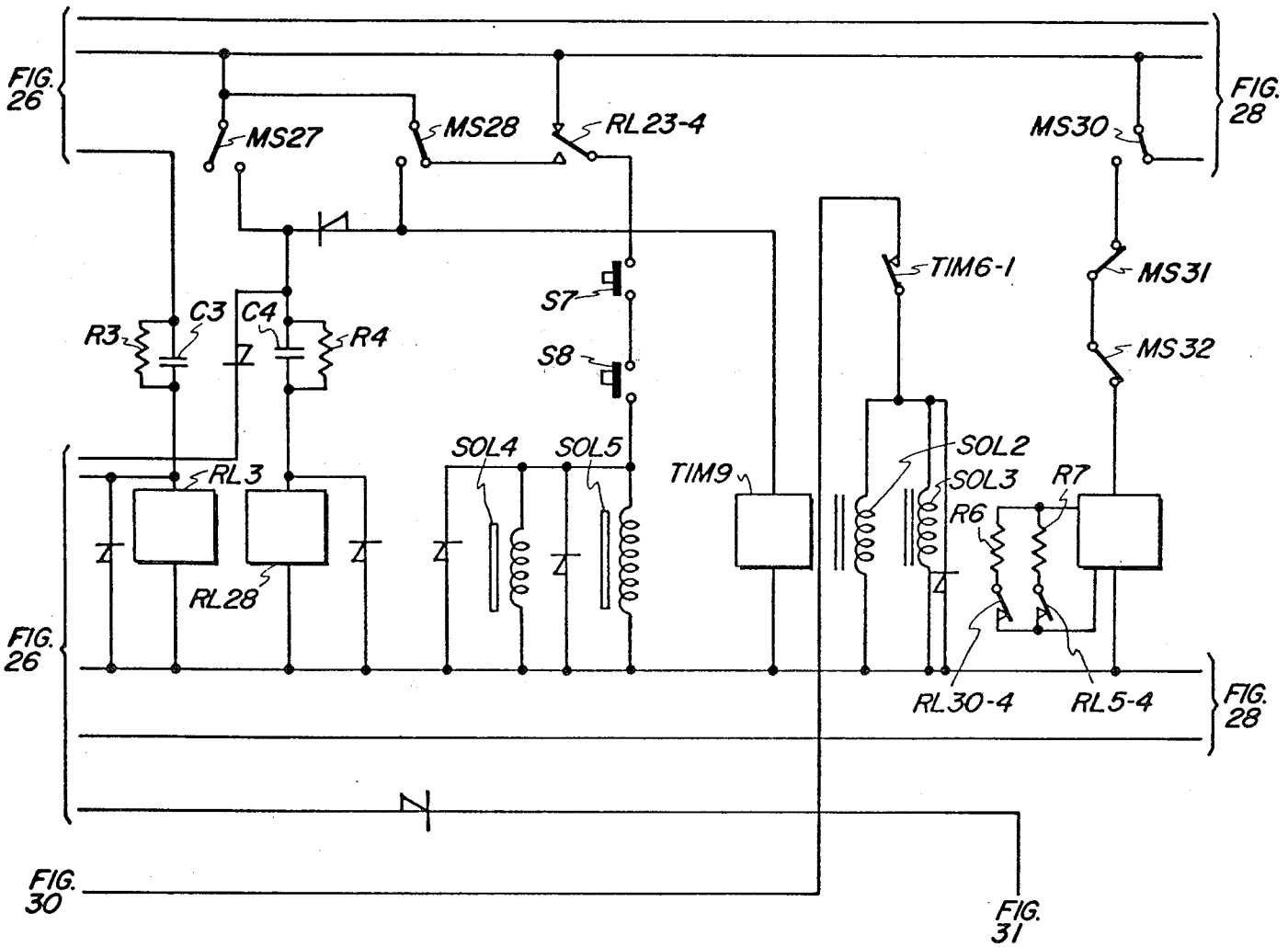

When paper passes satisfactorily over MS26, relay RL3 (FIG. 27) is energised and is self-held by RL3-1 (FIG. 26) via RL28-1. This starts the timing sequence of TIM8. TIM8 has been arranged to detect a fault if the timing sequence is not cancelled by the print reaching the next path switch. Since the jam detection circuit must cater for both short and long prints, relays RL3 (FIG. 27) and RL28 are operated by the closure of MS26 (FIG. 26) and MS27 (FIG. 27) respectively. Series capacitor C3 charges via RL3 when MS26 is operated. On energisation, RL3 self-holds and operates TIM8 (FIG. 26). When the lead edge of the sheet reaches MS27, (FIG. 27), RL28 is similarly pulsed, by series capacitor C4, resulting in the release of TIM8 and RL3, even if a long sheet still has MS26 operated. On release of the microswitches by the trailing edge of the sheet, C3 discharges through R3 and C4 discharges through R4. If the leading edge of the document does not reach MS27, TIM8 will complete its timing sequence. TIM8-1 (FIG. 26) contact will then close, relay RL20 will be energised and the vertical transport jam light LP20 illuminated to indicate a jam.

In the case where paper is to be fed to the front of the machine, an identical sequence will take place as that just described for the rear exit case, except that MS28 (FIG. 27) will cancel the TIM8 timing sequence instead of MS27. Thus, TIM8 will be cancelled by either MS27 or MS28 changing over and momentarily energising RL28 via C4.

When the print passes across MS28, it cancels TIM8 as already mentioned. It also starts the timing sequence of a further timer TIM9. If the print has not reached MS29 (FIG. 26) (in the upper vertical transport assembly) by the time TIM9 has completed its sequence, a jam signal will be generated by the closure of contact TIM9-1. This will result in RL20 being called, and the vertical transport jam light LP20 being illuminated. If the paper is unimpeded, microswitch MS29 opens thereby rendering the closure of TIM9-1 contact ineffective.

SUMMARY OF JAM DETECTION AND PAPER LOCK-OUT

The principal of paper path detection is to check the paper at regular intervals through the transport system by comparison of the paper position with a cycle timer switch. At each position of detection in the transport path, the paper must reach and operate the relevant path switch before a line is completed to the jam relay by way of the switch on the cycle control cam. Thus, as the paper passes over the path switches MS7, MS33, MS5, MS26, MS27, MS28 and MS29, the contacts change over, and supply +24 volts to relay RL22. Photo-detector PS6 (FIG. 35) will also actuate RL22, by way of RL42, if paper fails to be puffed off the drum. Should a jam occur the paper will most probably rest across a path switch and this will maintain the supply to RL22. If the paper is not removed from the transport by the operator RL22 (FIG. 25) will be maintained in the energised position. RL22-1 inhibits the action of the machine "on" button S1, so that if S1 is pressed without first removing paper from the transport system, the "clear paper" lamp LP6 is illuminated, but there is no effect on the machine start relay RL1. Hence, a "lock-out" condition has been achieved.

DOCUMENT JAM DETECTION

Jams in the document transport system can be detected at three points. As mentioned above, these are at microswitch MS30 (FIG. 27) and at microswitches MS31 or MS32 depending on whether the document is being fed to the rear of the machine or to the front.

If the document fails to reach MS30 (located just after the exposure slit 11) before SW9 (FIG. 28) on the cycle control cam closes, the document jam relay RL23 will be energized. Provided the document reaches MS30 before SW9 closes, MS30 initiates the timing sequence of timer TIM2 (FIG. 27), via microswitches MS31 and MS32. The contact TIM2-1 (FIG. 28) of timer TIM2 closes after a delay to indicate a document jam by illuminating the "clear document" lamp LP5, unless the document reaches MS31 (FIG. 27) or MS32 first, and inhibits the relay action by opening the contacts of the relevant microswitch. Depending on the optical magnification ratio chosen, an external resistor is switched into the circuit of TIM2 to give the correct time delay for the document to travel to the next path switch, and inhibit the action of the timer.

When RL23 (FIG. 23) is called (as described above) RL23-1 closes and creates a hold path via document handler interlock MS25. It also completes the circuit to the "clear document" warning lamp LP5. RL23-2 (FIG. 31) opens and disconnects the document drive, to prevent further damage to an original document. RL23-3 opens to prevent another copy cycle being initiated by de-energising RL4. It also cancels the existing cycle. RL23-4 (FIG. 27) changes over to provide a supply to the document handler release solenoids SOL4 and SOL5, via document handler release switches S7 and S8 and MS28. MS28 would be held open by a copy being fed out into the front exit tray, and thus, should a jam occur during this operation, lifting of document handler would be prevented until this operation was completed.

If the operator sees or hears a document misfeed, the "stop document" switch S2 (FIG. 28) can be pressed. This will stop the document drive immediately.

On clearing the document handler, microswitch MS25 is opened, and this re-sets RL23 to the de-energised state to allow the next document to be fed.

The action of timer TIM2 (FIG. 27) is inhibited, when the transport is reversing in the multi-copying mode, until the document has cleared either MS31 or MS32. Failure to clear MS30 will actuate the shut-down timer, thus providing a measure of jam detection for both directions of document travel.

Microswitches MS46 and MS47 (FIG. 31) act as interlock switches, preventing operation of the document feed clutches, (SOL13, SOL14, SOL15 and SOL16, which drive the document handler in the 100 percent, 70 percent, 50 percent and reverse modes respectively), should the document handler not be correctly latched in position.

JAM HOLD, AND "RE-START TO CLEAR" CYCLE

When a copy paper jam occurs, relay RL7 (FIG. 25) is called by contact RL20-1 of RL20 (FIG. 26) (the paper jam relay). The machine must not be able to start until the jam has been removed. To achieve this contact RL7-3 (FIG. 36) closes and energises relay RL21, which carries out the following functions when the machine power "on" button S1*a* (FIG. 25) is pressed. RL21-1 (FIG. 36) completes a hold path via the shut-down timer contact TIM1-2*b*. RL21-2 (FIG. 30) lights the "not ready" lamp LP11 and RL21-3 (FIG. 31) inhibits the "start copy" cycle sequence. RL21-4 (FIG. 30) initiates the shut-down timer TIM1 in the "restart to clear" sequence and ensures that foward document drive is maintained.

Figure 30:
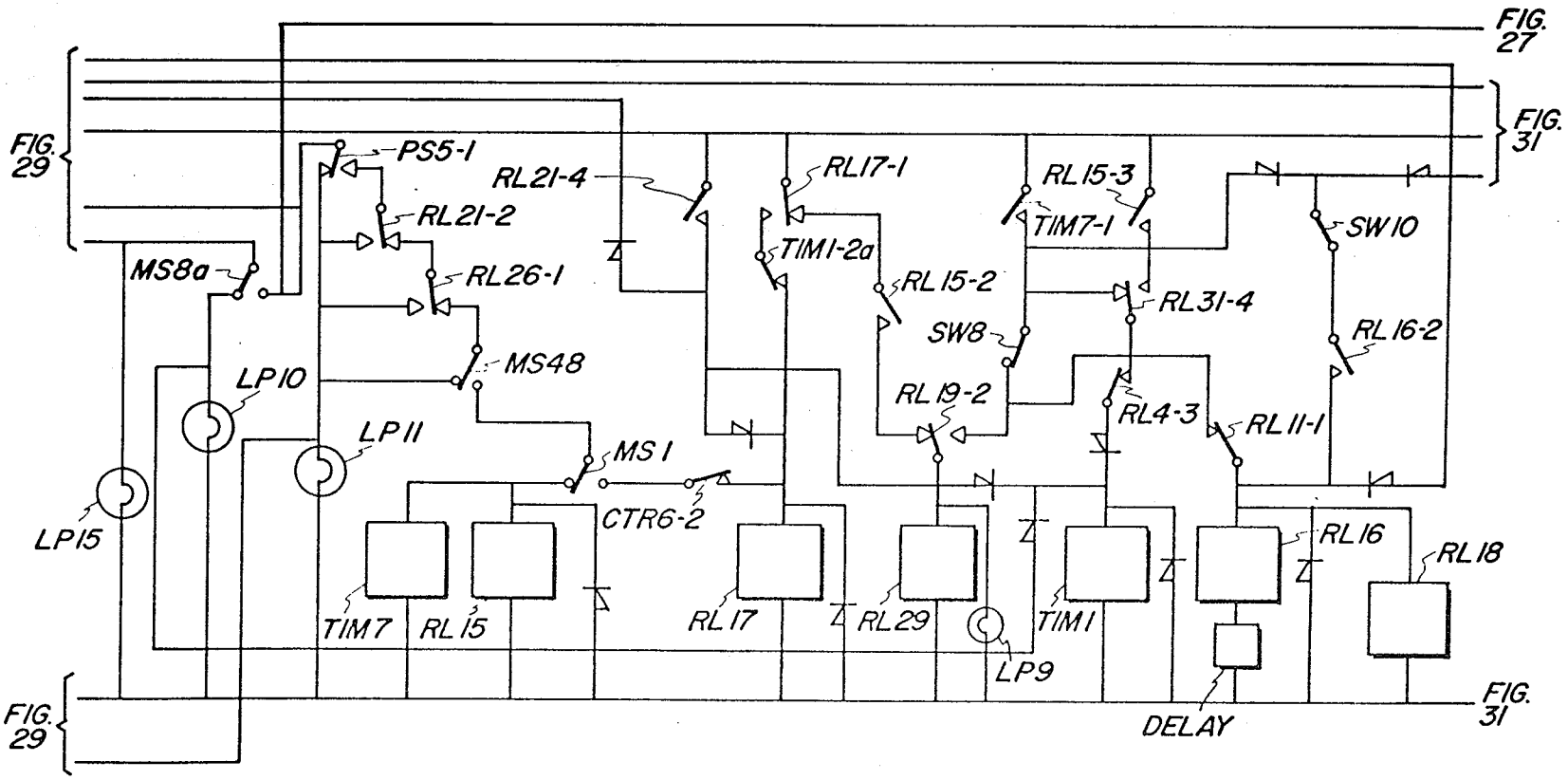
Figure 31:
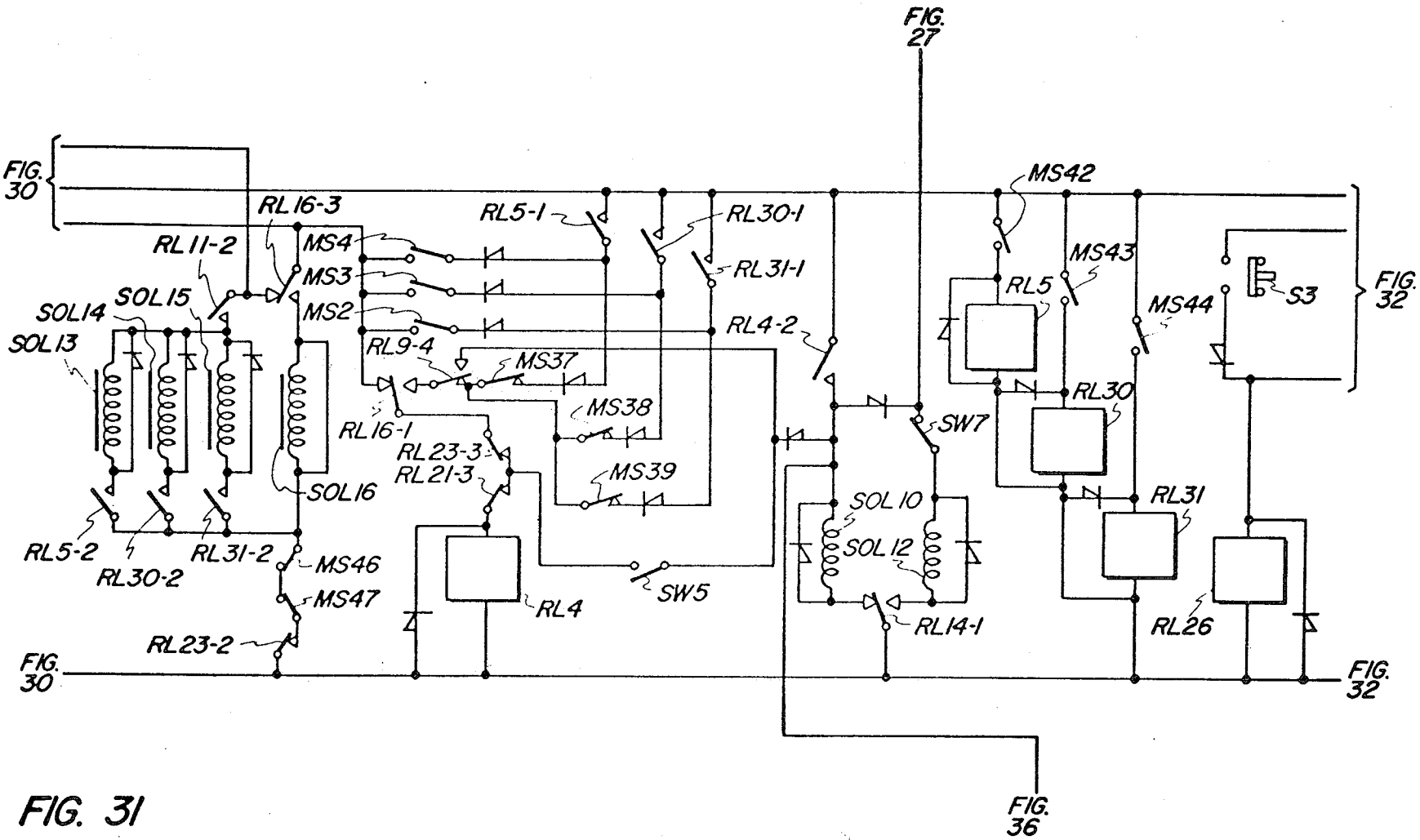

When the jam has been removed, the "on" button S1*a* (FIG. 25) is pressed, and the machine "cycles out" through the shut down sequence, controlled by the two-stage timer TIM1 (FIG. 30). This feeds out the document without feeding any further copy paper through the machine. A new copy cycle is inhibited by the action of RL21-3 (FIG. 31) opening until the shut down sequence is complete. Contact TIM1-2*b* (FIG. 36) opens to reset the jam relay RL21.

In the event of complete loss of power in a jam condition, the machine cannot be restarted when power is reconnected until the jam has been removed. This "memory" will stop paper entering the brush housing on restarting the machine.

PAPER REEL LOADING

To change a copy paper roll, the front panel of the machine is first opened to expose the loading unit. Pressing the loader "down" button S18 (FIG. 33) connects 110 volts to the roll loader motor MOT13 via the "up" button S17 and "down limit" microswitch MS36. The circuit has been arranged to cut the supply to the loader motor if buttons S17 and S18 are pressed at the same time. MS36 acts as a limit of travel switch for downward motion and on opening cuts the supply to the motor. After fitting in a new roll of paper, the "up" button S17 is pressed and the loader swings the new roll into place. As the limit of travel microswitch for the upward direction, MS19, is operated the supply is removed from the motor. In the event of failure of either MS36 or MS19, the loader arm will operate either MS40 or MS41 at the limits of travel. These microswitches act as a safety device and inhibit further loading operations until MS36 or MS19 has been replaced or re-adjusted by a service engineer.

The loading motor is only activated while the loading operator keeps the loading button depressed. In the event of potential damage to the machine or accident to the operator, the motor can be stopped by releasing the buttons or reversed by pressing the opposite mode button.

Microswitch MS48 (FIG. 30) acts as a safety interlock in the paper loader system. If the front door of the machine is not in position, MS48 calls the "not ready" lamp LP11 and prevents machine operation.

Microswitch MS24 (FIG. 29) is operated when the diameter of the roll of paper falls below a certain predetermined diameter, microswitch MS24 lighting the "low paper" lamp LP12.

SINGLE PRINT SEQUENCE

When the machine is in a condition ready for printing, the "feed document" lamp LP9 (FIG. 30) will light. A demand of 01 copies is dialled on the copy counter switches, and on feeding a document face down into the document handler, the following sequence is activated. The leading edge of the document actuates MS1 thereby energising RL17 via CTR6-2. RL17-1 changes over, and extinguishes the "feed document" lamp LP9 and supplies a "hold" path for RL17. RL17-2 closes and energises relay RL2, and RL17-3 opens to inhibit the mode change circuits. When RL2 is energised, the various machine systems are put into operation as follows. RL2-1 lights the discharge lamp LP7 (previously referred to as 234). RL2-2 energises the main machine drive motor MOT1, the brush motor MOT7, the filter vacuum motor MOT6, the oil pump motor MOT4 (via RL4-4), the vacuum pump motor MOT8, the antistatic bar transformer PS4, the developer drive motor MOT2, the toner dispenser system TIM3, TIM4 and MOT3, and RL2-3 primes the pressure roll solenoid SOL6, and also supplies power to power supplies PS1 and PS3 for the EHT and the developer box electrode units. RL2-4 (FIG. 35) switches on the exposure lamps 260 by way of ballast circuit L1. Brush motor MOT 7 is started after a delay sufficient to ensure that a vacuum has built up in the cleaning system, this being achieved by contact T1M11-1 of timer TIM 11, With the machine now running, the document is pulled by the drive bels into the document handler. Depending on the magnification mode selected, document and print sequences will be synchronised from the moment the document hits the selected ratio switch (MS2, MS3, or MS4) (FIG. 31) is the document handler. Considering the case of a document printing at 100 percent mode, synchronisation will be initiated by the document hitting MS4.

When the 100 percent mode has been selected, MS42 (the 100 percent lens position microswitch, in the optical system) closes to energise RL5. RL5-1 primes the 100 percent document path circuit through MS4, RL5-2 primes the 100 percent drive solenoid SOL13, RL5-3 primes the billing unit, and RL5-4 selects the correct delay via resistor R7 on timer TIM2.

In the 70 percent mode, the relevant microswitch MS43 of the lens position microswitches closes to call relay RL30. RL30-1 primes the 70 percent document path circuit through MS3, RL30-2 primes the 70 percent drive solenoid SOL14, RL30-3 (FIG. 36 and FIG. 38) primes the billing meter CTR2, and RL30-4 (FIG. 27) selects the correct delay, via resistor R6, on TIM2. In the 50 percent mode, lens position microswitch MS44 closes to call relay RL31. RL31-1 primes the 50 percent document path circuit through MS2, RL31-2 primes the 50 percent drive solenoid SOL15, RI31-3 (FIG. 36 and FIG. 38) primes the billing meter CTR3, and RL31-4 (FIG. 30) primes the shut-down timer TIMl (by passing TIM7-1). The correct delay is provided by TIM2 without switching in any external resistors.

When the document closes the relevant one of microswitches MS4, MS3 and MS2, relay RL4 is energised to initiate the print sequence. Provided that no jams occur in the system, the document travels over the exposure slit 11, and out to the front or rear document exit.

When RL4 is energised, RL4-1 (FIG. 36) changes over, and allows RL13 to be pulsed "on" by C15 charging. This pulsing action also primes the circuit of the automatic cutter. The effect of pulsing RL13 is as follows. RL13-1 (FIG. 25) primes the jam hold circuit, and RL13-2 (FIG. 28) energises the one revolution clutch SOL7 which operates the cycle control cam. Energisation of SOL7 is maintained by switch SW11 of the cycle control cam until the cycle revolution is complete. RL13-3 (FIG. 35) changing over adds a "count" pulse to programmer CTR6. Returning to R14, RL4-2 (FIG. 31) energises the roll feed drive clutch SOL10 and allows paper to form a buckle behind the registration transport roller 18. A +24 volt supply is also switched to the billing unit. RL4-3 (FIG. 30) opens and inhibits the action of timer TIM1. RL4-4 (FIG. 34) switches 110 volts to the fuser oil motor MOT4, and to the toner system.

The cycle timer operated by SOL7 (FIG. 28), is driven round until switch SW1 (FIG. 26) is closed. This completes a supply path to the registration transport assembly clutch SOL11. The paper is accordingly driven through the rollers and up the registration transport system. As mentioned above, microswitches MS7 and MS33 maintain the supply to the registration transport system, and cycle control cam switch SW2 checks for a jam condition. Microswitch MS33 calls RL32, and RL32-2 (FIG. 34) energises the fuser pressure roll solenoid SOL6.

The copy paper next passes over the transfer corotron and into the horizontal transport area. Switch SW3 (FIG. 34) of the cycle control cam energises solenoid SOL8 which puffs the paper off the drum onto the horizontal transport assembly. Further paper path checks are made by comparing MS5 (FIG. 26) with SW4 and MS26 with SW6. MS26 provides a hold path for RL32 so that the pressure roller solenoid SOL6 (FIG. 34) is maintained until the trailing edge of the copy has passed through the fuser.

The function of SW5 (FIG. 31) of the cycle control cam is to ensure that a minimum length of ten inches of copy paper has passed the rotary knife before it can cut.

Further path checks are carried out in the rear vertical transport assembly by microswitches MS27, MS28 and MS29, as described above.

On energising relay RL32 (FIG. 26), RL32-1 acts as a hold for RL32 through either SW11 (FIG. 28) or RL19-4 (FIG. 26). RL32-2 (FIG. 34) supplies +24 volts to the fuser pressure roll solenoid SOL6. The hold for RL32 (FIG. 26) through SW11 (FIG. 28) provides for the pressure roller remaining up long enough to fuse short paper lengths, and the hold path through RL19-4 (FIG. 26) prevents the pressure roll being dropped between sheets during a multiple copy run.

As the trailing edge of the document leaves MS1, its contacts change over to re-energise TIM7, and RL15. TIM7-1 closes after a delay of 1½ seconds. When cycle switch SW8 closes, the feed document lamp LP9 will be lit, allowing another cycle to be started before the machine stops. RL15-1 resets the skew reverse circuit after the document is fed out of the handler. RL15-2 prevents the "feed document" lamp being illuminated during warm-up, but has no effect after the first copy cycle. RL15-3 activates the shut down timer in the 50 percent mode (i.e. by-passes TIM7-1). RL15-4 completes the "hold" path for the shut down relay RL19, and supplies power to the document feed inhibit solenoid SOL20.

After counting one copy, coincidence is reached, and CTR6-1 contact closes to energise RL19. RL19-1 closes to complete a hold path for the shut down relay and inhibits reverse drive. The shut-down timer is therefore primed. RL19-2 (FIG. 30) primes the dynamic feed document lamp circuit mode and RL29. RL29-2 (FIG. 35) resets the programmer CTR6 by removing the 180V power supply when coincidence is achieved. RL19-3 (FIG. 34) changes over to maintain the supply to the developer box motor MOT2 until contact TIM1-1*b* (FIG. 35) opens. RL19-4 (FIG. 26) opens to break one of the hold paths to RL32.

As the trailing edge of the document leaves MS4 (FIG. 31) relay RL4 is de-energised. RL4-1 (FIG. 36) changing over operates the rotary knife by pulsing RL8. The pulsing action is the result of C15 discharging through RL8. RL8-1 (FIG. 25) and RL8-2 closing operate the rotary knife actuating solenoid SOL1. RL4-2 (FIG. 31) opening disengages the roll feed drive and removes the control signal from the billing unit. RL4-3 (FIG. 30) closing initiates the shut down timer sequence TIM1. RL4-4 (FIG. 34) opening stops the fuser oil motor drive and removes the 110 volt supply from the toner system. Timer TIM1 (FIG. 30) progressively shuts down the machine system as follows. TIM1-1*a* (FIG. 29) opens but has no effect in the single copy mode. TIM1-1*b* (FIG. 35) removes the supply to the developer drive and toner dispenser system. TIM1-2*a* (FIG. 30) opens and de-energises relay RL17. This causes the machine drive system to be shut down, and for the mode selector circuit to become operative once more. TIM1-2*b* (FIG. 36) opens to reset the jam hold circuit if necessary.

Whenever RL19 (FIG. 29) is called, the above sequence takes place. RL19 is called should any one of the following conditions occur.

1. Coincidence in single or multi-copy mode.
2. Low paper microswitch MS24 actuation.
3. Stiff document sensor MS45 actuation, to prevent multiple copying of stiff documents.
4. De-actuation of PS5 (FIG. 34) caused by a drop in fuser temperature to operate contact PS5-1 (FIG. 30).

The main action of RL19 is to inhibit reverse document drive and hence to allow the shut down sequence to take place.

MULTI-PRINT SEQUENCE

The sequence for a multi-print run is as already described except that a coincidence signal is not generated until the desired number of copies have been made. To obtain a second and subsequent prints it is necessary to reverse the document to the point where the leading edge of the document is in front of the exposure slit 11. To speed up the multi-print process, two functions take place:

1. The leading edge of the document is not reversed back to the original print sequence switches MS2, MS3 or MS4, which are located at the front of the document handler and some way from the platen. Increased through-put speed is achieved by siting three more microswitches just after the exposure slit to initiate the start copy cycle for the subsequent cycles. These microswitches are designated MS37 (FIG. 31), MS38 and MS39, and relate to the 100 percent, 70 percent and 50 percent modes respectively.
2. At the same time as the document is being reversed, paper is being fed from the reel for the next print.

As the trailing edge of the document leaves MS1 on the first scan of the copy cycle, timer TIM7 starts to time out. Eventually, with the document still travelling forwards, TIM1, the shut down timer, starts to time out, when the trailing edge leaves MS2, MS3 or MS4. Reversal is achieved when timer contact TIM1-1*a* (FIG. 29) opens. This de-energises relay RL11 with the following results. RL11-1 (FIG. 30) closes and energises RL16 and RL18, via timer TIM7-1 and SW8 contacts. RL11-2 (FIG. 31) opens and disengages the forward drive to the document handler.

RL16-1 (FIG. 31) changes over but has no effect at this time as MS37 is open. RL16-2 (FIG. 30) closes and provides a hold path for RL16 through SW10 and TIM7-1, MS4 (FIG. 31) and RL5-1. RL16-3 closes and completes the reverse drive circuit by energising solenoid SOL16. RL16-4 (FIG. 29) opens and de-energises the document feed-in barrier solenoid SOL20.

The function of RL18 (FIG. 30) is to short out the charge corotron in the reverse document mode. If this were not done, the document reversing over the exposure slit would throw a blurred image onto the drum and toner would be transferred to this image if the drum were charged. As no paper is under the drum, the toner image would be cleaned off by the brush cleaning system. Although there is no harm in this procedure, obviously more toner would be used. Shorting out the main charge corotron with RL18-1 (FIG. 34) eliminates this problem.

The second copy cycle is initiated by energising RL4 (FIG. 31) as the original leading edge of the document leaves MS37 in the 100 percent mode (or MS38 in the 70 percent mode, or MS39 in the 50 percent mode), as the document travels backwards, over the exposure slit 11. The energisation of RL4 causes paper to be fed from the copy paper reel while the document is still reversing. Contact RL4-3 (FIG. 30) opening de-energises and resets the contacts of timer TIM1. TIM1-1*a* (FIG. 29) closing re-energises RL11, and RL11-1 (FIG. 30) breaks one hold path to RL16. RL11-2 (FIG. 31) primes the forward drive solenoid circuits. Reverse document drive is halted by SW10 (FIG. 30) opening, and by RL16 being de-energised. RL18 is also de-energised by SW10 opening. RL16-1 (FIG. 31) changes over to the normally closed position, and maintains the supply to RL4, via MS2, MS3 or MS4, depending upon the optical mode. RL16-2 (FIG. 30) opens and breaks the hold circuit path to RL16, and RL16-3 (FIG. 31) changes over to the normally closed position, and engages forward drive. RL16-4 (FIG. 29) opens and re-energises the document feed-in barrier solenoid SOL20.

With the forward drive re-engaged the document starts the second scan cycle. Paper is cut from the roll in the normal way by the trailing edge of the document leaving MS4 in the 100 percent mode position. RL16 and RL11 are slightly delayed to allow time for the document to stop before reversal.

In order to inhibit a second document being fed into the handler before the "feed document" lamp LP9 (FIG. 30) lights, a document feed-in barrier operated by solenoid SOL20 (FIG. 29) is positioned just inside the handler. Its function is as follows. As the document travels forward, and the trailing edge clears MS1 (FIG. 30) relay RL15 is energised. This closes contact RL15-4 (FIG. 29) which energises solenoid SOL20, via contacts RL29-1 and RL16-4. The barrier remains in place until, in the single copy mode, the shut down sequence energises the "feed document" lamp LP9 (FIG. 30) and RL29. RL29, on energisation, opens contact RL29-1 (FIG. 29) which causes solenoid SOL20 to be de-energised. In the multi-copy mode, the barrier remains in place until reversal of the document is caused by energisation of relay RL16 (FIG. 30). RL16-4 (FIG. 29) opens to de-energise SOL20. This removes the barrier to give clear passage to a long document as it reverses out for the next scan.

In the multiple copy mode, RL17, is prevented from being energised (by MS1) by means of CTR6-2 (FIG. 30), which is open until coincidence is achieved in programme CTR6.

THE EFFECT OF PAPER JAMS ON THE PRINT SEQUENCE

If a paper jam occurs in a multi-copy or single copy cycle, relay RL21 (FIG. 36) is called. RL21-1 holds RL21 via TIM1-2*b*. RL21-2 (FIG. 30) lights the "not ready" lamp LP11, and RL21-3 (FIG. 31) de-energises RL4 and hence causes the paper to be cut by the rotary knife and the roll feed drive to stop. RL21-4 (FIG. 30) closes to provide a supply to relay RL11 (FIG. 29), TIM1 (FIG. 30) and RL17, so that when the machine is restarted after the jam has been cleared, the machine drives are maintained to feed the document out, and the normal machine shut down takes place under the control of TIM1. The opening of TIM1-2*a* (FIG. 36) resets RL21 to allow a new copy cycle to take place.

THE EFFECT OF DOCUMENT JAMS ON THE PRINT SEQUENCE

If a document jams, contact RL23-3 (FIG. 31) opens and de-energises RL4 after a minimum length of copy paper, determined by SW5, has passed through the rotary knife.

When a fault has been detected, the relevant lamp is caused to flash by means of a lamp flasher TIM10 (FIG. 29). The lamps concerned are LP5 (FIG. 28), LP6 (FIG. 25), LP12 (FIG. 29), LP19 (FIG. 26) and LP20.

DOCUMENT SKEW DETECTION

Two microswitches MS9 (FIG. 29) and MS10 located on each side of the feed-in platform 30 detect skew fed documents. When either MS9 or MS10 is actuated by a skewed document, relay RL9 is energised. RL9-1 closes to act as a hold path for RL9, and RL9-2 opens and de-energises relay RL11 which supplies a path to RL16 (FIG. 30) RL9-3 (FIG. 28) opens and inhibits the document jam sensing circuit, (circuits MS30 (FIG. 27), SW9 (FIG. 28). RL9-4 (FIG. 31) changing over ensures that a copy cycle of minimum length (determined by SW5) is initiated if a skew occurs when the document is reversing. RL9-4 changes over to either:-

1. prevent RL4 being called by the document clearing MS37, MS38 or MS39, thereby preventing the initiation of a further copy cycle; or
2. maintain RL4 if it is already called, unitl RL9 is reset, thus feeding a minimum length of paper.

Thus, skew detection causes the document to be reversed out of the handler, and a minimum length of copy paper to be fed if the skew occurs at the start of a document cycle. Document reversal continues until microswitch MS1 has been cleared by the leading edge of the document. At this time RL15-1 (FIG. 29) contact opens to reset the document skew circuits.

DEVELOPER AND TONER SYSTEM

The developer system is driven by motor MOT2 (FIG. 34), which is connected to 110 volt supply via a normally closed contact RL19-3 of the shut down relay RL19. When shut down is initiated, RL19-3 changes over, and maintains the supply to the developer motor until TIM1-1*b* (FIG. 35) contact opens.

The toner dispenser motor MOT3 (FIG. 35) is activated every 30 seconds for a maximum period of 5 seconds. A 30 second cycle is obtained by timer TIM3 closing contacts TIM3-1 to supply power to timer TIM4 and the dispenser motor MOT3. Supply to the motor MOT3 is via TIM4, RL25-2 (normally closed), and switch S10. TIM4 is adjustable between 1 and 5 seconds, and for this period the timer keeps contacts TIM4-1 closed to drive the dispenser motor. When the "boost toner" button S19 is pressed, relay RL25 is energised and is self-held via TIM5-2 and RL25-1 contacts. RL25-3 closing activates TIM5, the 30 second timer. This maintains toner boost for 25 seconds by holding RL25 in an energised state through contact TIM5-2. RL25-2 actually supplies power to the dispenser motor but it is controlled by TIM5.

After 25 seconds, TIM5-2 contact opens, and stops the motor. A further five seconds elapse before TIM5-1 contact opens and de-energises the timer itself.

The 110 volt supply to the toner system is controlled by the copy cycle relay contacts RL4-4 (FIG. 34) to stop toner dispensing occurring while the machine is not printing.

PROGRAMMER

A nixie tube programmer of standard kind is used. Copy count is initiated by contact RL13-3 (FIG. 35) changing over once per cycle.

Power supplies to the programmer are +24 volts, 5 volts, and 180 volts, the latter two being obtained from the billing unit.

MANUAL OPERATION OF ROTARY KNIFE

Manual Operation of the rotary knife is provided to allow the leading edge of paper from the copy paper roll to be cleanly cut when required (particularly when loading a new roll). Relay RL8 (FIG. 36) is called by pressing operator switches S9 and S11, a cut being made on release of either switch.

CYCLE CONTROL SWITCH SEQUENCE

FIG. 24 is a chart showing the cycle control switch sequence, the blacked-in portions of the chart representing the portions of each revolution of the timing cam for which the various switches SW1 to SW11 are functional.

BILLING UNIT

The billing unit controls six billing meters. The first three meters are designated CTR1 (FIG. 38), CTR2 and CTR3, which provide respectively indications of the lengths of paper used in the 100 percent mode, the 70 percent mode and the 50 percent mode. Total paper length is recorded by counter CTR7. A weighted billing indication is provided by meter CTR4 (FIG. 40) and an indication of the total area of paper used is indicated by CTR5 (FIG. 39).

Considering first the paper length indicators, it is arranged that one pulse per foot of copy paper fed through the machine is supplied to the appropriate one of counters CTR1 (FIG. 38), CTR2 and CTR3. Since the basic machine speed is 8 inches per second of copy paper, it is necessary only to supply one pulse every 1.5 seconds to the appropriate counter. Pulses at 1.5 second intervals are provided from the billing circuit, being derived from mains frequency by a series of divider circuits. The main drive motor MOT1 of the machine is an induction motor whose speed, therefore, is proportional to the mains frequency. Considering, for example, the case of footage in the 100 percent mode, switch S3 has been pressed to bring the lens assembly into the 100 percent position. When the lens is in the 100 percent position, microswitch MS42 (FIG. 31) is actuated, thereby calling relay RL5. RL5-3 (FIG. 30) then causes the 100 percent indicator lamp LP16 to be illuminated, and also primes the counter CTR1. When the document is fed into the machine, as soon as its leading edge closes microswitch MS4, relay RL4 is called. RL4-2 then initiates operation of the billing circuit, sending pulses at 1.5 second intervals to counter CTR1.

In the 70 percent mode, a similar sequence of events takes place. Switch S4 is pressed, microswitch MS43 is actuated, relay RL30 is called, contact RL30-3 illuminates the 70 percent lamp LP17, and primes counter CTR2. Thus, when pulses are supplied by the billing circuit, counter CTR2 records the footage of copy paper used.

Similarly, in the 50 percent mode, switch S5 is pressed, microswitch MS44 is actuated by the lens carriage, relay RL31 is called, and relay contact RL31-3 is made. This illuminates the 50 percent lamp LP18 and primes counter CTR3. In this case pulses from the billing circuit are supplied to counter CTR3.

All the pulses that are recorded by counters CTR1, CTR2 and CTR3 are always recorded by CTR7. This gives a total paper length count.

Counter CTR4 (FIG. 40) records the weighted sum of the lengths of paper used, the weighting factor for each magnification mode being adjustable. The object of recording the weighted sum of paper lengths is to ensure that the operator of the machine does not always use the 50 percent or 70 percent magnification modes in order to achieve a cost saving. In other words, when the operator uses a reduction mode, be may be charged at a higher rate than the direct footage rate, to compensate for the increased information density he has obtained. As an example, if there were no weighting factor, and the operator always used the 50 percent mode, his costs would always be halved compared with making 100 percent sized copies. If on the other hand a weighted billing factor of two were introduced it could be made twice as expensive to make copies in the 50 percent mode as in the 100 percent mode for a given size of copy. Clearly, some compromise factor lying between 1.0 and 2.0 would be best and the circuit is designed to accommodate this range of weighted factors for the 50 percent mode. Applying similar considerations in the 70 percent mode, a weighting factor in the range of 1.0 to about 1.4 would be desirable. Again, the circuit has been designed to accommodate this range of weighting factors. Clearly, if these reduced modes are weighted, there is no need for a weighting factor for the 100 percent mode.

The weighting factor is introduced by feeding the one pulse per foot pulses into the weighted billing circuit, which has an output of pulses that are counted by counter CTR4. The pulses are fed from the weighted billing circuit to the counter by a divide by 40 device, so for every 40 pulses received by the divider, one pulse is added to the count on the counter CTR4. Each input pulse (i.e. one pulse per foot pulses) activates a pulse generator which in turn initiates the generation of a fixed number of pulses that are fed into the divide by 40 circuit. If, for example, the weighting factor required in the 70 percent mode is 1.325, the pulse generator is arranged (by means of a billing card to be described below) to provide an output of 53 pulses, (which when divided by 40 gives the required billing factor). Thus, for every pulse of the one pulse per foot pulses fed into the pulse generator, 53 pulses are fed to the divide by 40 circuit. This causes a count of one to be added to the counter CTR4, the remainder of 13 pulses remaining in store in the divider circuit. Next time a pulse is received, a further 53 counts are supplied to the divide by 40 circuit, and once again a count of one is added to the counter and the total remainder stored in the divider circuit is now 26 pulses. As soon as the stored remainder exceeds 40 an additional count is placed on the counter, any residue again being stored.

The pulse generator is arranged to generate the desired number of pulses (by means of respective billing cards) in each of the 50 percent and 70 percent modes, but in the case of the 100 percent mode, it is arranged that for every input pulse, 40 pulses are supplies to the divider circuit so as always to provide a count of one on the counter CTR4, thus holding any residue from a previous operation in either of the other two modes.

Figure 40:
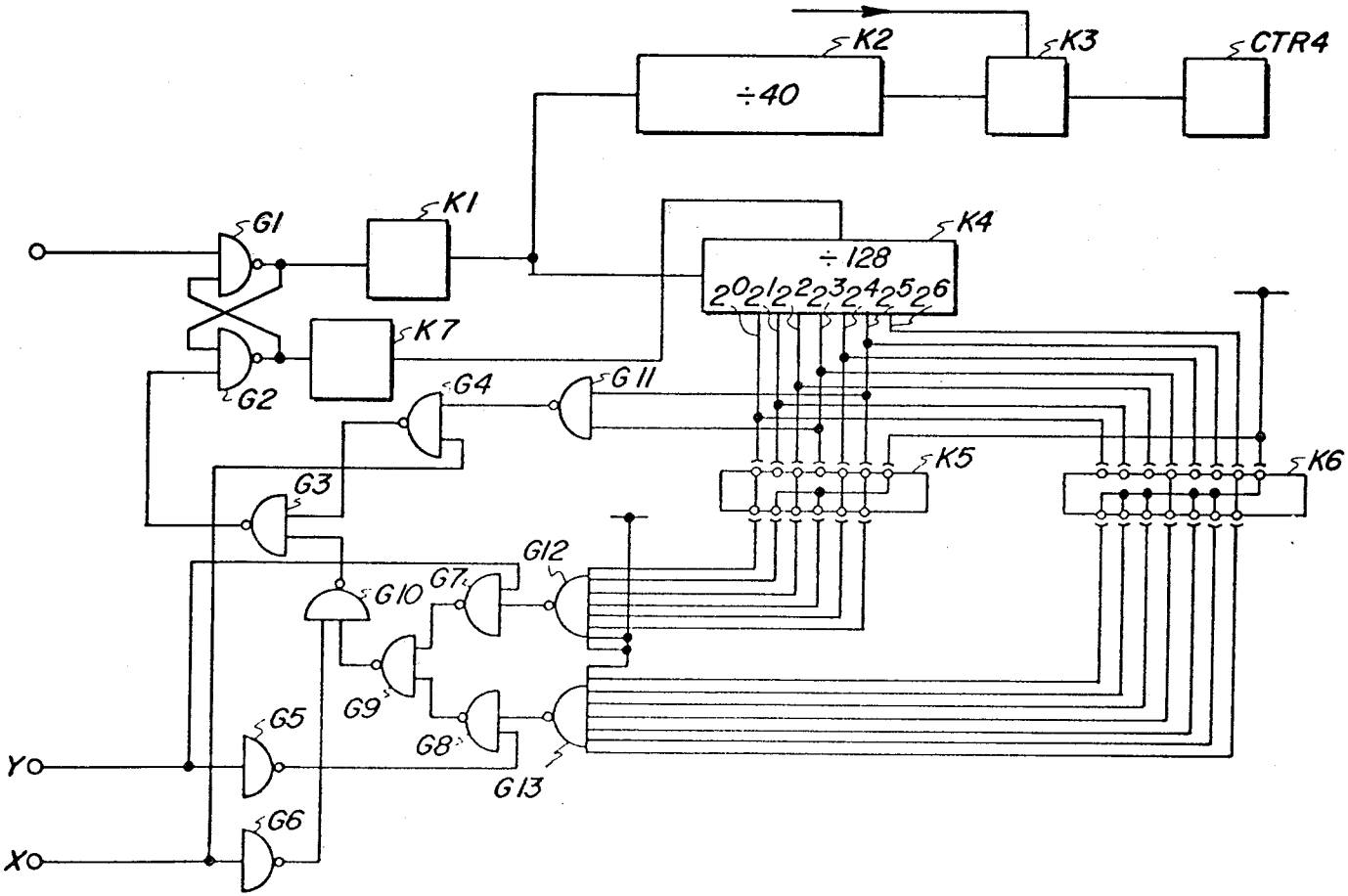
FIG. 40 is a circuit diagram of a weighted footage billing circuit.

Turning now to the circuit shown in FIG. 40 the one pulse per foot pulses are fed into gate G1 of a latching pair of gates G1 and G2. Using positive logic, the 1 output of Gate G1 starts a pulse generator K1 of, for example, 100 Hz. The output of this pulse generator is fed to two dividing circuits, the first dividing circuit being a divide by 40 circuit K2, the output of which drives counter CTR4 via a driving circuit K3, and the second dividing circuit being a divide by 128 circuit K4. The dividing circuit K3 is enabled when the machine is running. All the outputs of this second divider K4 are taken to two pre-wired billing cards K5 and K6 which separate from the billing unit on sockets, and which are easily changed. The billing cards are wired to sense a given count number corresponding to the desired weighting factor. Two cards K5 and K6 are used, to accommodate respectively the different weighting factors selected for the 70 percent and 50 percent reduction modes.

Figure 38:
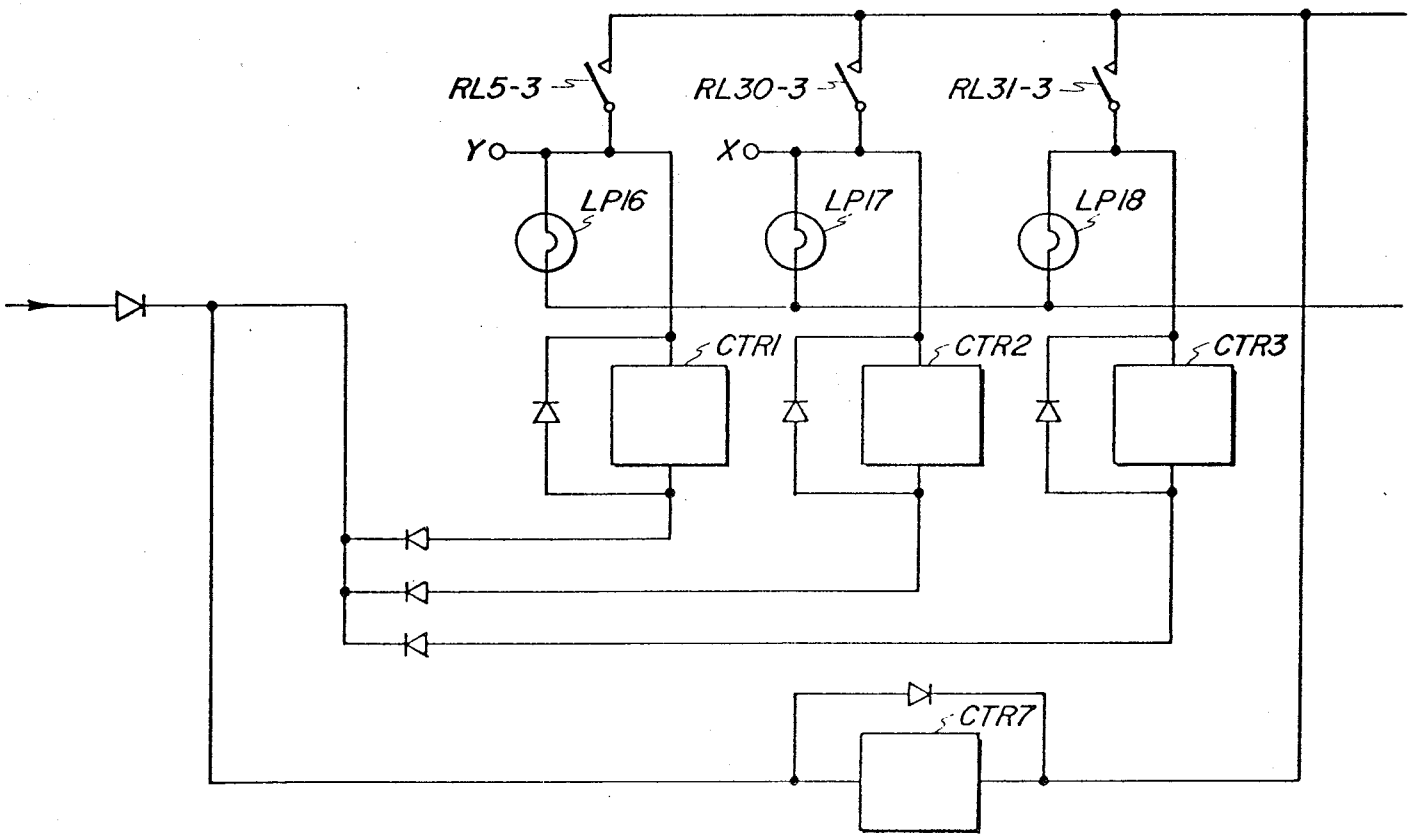
FIG. 38 is a circuit diagram of a footage billing circuit.
Figure 39:
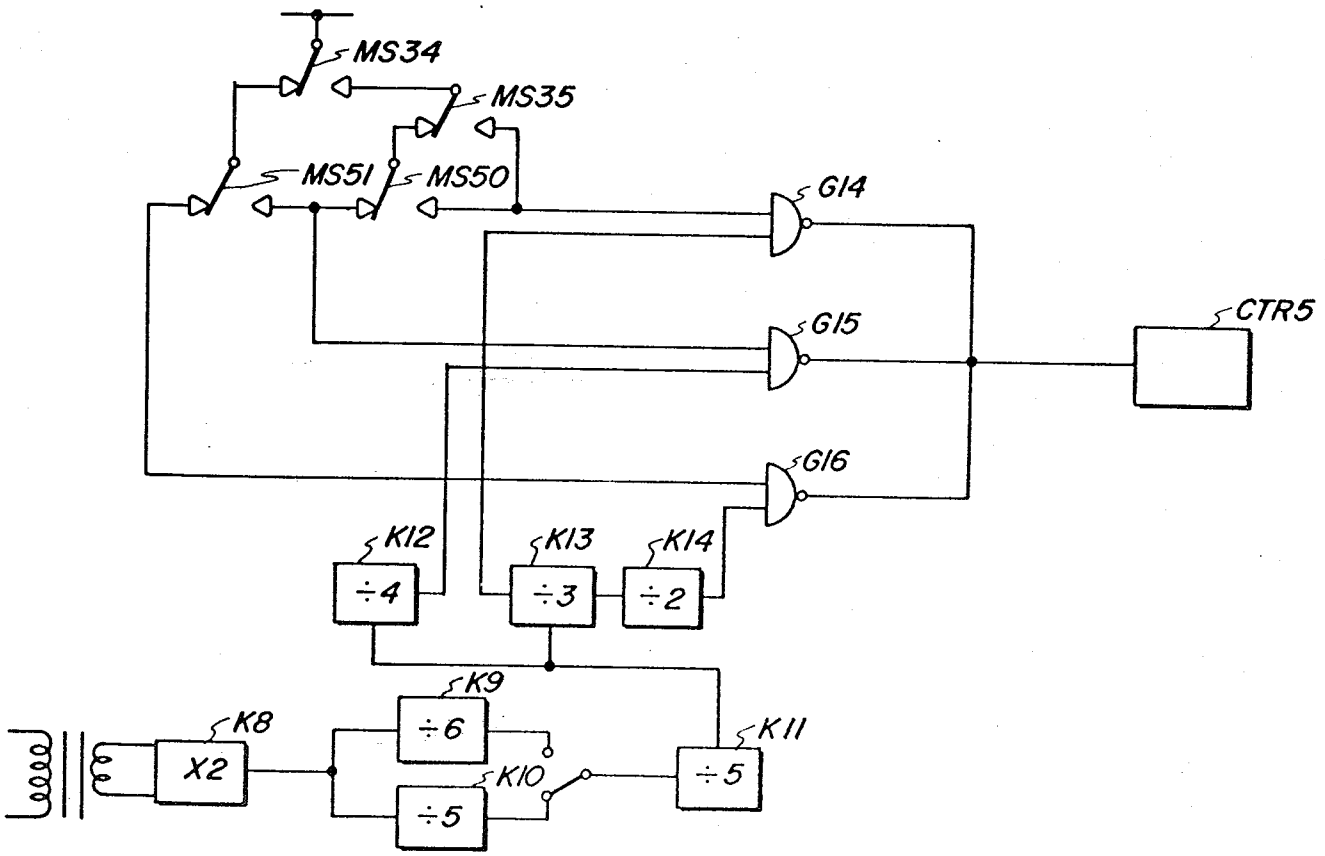
FIG. 39 is a circuit diagram of an area billing circuit.

Considering the case of the 70 percent mode, inputs *X* and *Y* to gates G6 and G5 are derived from the lens position switches MS42 and MS43, via relay contacts RL5-3 and RL30-3 respectively (see FIG. 38). For the 70 percent mode it is arranged that *X* is 0 and *Y* is 1. Gates G5 and G6 simply generate the inverse of *X* and *Y*. Gate G10 is disabled by X, and its output is 1 permanently. Gate G10 is enabled by the inverse of *X* (the output of gate G6). Gate G7 is enabled by *Y*, and gate G8 is disabled by the inverse of *Y* (the output from gate G5). A reset path is thus established from the 70 percent billing card K5 via gates G12, G7, G9, G10 and G3, to reset gate G2 of the bi-stable pair of gates G1, G2, the output of gate G2 then resetting the divide by 128 circuit K4 via a monostable K7. Thus on receipt of a footage input signal, the pulse generator K1 will give out the number of pulses determined by the wiring on the 70 percent billing card K5.

As mentioned above, the effective output of the divide by 40 circuit K2 will be the number set on the billing card K5 divided by 40. Thus, in the example given above, with the card wired at 53, the effective output will be 1.325.

If input *X* is 0 and input *Y* is 0 the reset path for gates G1 and G2 is established through gates G13, G8, G9, G10 and G3, i.e. via the 50 percent billing card K6, which has a number range above 80, so including factors up to and including 2.

If input *X* is 1, regardless of the state of input of *Y*, the reset circuit is by way of gates G11, G4 and G3. The input of gate G11 is permanently wired to give a count of 40 (a weighting factor of 1) for the 100 percent magnification mode.

The above described mode of operation ensures that any remainder in the divide by 40 counter is preserved.

Counter CTR5 (FIG. 39) indicates the total area, in square feet, of copy paper used. It is intended that the machine accommodate three standard roll widths, 24 inches, 18 inches and 12 inches; or 2 feet, 1½ feet and 1 foot respectively. Since it is required to indicate the square footage on the area meter, the product of footage count with the respective factor (2, 1½ or 1) must be evaluated and counted by the counter. For this purpose pulses or 1, 1½ or 2 pulses per foot are derived from mains frequency, depending on whether 12, 18 or 24 inch paper is used, thereby giving a direct measure of the number of square feet of paper used.

In order to determine which width of paper is being used, a set of four microswitches MS34, MS35, MS50 and MS51, is provided in the copy paper feed unit, between the feed rollers and the rotary knife. Microswitches MS34 and MS50 are situated 6 inches on either side of the centre line of the paper feed path, and microswitches MS35 and MS51 are situated 9 inches on either side of the centre line. All the microswitches are change-over microswitches, as shown in FIG. 39. Thus, if none of the microswitches are actuated, the microswitch circuit provides an output indicating a 12 inch wide copy paper sheet. If either or both of switches MS34 and MS50 are actuated, an output is provided indicating that the copy paper is 18 inches wide. If any three microswitches are actuated, including either or both of MS34 and MS50, the output of the microswitch circuit is such as to indicate a 24 inch wide copy paper roll.

If copy paper is deliberately fed off-centre, with the intention of cheating the billing system, it will be seen that if microswitches MS34 and MS35 are actuated, a 24 inch copy paper width is signalled, whatever its actual width. Similarly, if only MS50 and MS51 are actuated, an 18 inch width is indicated regardless of the actual width.

If the microswitches MS34, MS35, MS50 and MS51 indicate that a 24 inch wide copy paper sheet is present, gate G14 is enabled, thereby allowing 2 pulse per foot pulses to be feed to the area counter GTR5. If an 18 inch width is indicated, gate G15 is enabled, thereby allowing 1½ pulse per foot pulses to be fed to CTR5. If a 12 inch width is indicated (the condition shown in FIG. 39), gate G16 is enabled, thereby allowing 1 pulse per foot pulses to be fed to CTR5.

The way in which the pulses are derived can also be seen from FIG. 39. Mains frequency is provided from the output of a transformer T2 and is doubled by a frequency doubling circuit K8. The output of circuit K8 is fed to both a divide by 6 circuit K9 and a divide by 5 circuit K10. In the case of 60 Hz mains, the output of circuit K9 is fed to a further divide by 5 circuit K11, and in the case of 50 Hz mains, the output of circuit K10 is fed to circuit K11. In either case, the input to circuit K11 is 20 Kz, i.e. 30 pulses per foot of copy paper. The output of circuit K11 is thus 6 pulses per foot. The 6 pulse per foot pulses from circuit K11 are fed to a divide by 4 circuit K12 and also to a divide by 3 circuit K13. The output of circuit K12 accordingly provides the 1½ pulse per foot pulses, which are fed to gate G15. The output of circuit K13 provides the 2 pulse per foot pulses, which are fed to gate G14. An output from circuit K13 is further divided by 2 by circuit K14 to provide the 1 pulse per foot pulses that are fed to gate G16, as well as to the weighted billing circuit discussed above.

A direct area count, in square feet, is automatically recorded, accordingly, by counter CTR5.

In many areas of the machine described above, alternative embodiments of particular devices may be used. For example in an alternative embodiment of the puffer device (not shown) a hollow bar corresponding with bar 241 (FIGS. 15 to 18) may be cylindrical. The masking member in these circumstances may be a cylindrical sleeve which is a sliding fit over the bar. Apertures in the sleeve are arranged to expose different groups of puffer jets on rotation of the sleeve about the bar to predetermined angular positions. The apertures in the sleeve may be circumferentially spaced apertures, or may be circumferentially extending slots of lengths which are selected so that on angular movement of the sleeve to one of a plurality of predetermined positions, the required number of jet orifices are uncovered.

In a alternative embodiment of the fuser oil supply arrangement (not shown) four delivery tubes like the delivery tubes 165 (FIG. 10) are used to deliver fuser oil to four separate points spaced along the fuser roll. In these circumstances, it is possible to arrange either that the two inner-most delivery tubes only are operative, or that all four delivery tubes are operative. It is thus possible by having only the inner-most delivery tubes operative, to prevent fuser oil from being supplied to the outer portions of the fuser roll when the sheet of material carrying the image to be fused is less wide than the maximum useable width of the fuser roll. Wastage of fuser oil is accordingly reduced when narrower widths of imaged sheet material are used. In order to selectively shut off the supply of fuser oil to the outermost points along the fuser roll, it is possible to provide either a second peristaltic pump or a second cam, like cam 167, which is driven through a clutch from the drive of the cam 167. In either case, the delivery tubes for the outermost points may be rendered inoperative by stopping the second cam from rotating. This is done either by switching off the drive motor, or by disengaging the clutch.

What is claimed is:

1. In a method of electrostatic copying comprising the steps of continuously moving a reusable photoconductive surface past a charging corotron for charging thereof prior to exposure, feeding a document to be copied forwardly over an exposure slit to produce a first copy of the document, and then reversing the document and refeeding it in the forward direction over the exposure slit for each one of the second and subsequent copies, projecting an optical image of the document at the slit onto the continuously moving reusable photoconductive surface to enable a latent electrostatic image to be formed thereon by said optical image during forward feeding of said document, developing the latent electrostatic image and transferring the developed image to copy sheet, and cleaning the residual image from the reusable photoconductive surface, the improvement comprising switching off said charging corotron during reversal of the document over the exposure slit and projection of a backwards image thereof to prevent development of the image and avoid cleaning of the reusable photoconductive surface and switching on said cleaning corotron during the refeeding of the document in the forward direction and repeating the aforementioned steps to produce multiple copies thereof.

2. In a electrostatographic copying machine comprising means for continuously advancing a reusable photoconductive member past processing stations including corotron means for charging the surface thereof, means for feeding a document in a forward direction over an exposure slit in order to produce a first copy of said document, means for reversing and refeeding the document over the exposure slit in order to produce second and subsequent copies of the document, means for projecting an image of the document at the slit onto the surface of the continuously moving reusable photoconductive member which is adapted to be driven at a speed related to the speed of said document as it is fed over the exposure slit to enable a latent electrostatic image to be formed thereon during forward feeding of the document, means for developing and transferring the developed image to copy sheet, and means for cleaning the residual photoconductive surface the improvement comprising means for switching off said charging means during reversal of said document over the exposure slit and projection of a backwards image thereof to prevent development of the image and avoid cleaning of the reusable photoconductive surface and means for switching on said charging means during the refeeding of the document in the forward direction to produce multiple copies thereof.

* * * * *